US006927664B2

(12) United States Patent
Nakatani et al.

(10) Patent No.: US 6,927,664 B2
(45) Date of Patent: Aug. 9, 2005

(54) MUTUAL INDUCTION CIRCUIT

(75) Inventors: Toshifumi Nakatani, Sakai (JP); Hisashi Adachi, Mino (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/843,575

(22) Filed: May 12, 2004

(65) Prior Publication Data

US 2004/0227608 A1 Nov. 18, 2004

(30) Foreign Application Priority Data

May 16, 2003 (JP) ..... 2003-139357

(51) Int. Cl.[7] ..... H01F 5/00
(52) U.S. Cl. ..... 336/200
(58) Field of Search ..... 336/65, 83, 200, 336/206–208, 223, 232; 257/531

(56) References Cited

U.S. PATENT DOCUMENTS

| | | | | | |
|---|---|---|---|---|---|
| 4,613,843 | A | * | 9/1986 | Esper et al. | 336/232 |
| 4,959,631 | A | * | 9/1990 | Hasegawa et al. | 336/83 |
| 5,420,558 | A | | 5/1995 | Ito et al. | |
| 5,572,179 | A | * | 11/1996 | Ito et al. | 336/200 |
| 6,549,112 | B1 | * | 4/2003 | Gallina et al. | 336/200 |
| 6,661,325 | B2 | * | 12/2003 | Suh et al. | 336/200 |
| 6,759,937 | B2 | * | 7/2004 | Kyriazidou | 336/200 |
| 2002/0130387 | A1 | | 9/2002 | Carpentier | |
| 2003/0071706 | A1 | | 4/2003 | Christensen | |

FOREIGN PATENT DOCUMENTS

| | | |
|---|---|---|
| EP | 0 220 914 | 5/1987 |
| EP | 0 324 240 | 7/1989 |
| JP | 8-083717 | 3/1996 |
| JP | 11-176639 | 7/1999 |
| JP | 11-307723 | 11/1999 |
| JP | 2002-164704 | 6/2002 |
| WO | 97/01219 | 1/1997 |

OTHER PUBLICATIONS

Thomas Y.K. Wong et al., "A 10 Gb/s AlGaAs/GaAs HBT High Power Fully–differential Limiting Distributed Amplifier for III–V Mach–Zehnder Modulator", Gallium Arsenide Integrated Circuit (GAAS IC) Symposium, 1995, Technical Digest 1995, 17$^{th}$ Annual IEEE, San Diego, CA, USA, Oct. 29–Nov. 1, 1995, New York, NY, USA, IEEE, US, Oct. 29, 1995, pp 201–204, XP010196760, ISBN, 0–7803–2966–X.

* cited by examiner

*Primary Examiner*—Tuyen T Nguyen
(74) *Attorney, Agent, or Firm*—Wendeorth, Lind & Ponack, L.L.P.

(57) ABSTRACT

A transformer element 1 is formed on a semiconductor substrate using first and second wiring layers arranged parallel to each other in a vertical direction, and includes a first inductor 2 and a second inductor 3. The first and second inductors 2 and 3 are each provided using the first and second wiring layers such that if projected into one of the first and second wiring layers either along a vertical upward direction or a vertical downward direction, outlines of a projection form a symmetrical shape with respect to a predetermined reference plane, and portions corresponding to intersections between the outlines of the projection on the wiring layer are formed so as to be out of contact with each other.

23 Claims, 35 Drawing Sheets

MUTUAL INDUCTION CIRCUIT

BACKGROUND OF THE INVENTION

1. Field of the Invention

The present invention relates to a mutual induction circuit, and more particularly to a mutual induction circuit which is formed in first and second wiring layers parallel to each other in a vertical direction and is operated based on an input differential signal.

2. Description of the Background Art

In recent years, through the spread of mobile communication terminal apparatuses, typified by a mobile telephone, a variety of types of radio circuits have tended to be incorporated into an integrated circuit. In such a trend, a transformer element, which is an example of a mutual induction circuit highly used in radio circuits, also has tended to be incorporated into the integrated circuit. Three conventional transformer elements will be described below.

FIG. 32A is a top view schematically illustrating a structure of a transformer element as a first exemplary conventional mutual induction circuit (hereinafter, this transformer element is referred to as a "first mutual induction circuit 100" in this "Description of the Background Art" section). FIG. 32B is a schematic view illustrating a cross section of the first mutual induction circuit 100 taken along line V—V shown in FIG. 32A and viewed from the direction of arrow W1. In FIGS. 32A and 32B, the first mutual induction circuit 100 includes a primary coil 101 and a secondary coil 102. Both of the primary and secondary coils 101 and 102 are formed within an insulating layer 103 such that the primary coil 101 is situated immediately below the secondary coil 102. The primary coil 101 is roughly spiral shaped, and has a first input terminal A1 at one end and a second input terminal A2 at the other end. More specifically, the primary coil 101 is shaped as if a circle extends along one plane outwardly from the first input terminal A1 situated at an approximate center of the spiral. The second input terminal A2 is situated at the end of the outer circumferential side of the primary coil 101.

The secondary coil 102 has substantially the same shape as that of the primary coil 101, and is situated at a location to which the primary coil 101 is translated by a predetermined distance along a vertical direction. The secondary coil 102 has a first output terminal A3 at the end of the spiral center side and a second output terminal A4 at the end of the outer circumferential side.

In the above first mutual induction circuit 100, by applying an electrical signal to the first and second input terminals A1 and A2, an electrical signal in accordance with the ratio of the numbers of turns in the primary and secondary coils 101 and 102 is obtained from each of the first and second output terminals A3 and A4.

FIG. 33 is a vertical cross-sectional view schematically illustrating a structure of a transformer element as a second exemplary conventional mutual induction circuit (hereinafter, this transformer element is referred to as a "second mutual induction circuit 200" in this "Description of the Background Art" section). In FIG. 33, the second mutual induction circuit 200 includes a lower chip 201 and an upper chip 202. The lower chip 201 includes a secondary coil 205 formed on an insulating film 204 laminated on a semiconductor substrate 203. Similarly, the upper chip 202 includes a primary coil 208 formed on an insulating film 207 laminated on a semiconductor substrate 206. The lower and upper chips 201 and 202 are bonded together via a polyimide film 209. In this case, the primary and secondary coils 208 and 205 are situated symmetrical to each other with respect to a reference plane RP virtually formed within the polyimide film 209.

In the above second mutual induction circuit 200, by applying an electrical signal to one of the coils 205 and 208, an electrical signal in accordance with the ratio of the numbers of turns in the coils 205 and 208 is obtained from the other of the coils 205 and 208.

FIG. 34A is a top view schematically illustrating a structure of a transformer element as a third exemplary conventional mutual induction circuit (hereinafter, this transformer element is referred to as a "third mutual induction circuit 300" in this "Description of the Background Art" section). FIG. 34B is a cross-sectional view of the third mutual induction circuit 300 taken along line P—P shown in FIG. 34A and viewed from the direction of arrow Q. In FIGS. 34A and 34B, the third mutual induction circuit 300 is formed on a semiconductor substrate 301, and includes a first planar spiral coil 302, a second planar spiral coil 303, and a third planar spiral coil 304. The second planar spiral coil 303 is formed above the first planar spiral coil 302 via a first insulating film 305. In other words, the second planar spiral coil 303 is situated on the first insulating film 305 formed on the first planar spiral coil 302. Similarly, the third planar spiral coil 304 is formed above the second planar spiral coil 303 via a second insulating film 306. The end of the spiral center side of the first planar spiral coil 302 is electrically connected to the end of the spiral center side of the second planar spiral coil 303. Similarly, the end of the spiral outer circumferential side of the second planar spiral coil 303 is electrically connected to a neighborhood of the end of the spiral outer circumferential side of the third planar spiral coil 304.

A first input terminal 307 is formed by a signal line drawn out from a connection between the first and second planar spiral coils 302 and 303. Similarly, a second input terminal 308 is formed by a signal line drawn out from the end of the spiral center of the third planar spiral coil 304. Further, a first output terminal 309 is formed by an end portion on the spiral outer circumferential side of the first planar spiral coil 302, and a second output terminal 310 is formed by an end portion on the spiral outer circumferential side of the second planar spiral coil 304.

In the above third mutual induction circuit 300, by applying an electrical signal to the first input terminal 308 while grounding the first input terminal 307, a transformed electrical signal is applied between the first and second output terminals 309 and 310.

Similar to the transformer element, a differential inductor element, which is another example of the mutual induction circuit, has tended to be incorporated into the integrated circuit. Two conventional differential inductor elements will be described below.

FIG. 35 is a circuit diagram illustrating a differential switch circuit including a differential inductor element as a fourth exemplary conventional mutual induction circuit. FIG. 36 is a circuit diagram of a differential distributed amplifier circuit including a differential inductor element as a fifth exemplary conventional mutual induction circuit. In a simple comparison with a single-phase circuit, a differential circuit, such as the differential switch circuit shown in FIG. 35 or the differential distributed amplifier circuit shown in FIG. 36, requires twice the number of elements. In particular, an inductor element occupies a larger area relative to other types of elements. Accordingly, in the case of the above-mentioned differential circuit with high element density, the inductor element is a factor in increasing various costs. In order to address the above problem, Japanese Patent Laid-Open Publication No. 2002-164704 proposes a differential inductor element as described below.

FIGS. 37A and 37B are perspective views each illustrating the structure of the differential inductor element as the fifth exemplary conventional mutual induction circuit. In FIG. 37A, the differential inductor element includes two spiral inductor elements arranged in a vertical direction. Each spiral inductor element receives and outputs a balanced signal equivalent in amplitude but reversed in phase with respect to that received and outputted by the other spiral inductor element.

More specifically, a first spiral inductor includes a input wiring conductor 604*a*, a spiral wiring conductor 601*a* wound in a spiral form, and an output wiring conductor 605*a* for outputting a signal. Similarly, a second spiral inductor includes an input wiring conductor 604*b*, a spiral wiring conductor 601*b*, and an output wiring conductor 605*b*. In the above first and second spiral inductors, the spiral wiring conductors 601*a* and 601*b* are wounded in opposite directions, and are formed in upper and lower layers so as to overlap with each other via an insulating layer.

The input wiring conductor 604*a* is connected to the spiral wiring conductor 601*a* via a lead conductor 602*a*, and the input wiring conductor 604*b* is connected to the spiral wiring conductor 601*b* via a lead conductor 602*b*. The lead conductor 602*a* is formed in a wiring layer underlying a wiring layer in which the spiral wiring conductor 601*a* is formed, and the lead conductor 602*b* is formed in a wiring layer underlying a wiring layer in which the spiral wiring conductor 601*b* is formed. Interlayer contacts 603*a* through 603*d* are used for connections between different wiring layers.

In the differential inductor element of FIG. 37B, the spiral wiring conductors 601*a* and 601*b* are wounded in opposite directions, and the spiral wiring conductors 601*a* and 601*b*, excluding intersections 606*a* through 606*c*, are alternately arranged in the same wiring layer so as to be parallel to each other.

The differential inductor element as shown in FIGS. 37A and 37B is realized in an area approximately equivalent of an area occupied by one inductor element.

In some cases, a high frequency circuit, typified by a radio circuit incorporated into an integrated semiconductor circuit, is realized by a differential circuit in order to reduce common mode noise. However, in a conventional transformer element, coils are not symmetrical to each other when viewed from the signal input side. Accordingly, even if in-phase and reverse-phase signals contained in a differential signal are respectively supplied to two input terminals, there arises a problem that two signals, which are reversed in phase with respect to each other, might not be obtained from the two output terminals.

Note that if the above-described conventional transformer elements (see FIGS. 32A and 32B) are used in even numbers, it is possible to realize the symmetry as described above. However, there arises another problem that the transformer elements occupy a large area of a semiconductor integrated circuit.

In order to reduce internal losses due to resistive components of a semiconductor substrate, the transformer element is generally formed in a wiring layer located as far away from the semiconductor substrate as possible. A conventional transformer element requires three or more wiring layers. For example, in the first mutual induction circuit 100, one wiring layer is required for each of the primary and secondary coils 101 and 102. Moreover, each of the primary and secondary coils 101 and 102 has one terminal at its spiral center side, and therefore an additional wiring layer is required for a signal line for supplying an input signal or outputting an output signal. Similarly, the second transformer element 200 includes the coils 208 and 205, which are shaped similar to the primary and secondary coils 101 and 102, respectively, and therefore requires three winding layers. As for the transformer element 300, three wiring layers are required only for forming three planar spiral coils 302 through 304.

As is apparent from the foregoing, a considerable number of wiring layers are required for forming a conventional transformer element. Moreover, only a limited number of wiring layers can be formed in a semiconductor process. Accordingly, there are difficulties in forming the conventional transformer element sufficiently away from the semiconductor substrate so as to reduce internal losses due to resistive components of the semiconductor substrate.

Similarly, in a conventional differential inductor element, two inductors are not formed in a symmetric manner. Accordingly, even if in-phase and reverse-phase signals contained in a differential signal are respectively supplied to two input terminals, there arises a problem that two signals, which are reversed in phase with respect to each other, might not be obtained from the two output terminals. As in the case of the conventional transformer element, if the conventional differential inductor element is used in even numbers, it is possible to realize the symmetry as described above. However, there arises another problem that the differential inductor elements occupy a large area of a semiconductor integrated circuit.

SUMMARY OF THE INVENTION

Therefore, an object of the present invention is to provide a small-footprint mutual induction circuit.

Another object of the present invention is to provide a low-loss mutual induction circuit which can be formed by a small number of wiring layers.

The present invention has the following features to attain the objects mentioned above.

A first aspect of the present invention is directed to a mutual induction circuit formed using first and second wiring layers arranged parallel to each other in a vertical direction, the circuit including: a first inductor and a second inductor situated such that a magnetic flux induced in the first inductor passes therethrough, the first and second inductors each being provided using the first and second wiring layers such that if projected into one of the first and second wiring layers either along a vertical upward direction or a vertical downward direction, outlines of a projection form a symmetrical shape with respect to a first reference plane, and portions corresponding to intersections between the outlines of the projection on the wiring layer are formed so as to be out of contact with each other.

The mutual induction circuit is exemplarily a transformer element, and the first inductor includes first and second input terminals to which in-phase and reverse-phase signals contained in a differential signal are inputted, the in-phase and reverse-phase signals inputted into the first and second input terminals inducing a magnetic flux. The second inductor includes first and second output terminals from which transformed in-phase and reverse-phase signals are outputted via mutual induction with the first inductor.

Either one of the first and second inductors preferably includes: a plurality of pairs of first and second partially looped lines provided in either the first or second wiring layer along a direction from an outer circumferential side to an inner circumferential side, such that the first and second partially looped lines in each pair are situated symmetrical to and separate from each other with respect to the first reference plane; and at least one connection line formed in another one of the first and second wiring layers, so as to connect, via two contacts formed between the first and second wiring layers, one first partially looped line formed on the outer circumferential side to one second partially looped line situated one turn inward from the one first partially looped line situated on the outer circumferential side.

The first inductor preferably includes: a plurality of pairs of first and second partially looped lines provided in the first wiring layer along a direction from an outer circumferential side to an inner circumferential side, such that the first and second partially looped lines in each pair are situated symmetrical to and separate from each other with respect to the first reference plane; a first connection line formed in the second wiring layer, so as to connect, via two contacts, one first partially looped line formed on the outer circumferential side at a first side with respect to the first reference plane to one second partially looped line situated one turn inward from the one first partially looped line so as to be opposed to the one first partially looped line at a second side with respect to the first reference plane; and a second connection line formed in the first wiring layer, so as to connect one first partially looped line formed on the outer circumferential side at the second side with respect to the first reference plane to one second partially looped line situated one turn inward from the one first partially looped line so as to be opposed to the one first partially looped line at the first side with respect to the first reference plane. The second inductor preferably includes: a plurality of pairs of first and second partially looped lines provided in the second wiring layer along a direction from the outer circumferential side to the inner circumferential side, such that the first and second partially looped lines in each pair are situated symmetrical to and separate from each other with respect to the first reference plane; a first connection line formed in the first wiring layer, so as to connect, via two contacts, one first partially looped line formed on the outer circumferential side at the first side with respect to the first reference plane to one second partially looped line situated one turn inward from the one first partially looped line so as to be opposed to the one first partially looped line at the second side with respect to the first reference plane; and a second connection line formed in the second wiring layer, so as to connect one first partially looped line formed on the outer circumferential side at the second side with respect to the first reference plane to one second partially looped line situated one turn inward from the one first partially looped line so as to be opposed to the one first partially looped line at the first side with respect to the first reference plane.

The first and second partially looped lines included in the second inductor are preferably absent vertically immediately below or above the first and second partially looped lines included in the first inductor.

The mutual induction circuit further includes a contact for electrically connecting a virtual center of the first inductor to a virtual center of the second inductor.

The first inductor preferably includes: a plurality of pairs of first and second partially looped lines provided in the first wiring layer along a direction from an outer circumferential side to an inner circumferential side, such that the first and second partially looped lines in each pair are situated symmetrical to and separate from each other with respect to the first reference plane; a first connection line formed in the second wiring layer, so as to connect, via two contacts, one first partially looped line formed on the outer circumferential side at a first side with respect to the first reference plane to one second partially looped line situated one turn inward from the one first partially looped line so as to be opposed to the one first partially looped line at a second side with respect to the first reference plane; and a second connection line formed in the first wiring layer, so as to connect one first partially looped line formed on the outer circumferential side at the second side with respect to the first reference plane to one second partially looped line situated one turn inward from the one first partially looped line so as to be opposed to the one first partially looped line at the first side with respect to the first reference plane. The second inductor preferably includes: a plurality of pairs of first and second partially looped lines provided in the first wiring layer along a direction from the outer circumferential side to the inner circumferential side, so as to alternate with the plurality of pairs of first and second partially looped lines included in the first inductor; a first connection line formed in the first wiring layer, so as to connect, via two contacts, one first partially looped line formed on the outer circumferential side at the first side with respect to the first reference plane to one second partially looped line situated one turn inward from the one first partially looped line so as to be opposed to the one first partially looped line at the second side with respect to the first reference plane; and a second connection line formed in the second wiring layer, so as to connect one first partially looped line formed on the outer circumferential side at the second side with respect to the first reference plane to one second partially looped line situated one turn inward from the one first partially looped line so as to be opposed to the one first partially looped line at the first side with respect to the first reference plane.

The first and second inductors are exemplarily shaped so as to be symmetrical to each other with respect to a second reference plane perpendicular to the first reference plane.

The first inductor preferably includes: a plurality of pairs of first and second partially looped lines provided in the first wiring layer along a direction from an outer circumferential side to an inner circumferential side, such that the first and second partially looped lines in each pair are situated symmetrical to and separate from each other with respect to the first reference plane; a first connection line formed in the second wiring layer, so as to connect, via two contacts, one first partially looped line formed on the outer circumferential side at a first side with respect to the first reference plane to one second partially looped line situated one turn inward from the one first partially looped line so as to be opposed to the one first partially looped line at a second side with respect to the first reference plane; and a second connection line formed in the first wiring layer, so as to connect one first partially looped line formed on the outer circumferential side at the second side with respect to the first reference plane to one second partially looped line situated one turn inward from the one first partially looped line so as to be opposed to the one first partially looped line at the first side with respect to the first reference plane. The second inductor preferably includes: a plurality of pairs of first and second partially looped lines provided in the first wiring layer along a direction from the outer circumferential side to the inner circumferential side, so as to alternate with the plurality of pairs of first and second partially looped lines included in the first inductor; a first connection line formed in the first wiring layer, so as to connect, via two contacts, one first partially looped line formed on the outer circumferential side at the first side with respect to the first reference plane to one second partially looped line situated one turn inward from the one first partially looped line so as to be opposed to the one first partially looped line at the second side with respect to the first reference plane; and a second connection line formed in the second wiring layer, so as to connect one first partially looped line formed on the outer circumferential side at the second side with respect to the first reference plane to one second partially looped line situated one turn inward from the one first partially looped line so as to be opposed to the one first partially looped line at the first side with respect to the first reference plane. The first partially looped lines included in the second inductor are adjacent to each other in the first wiring layer, and the second partially looped lines included in the second inductor are adjacent to each other in the first wiring layer.

The mutual induction circuit preferably further includes a line for electrically connecting a virtual center of the first inductor to a virtual center of the second inductor.

In the mutual induction circuit, the first wiring layer is preferably thicker than the second wiring layer.

The first and second input terminals are preferably situated at opposite ends of a line forming an outermost turn of the first inductor, and the first and second output terminals are situated at the opposite ends of the line forming the outermost turn of the first inductor.

The mutual induction circuit preferably further includes: a third inductor having first and second input terminals for receiving the in-phase and reverse-phase signals contained in the differential signal inputted into the first inductor, the received in-phase and reverse-phase signals inducing the magnetic flux; and a fourth inductor situated such that the magnetic fluxes induced in the first and third inductor pass therethrough, and the fourth inductor including first and second output terminals from which transformed in-phase and reverse-phase signals are outputted via mutual induction with the first inductor. The third and fourth inductors are formed in the second wiring layer so as to have substantially the same shape as those of projections of the first and second inductors onto one surface of the second wiring layer along the vertical downward direction. The first and third inductors are electrically connected together via a plurality of contacts, and the second and fourth inductors are electrically connected together via a plurality of contacts.

The mutual induction circuit preferably further includes: a line for connecting a virtual center of the first inductor to a virtual center of the second inductor; and a line for connecting a virtual center of the third inductor to the virtual center of the second inductor.

In the mutual induction circuit, the first and second wiring layers are preferably formed on a semiconductor substrate. The mutual induction circuit further includes a shield formed in a third wiring layer which is closer to the semiconductor substrate than the first and second wiring layers are, and the shield has a radial pattern or radially arranged holes.

In the mutual induction circuit, the first and second wiring layers are preferably formed on a semiconductor substrate. The mutual induction circuit further includes radially arranged trenches situated closer to the semiconductor substrate than the first and second wiring layers are.

In the mutual induction circuit, the first and second wiring layers are preferably formed on a dielectric laminated substrate.

In the mutual induction circuit, the first and second wiring layers are preferably formed on a dielectric single layer double-sided substrate.

The mutual induction circuit is exemplarily a balun, and one of the first and second input terminals or one of the first and second output terminals is grounded.

Further, the first inductor exemplarily includes a first input terminal and a first output terminals which are used for receiving and outputting the in-phase signal contained in the differential signal, the in-phase signal received by the first input terminal inducing the magnetic flux. The second inductor includes a second input terminal and a second output terminal which are used for receiving and outputting the reverse-phase signal contained in the differential signal, the reverse-phase signal received by the second input terminal inducing the magnetic flux.

A second aspect of the present invention is directed to an oscillation circuit including: an oscillation stage for generating a differential signal having a predetermined frequency; a mutual induction circuit for transforming the differential signal generated by the oscillation stage; and an amplification stage for amplifying the differential signal amplified by the mutual induction circuit. The mutual induction circuit is a transformer element formed on a semiconductor substrate using first and second wiring layers which are parallel to each other in a vertical direction, the transformer element including: a first inductor including first and second input terminals to which in-phase and reverse-phase signals contained in the differential signal generated by the oscillation stage are inputted, the inputted in-phase and reverse-phase signals inducing a magnetic flux; a second inductor situated such that the magnetic flux induced in the first inductor passes therethrough, and includes first and second output terminals from which transformed in-phase and reverse-phase signals are outputted via mutual induction with the first inductor; and a contact for electrically connecting a virtual center of the first inductor to a virtual center of the second inductor. The first and second inductors are each provided using the first and second wiring layers such that if projected into one of the first and second wiring layers either along a vertical upward direction or a vertical downward direction, outlines of a projection form a symmetrical shape with respect to a predetermined reference plane, and portions corresponding to intersections between the outlines of the projection on the wiring layer are formed so as to be out of contact with each other.

The oscillation circuit is preferably incorporated into a radio communication apparatus.

A third aspect of the present invention is directed to an amplification circuit including: a plurality of first mutual induction circuits connected in series with each other, each of the first mutual induction circuit operable to receive a differential signal; a first termination circuit connected to a last one of the plurality of first mutual induction circuits and including at least a differential termination resistor; a plurality of amplification stages for amplifying differential signals outputted from all but the last one of the plurality of the first mutual induction circuits; a second termination circuit including at least a differential termination resistor and terminating a differential signal outputted from each of the amplification stages; and a plurality of second mutual induction circuits connected in series with each other. One of the plurality of second mutual induction circuits is connected to the second termination circuit, all but the one of the plurality of second mutual induction circuits each are connected to a corresponding one of the plurality of amplification stages, and each of the plurality of first and second mutual induction circuits is formed using first and second wiring layers arranged parallel to each other in a vertical direction, each of the plurality of first and second mutual induction circuits including: a first inductor; and a second inductor situated where a magnetic flux induced in the first inductor passes therethrough. The first and second inductors are each provided using the first and second wiring layers such that if projected into one of the first and second wiring layers either along a vertical upward direction or a vertical downward direction, outlines of a projection form a symmetrical shape with respect to a predetermined reference plane, and portions corresponding to intersections between the outlines of the projection on the wiring layer are formed so as to be out of contact with each other.

Thus, in the first through third aspects of the present invention, the mutual induction circuit includes two inductors formed by only first and second wiring layers so as to have substantial plane symmetry. Accordingly, it is not necessary to provide a plurality of inductors on each of the primary and secondary sides, whereby it is possible to realize a small-footprint mutual induction circuit. This makes it possible to reduce the number of wiring layers used for forming the mutual induction circuit, whereby it is possible to form the mutual induction circuit sufficiently away from the semiconductor substrate so as to reduce internal losses due to resistive components of the semiconductor substrate.

These and other objects, features, aspects and advantages of the present invention will become more apparent from the following detailed description of the present invention when taken in conjunction with the accompanying drawings.

DESCRIPTION OF THE PREFERRED EMBODIMENTS (First Embodiment)

Figure 1:
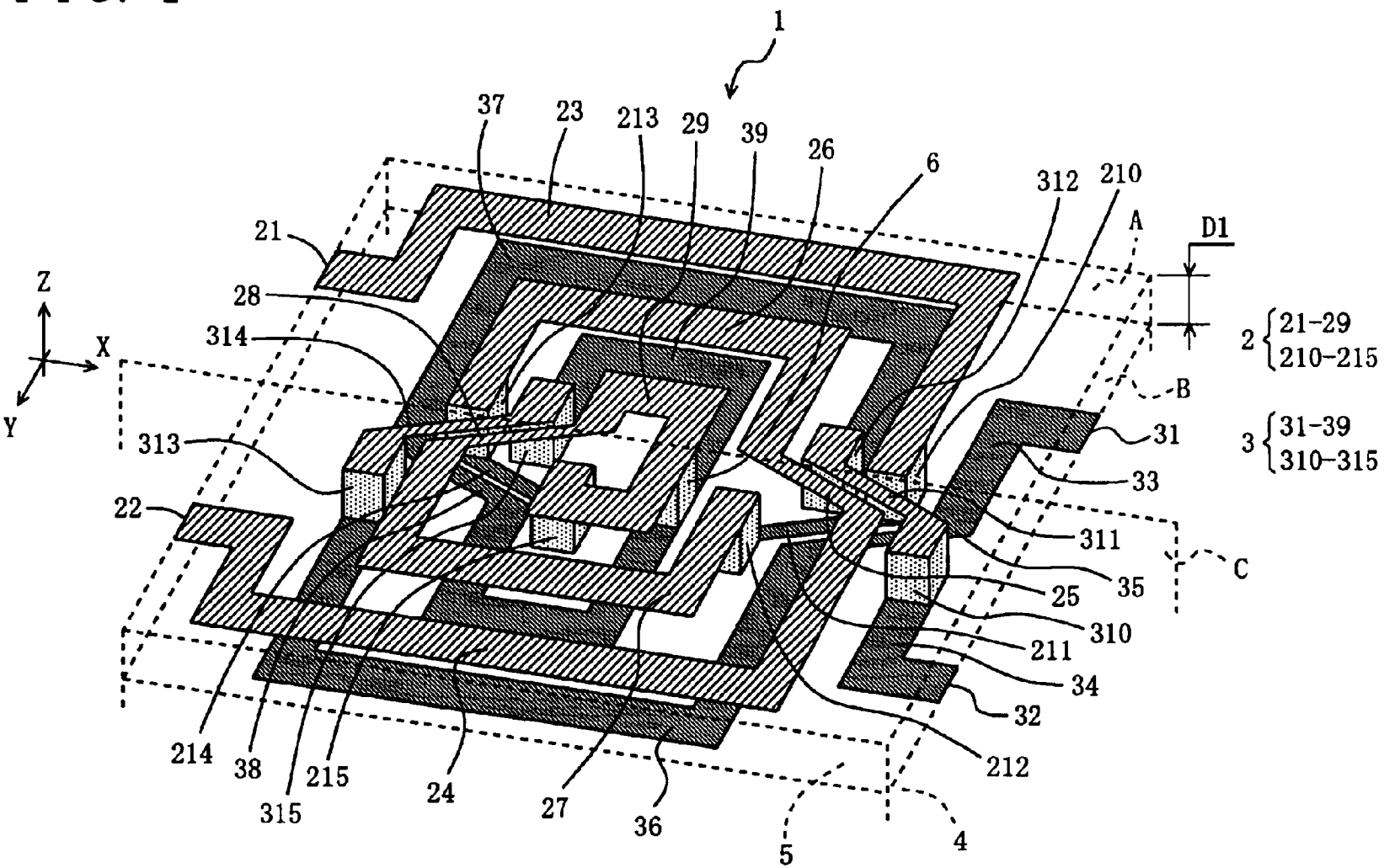
FIG. 1 is a perspective view illustrating the structure of a mutual induction circuit 1 according to a first embodiment of the present invention.
Figure 2:
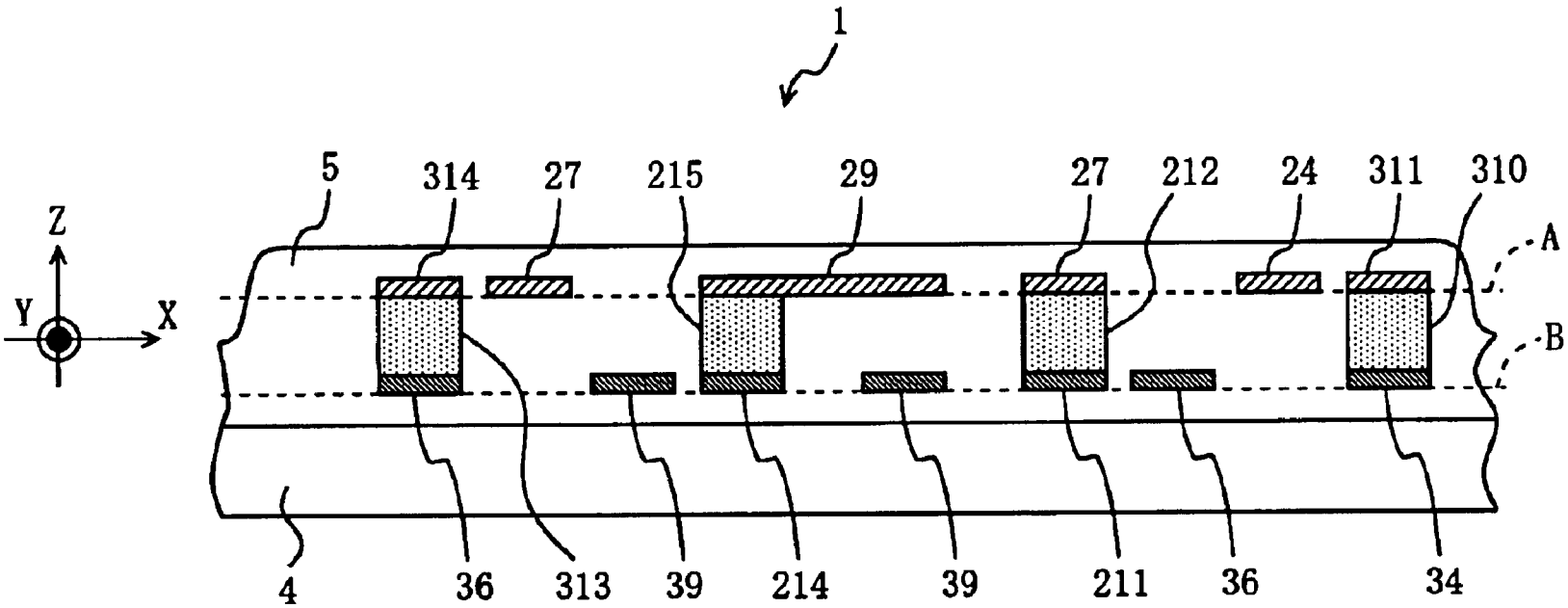
FIG. 2 is a cross-sectional view of the mutual induction circuit 1 of FIG. 1 taken along plane C (see FIG. 1) parallel to the ZX plane.

FIG. 1 is a perspective view illustrating the structure of a transformer element which is an example of a mutual induction circuit 1 according to a first embodiment of the present invention. For ease of description, a three-dimensional coordinate system consisting of X-, Y-, and Z-axes is shown in FIG. 1. FIG. 2 is a cross-sectional view of the mutual induction circuit 1 of FIG. 1 taken along plane C (see FIG. 1) parallel to the ZX plane.

As shown in FIGS. 1 and 2, the mutual induction circuit 1 is formed across two wiring layers arranged in the Z-axis direction (i.e., a vertical direction) within an interlayer insulating film 5 on a semiconductor substrate 4. In the following descriptions, an upper wiring layer, a lower wiring layer, and an interlayer between the upper and lower wiring layers are referred to as an "upper layer", a "lower layer", and an "interlayer", respectively. Specifically, the mutual induction circuit 1 is made of a conductive material, and essentially includes a first inductor 2 and a second inductor 3.

Figure 3:
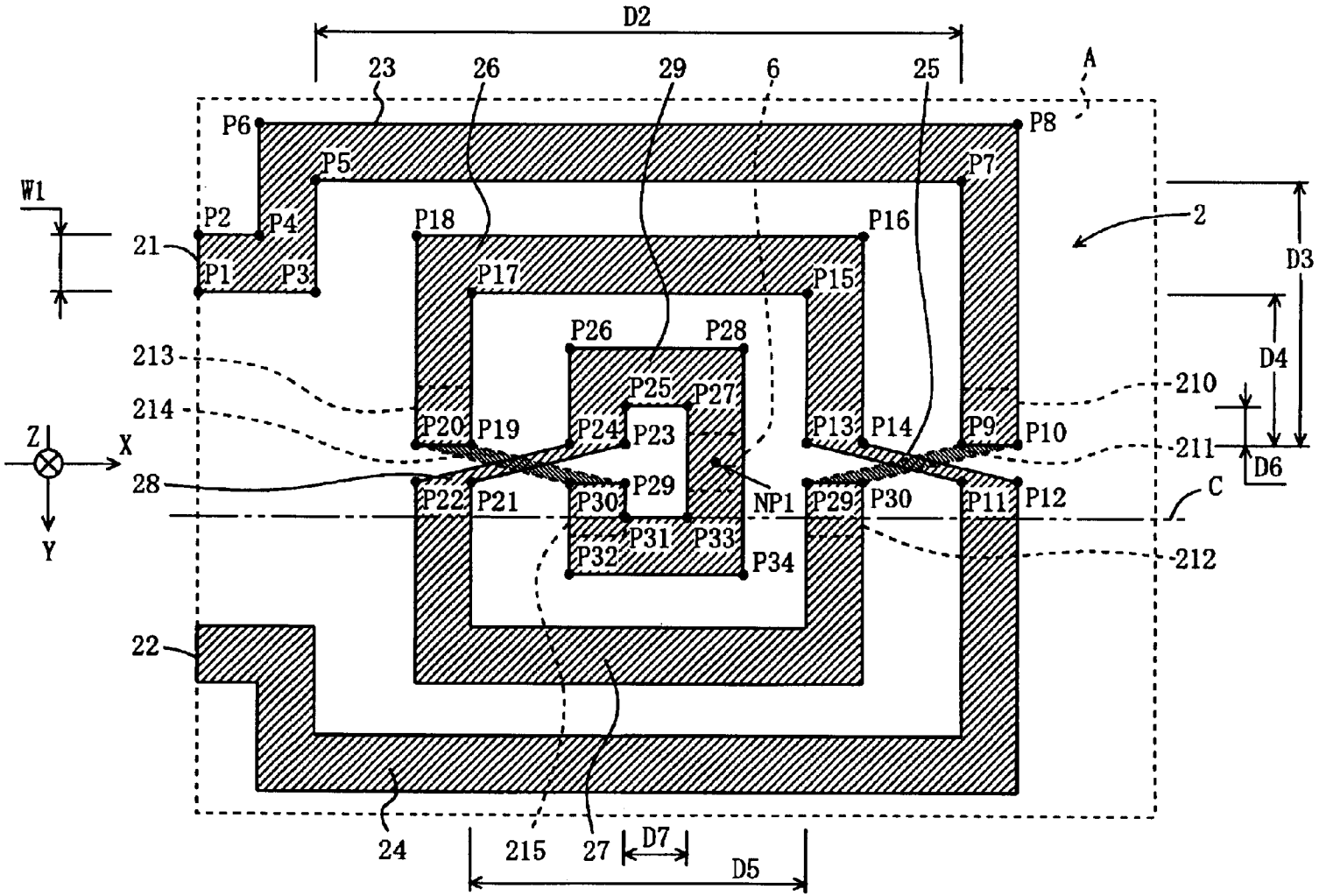
FIG. 3 is a view schematically illustrating elements of a first inductor 2 shown in FIG. 1 in a cross section of the mutual induction circuit 1 of FIG. 1 taken along plane A (see FIG. 1) parallel to the XY plane.
Figure 4:
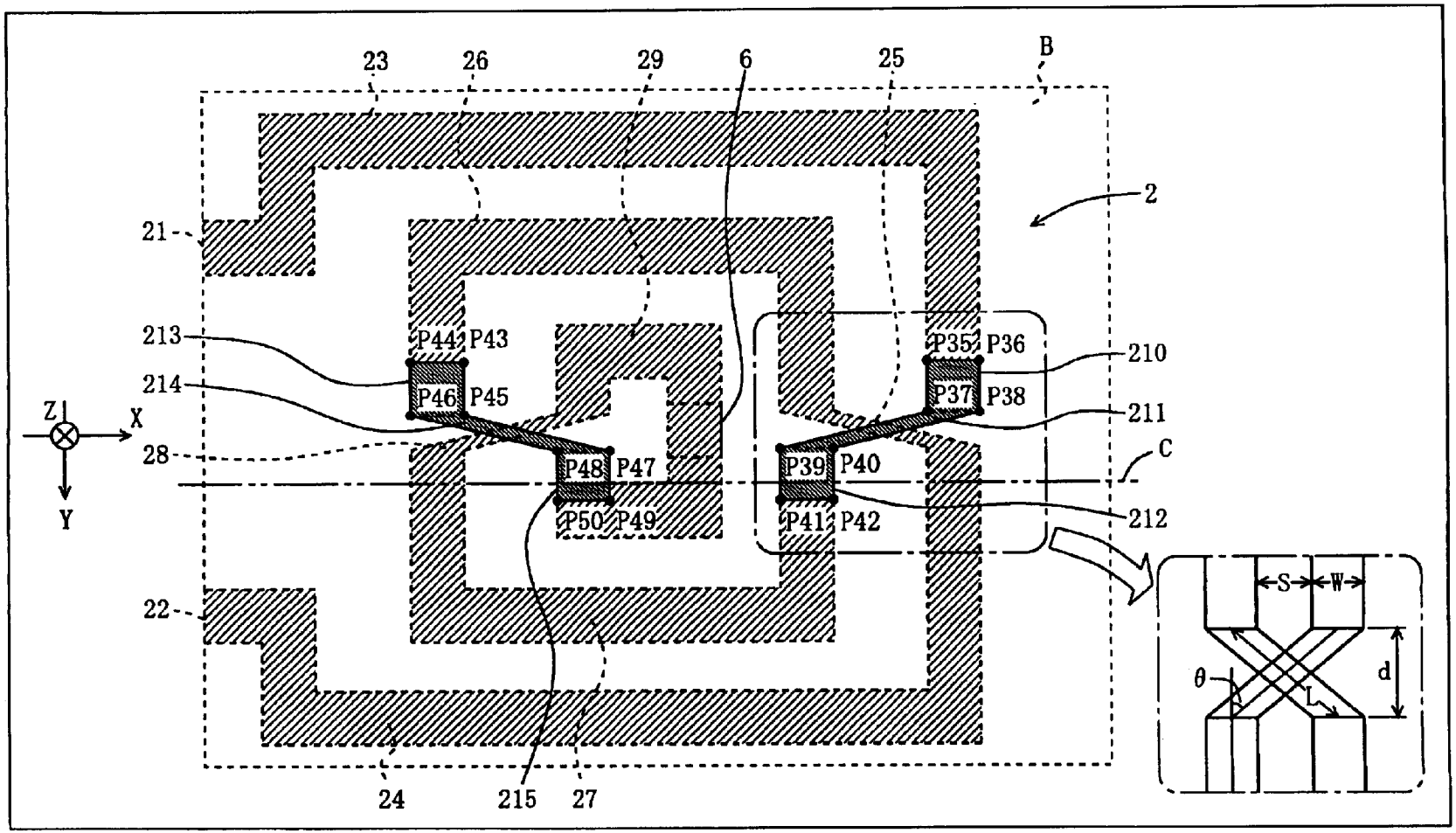
FIG. 4 is a view schematically illustrating elements of the first inductor 2 shown in FIG. 1 in a cross section of the mutual induction circuit 1 of FIG. 1 taken along plane B (see FIG. 1) which is included in a lower layer and corresponds to a plane translated from plane A (see FIG. 1) by a distance of D1 along the negative direction of the Z-axis.

FIG. 3 is a view schematically illustrating elements of the first inductor 2 in a cross section of the mutual induction circuit 1 taken along plane A (see FIG. 1) parallel to the XY plane in the upper layer. FIG. 4 is a view schematically illustrating elements of the first inductor 2 in a cross section of the mutual induction circuit 1 taken along plane B (see FIG. 1) which is included in the lower layer and corresponds to a plane translated from plane A (see FIG. 1) by a distance of D1 (see FIG. 1) along the negative direction of the Z-axis. Note that in FIGS. 3 and 4, elements of the first inductor 2, which are not present on either plane A or B, are all indicated by dotted lines.

The first inductor 2 is made of a conductive material. As shown in FIGS. 1 through 4, most elements of the first inductor 2 are present on plane A, and other elements are present either on plane B or in the interlayer. Specifically, in the first inductor 2, provided on plane A are first and second terminals 21 and 22 and first through seventh lines 23 through 29 which are typically microstrip lines.

The first and second terminals 21 and 22 are situated symmetrical to each other with respect to the ZX plane. Note that in the present embodiment, the first and second terminals 21 and 22 are exemplarily shown as an end of the first line 23 and an end of the second line 24, respectively.

The first line 23 is a partially looped line forming a portion of the outermost turn of the first inductor 2 and electrically connecting the first terminal 21 to a first contact 210 which will be described later. In the present embodiment, the first line 23 is exemplarily formed within an area defined by ten points P1 through P10 as described below (see FIG. 3). Point P1 has X- and Y-coordinate values (X1,−Y1), where X1 and Y1 are positive values determined in accordance with specifications of the mutual induction circuit 1. If the width of the first line 23 is W1, point P2 corresponds to a point translated from point P1 by a distance of W1 along the negative direction of the Y-axis. Point P3 corresponds to a point translated from point P1 by a distance greater than W1 along the positive direction of the X-axis. Point P4 corresponds to a point translated from point P3 by a distance of W1 along the negative direction of the X-axis. Point P5 corresponds to a point translated from point P3 by a distance of W1 or more along the negative direction of the Y-axis. Point P6 corresponds to a point translated from point P4 by a distance of W1 or more along the negative direction of the Y-axis. Point P7 corresponds to a point translated from point P5 by a distance of D2 along the positive direction of the X-axis. Note that D2 is a positive value determined in accordance with specifications of the mutual induction circuit 1. Point P8 corresponds to a point translated from point P7 by a distance of W1 along both the positive direction of the X-axis and the negative direction of the Y-axis. Point P9 corresponds to a point translated from point P7 by a distance of D3 along the positive direction of the Y-axis. Note that D3 is a positive value determined in accordance with specifications of the mutual induction circuit 1 so as to be at least less than a Y-coordinate value at point P7. Point P10 corresponds to a point translated from point P9 by a distance of W1 along the positive direction of the X-axis.

The second line 24 is a partially looped line forming a portion of the outermost turn of the first inductor 2 and electrically connecting the second terminal 22 to a third line 25 which will be described later. The second line 24 is situated symmetrical to the first line 23 with respect to the ZX plane.

The third line 25 electrically connects the second line 24 to a fourth line 26 which will be described later. In the present embodiment, the third line 25 is exemplarily formed within a parallelogram having, as vertices, four points P11 through P14 as described below (see FIG. 3). Points P11 and P12 are situated symmetrical to the above-described points P9 and P10, respectively, with respect to the ZX plane. Point P13 corresponds to a point translated from point P9 by a distance greater than W1+W2 along the negative direction of the X-axis. Note that W2 is equivalent to the width of a fifth line 37 which will be described later. Point P14 corresponds to a point translated from point P13 by a distance of W1 along the positive direction of the X-axis.

The fourth line 26 is a partially looped line forming a portion of a turn situated one turn inward from the outermost turn of the first inductor 2 and electrically connecting the third line 25 to a third contact 213 which will be described later. In the present embodiment, the fourth line 26 is exemplarily formed within an area defined by eight points P13 through P20 as described below (see FIG. 3). As in the case of the first line 23, the width of the fourth line 26 is W1. Points 13 and 14 are as described above. Point P15 corresponds to a point translated from P13 by a distance of D4 along the negative direction of the Y-axis. Note that D4 is a positive value determined in accordance with specifications of the mutual induction circuit 1 so as to be less than D3−W1. Point P16 corresponds to a point translated from point P15 by a distance of W1 along both the positive direction of the X-axis and the negative direction of the Y-axis. Point P17 corresponds to a point translated from point P15 by a distance of D5 along the negative direction of the X-axis. Note that D5 is a positive value determined in accordance with specifications of the mutual induction circuit 1 so as to be less than D2−(2×W1+2×W2). Point P18 corresponds to a point translated from point P17 by a distance of W1 along the negative direction of each of the X- and Y-axes. Point P19 corresponds to a point translated from point P17 by a distance of D4 along the positive direction of the Y-axis. Point P20 corresponds to a point translated from point P19 by a distance of W1 along the negative direction of the X-axis.

A fifth line 27 is a partially looped line forming a portion of a turn situated one turn inward from the outermost turn of the first inductor 2 and electrically connecting a second contact 212 and a sixth line 28 both of which will be described later. The fifth line 27 is situated symmetrical to the fourth line 26 with respect to the ZX plane.

The sixth line 28 electrically connects the fifth line 27 to a seventh line 29 which will be described later. In the present embodiment, the sixth line 28 is exemplarily formed within an area enclosed by a parallelogram having, as vertices, four points P21 through P24 as described below (see FIG. 3). Points P21 and P22 are situated symmetrical to the above-described points P19 and P20, respectively, with respect to the ZX plane. Point P23 corresponds to a point translated from point P19 by a distance slightly greater than W1+W2 along the positive direction of the X-axis. Point P24 corresponds to a point translated from point P23 by a distance of W1 along the negative direction of the X-axis.

The seventh line 29 is a partially looped line forming the innermost turn of the first inductor 2 and electrically connecting the sixth line 28 to a fourth contact 215. Note that the width of the seventh line 29 is W1. In the present embodiment, the seventh line 29 is exemplarily formed within an area defined by twelve points P23 through P34 as described below (see FIG. 3). Points P23 and P24 are as described above. Point P25 corresponds to a point translated from point P23 by a distance of D6 along the negative direction of the Y-axis. Note that D6 is a value determined in accordance with specifications of the mutually induction circuit 1, more specifically, a positive value less than D4−W1. Point P26 corresponds to a point translated from point P25 by a distance of W1 along the negative direction of each of the X- and Y-axes. Point P27 corresponds to a point translated from point P25 by a distance of D7 along the positive direction of the X-axis. Note that D7 is a positive value less than D5−(2×W1+W2). Point P28 corresponds to a point translated from point P27 by a distance of W1 along both the positive direction of the X-axis and the negative direction of the Y-axis. Points P29 through P34 are situated symmetrical to points P23 through P28 with respect to the ZX plane, and detailed descriptions thereof are omitted.

In the first inductor 2, a first contact 210, an eighth line 211, the second and third contacts 212 and 213, a ninth line 214, and the fourth contact 215 are present either on plane B of the lower layer or in the interlayer.

The contacts 210, 212, 213, and 215 have a commonality in that they are all situated in the interlayer. In the present embodiment, for ease of description, each of the contacts 210, 212, 213, and 215 is assumed to be a rectangular solid having a base side length of W1 and a height slightly less than D1.

The first contact 210 electrically connects a neighborhood of points P9 and P10 on the first line 23 to an area enclosed by points P35 through P38 (see FIG. 4) on the eighth line 211 as described below.

The eighth line 211 is typically a microstrip line electrically connecting the first contact 210 to the second contact 213 as described below. In the present embodiment, the eighth line 211 is exemplarily formed within an area defined by eight points P35 through P42 on plane B (see FIG. 4). Four points P35 through P40 are substantially situated where points, which are respectively symmetrical to points P11 through P14 with respect to the XZ plane, project onto plane B along a vertical downward direction. Point P35 corresponds to a point translated from point P37 by a distance of W1 along the negative direction of the Y-axis. Point P36 corresponds to a point translated from point P38 by a distance of W1 along the negative direction of the Y-axis. Point P41 corresponds to a point translated from point P39 by a distance of W1 along the positive direction of the Y-axis. Point P42 corresponds to a point translated from point P40 by a distance of W1 along the positive direction of the Y-axis.

The second contact 212 electrically connects an area enclosed by points P39 through P42 to a neighborhood of points P29 and P30 on the fifth line 27.

The third contact 213 electrically connects a neighborhood of points P19 and P20 on the fourth line 26 to points P43 through P46 which define the outline of the ninth line 214 as described below.

The ninth line 214 is typically a microstrip line electrically connecting the third contact 213 to the fourth contact 215 as described below. The outline of the ninth line 214 is defined by four points P43 through P50 on plane B. Points P45 through P48 are situated where points, which are respectively symmetrical to points P21 through P24 with respect to the ZX plane, project onto plane B along a vertical downward direction. Point P43 corresponds to a point translated from point P45 by a distance of W1 along the negative direction of the Y-axis. Point P44 corresponds to a point translated from point P46 by a distance of W1 along the negative direction of the Y-axis. Point P49 corresponds to a point translated from point P47 by a distance of W1 along the positive direction of the Y-axis. Point P50 corresponds to a point translated from point P48 by a distance of W1 along the positive direction of the Y-axis.

The fourth contact 215 electrically connects at least an area enclosed by points P47 through P50 on the ninth line 214 to a neighborhood of points P29 and P30 on the seventh line 29.

Figure 5:
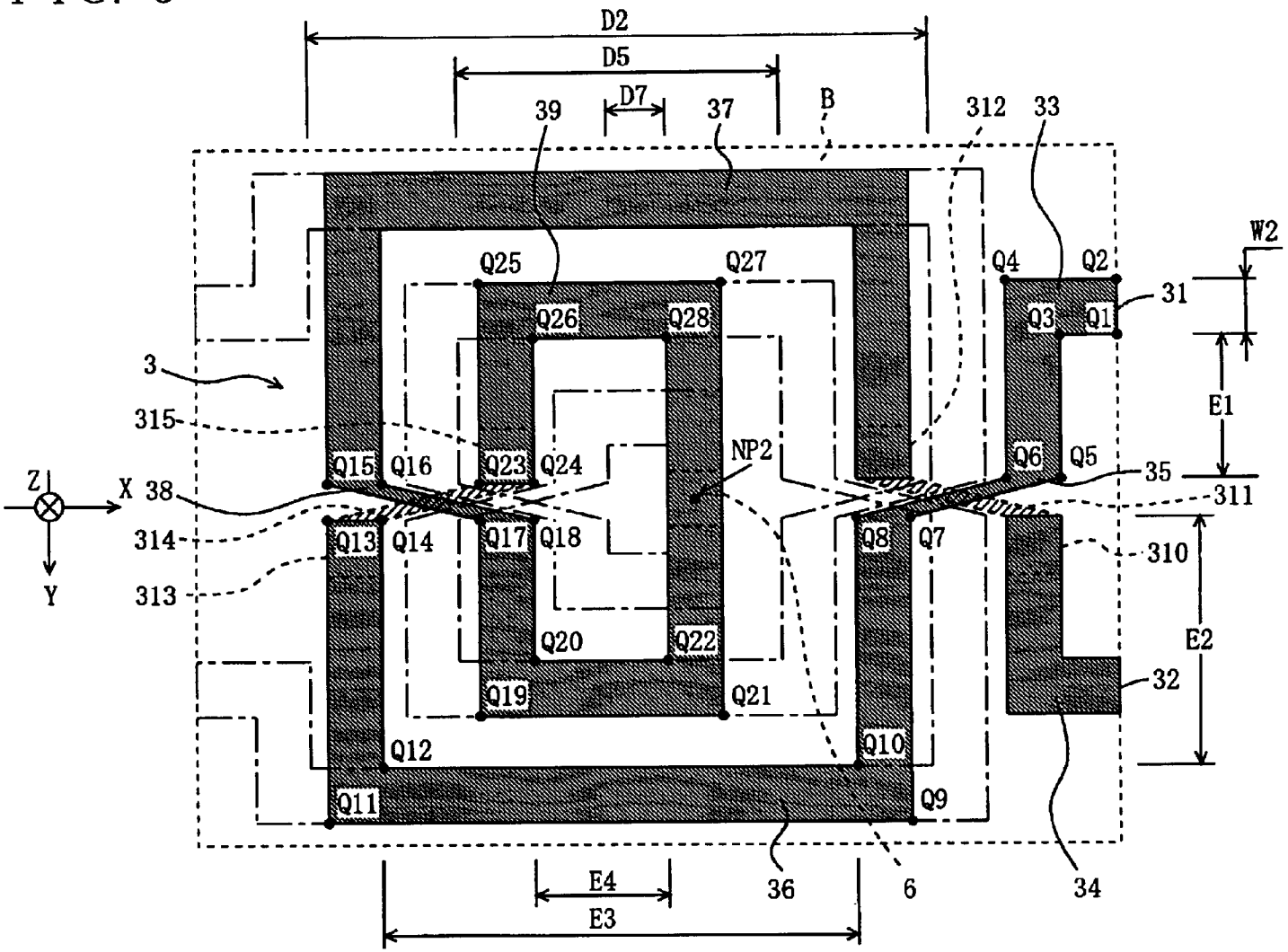
FIG. 5 is a view schematically illustrating elements of a second inductor 3 shown in FIG. 1 in a cross section of the mutual induction circuit 1 of FIG. 1 taken along plane B (see FIG. 1) parallel to the XY plane.
Figure 6:
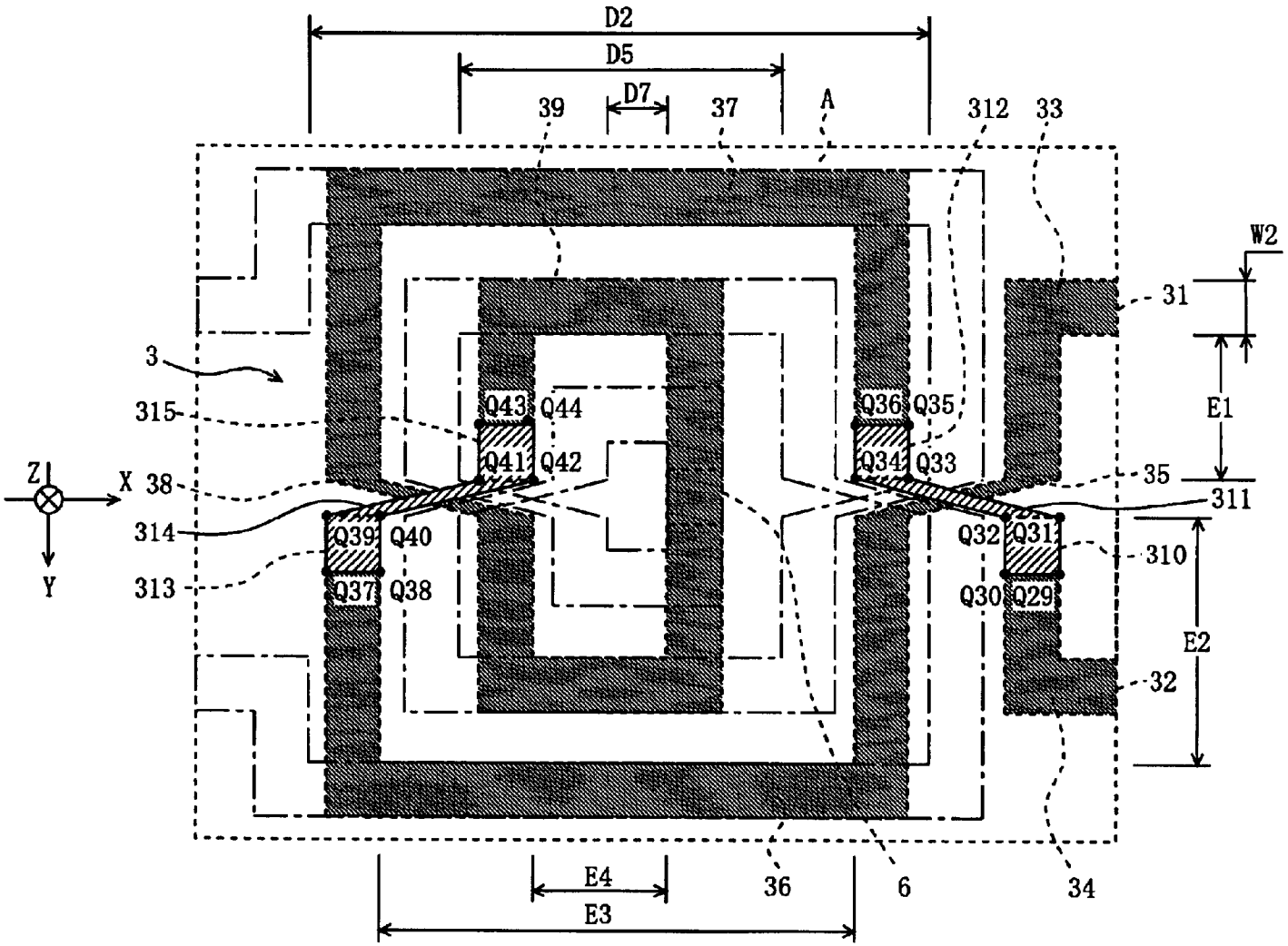
FIG. 6 is a view schematically illustrating elements of the second inductor 3 shown in FIG. 1 in a cross section of the mutual induction circuit 1 of FIG. 1 taken along plane A (see FIG. 1)

Next, the second inductor 3 is described. FIG. 5 is a view schematically illustrating elements of the second inductor 3 in a cross section of the mutual induction circuit 1 taken along plane B (see FIG. 1) parallel to the XY plane. FIG. 6 is a view schematically illustrating elements of the second inductor 3 in a cross section of the mutual induction circuit 1 taken along plane A (see FIG. 1). Note that in FIGS. 5 and 6, elements of the second inductor 3, which are not present on either plane A or B, are all indicated by dotted lines. In order to clarify a positional relationship between the first and second inductors 2 and 3, outlines of the first inductor 2 projected onto plane B along a vertical downward direction are indicated by one-dot chain lines in FIG. 5, and outlines of the first inductor 2 projected onto plane A along a vertical upward direction are indicated by one-dot chain lines in FIG. 6.

The second inductor 3 is made of a conductive material. As shown in FIGS. 1, 5, and 6, most elements of the second inductor 3 are present on plane B in the lower layer, and other elements of the second inductor 3 are present either on plane A of the upper layer or in the interlayer. Specifically, in the second inductor 3, provided on plane B are first and second terminals 31 and 32 and first through seventh lines 33 through 39 which are typically microstrip lines.

The first and second terminals 31 and 32 are situated symmetrical to each other with respect to the ZX plane. Note that in the present embodiment, the first and second terminals 31 and 32 are exemplarily shown as an end of the first line 33 and an end of the second line 34, respectively.

The first line 33 electrically connects the first terminal 31 to a third line 35 which will be described later, and is exemplarily situated within an area defined by six points Q1 through Q6 as described below (see FIG. 5). Point Q1 has X- and Y-coordinate values (X2,−Y2), where X2 and Y2 are positive values determined in accordance with specifications of the mutual induction circuit 1. In the present embodiment, Y2 is equivalent to Y1. If the width of the first line 33 is W1, point Q2 corresponds to a point translated from point Q1 by a distance of W2 along the negative direction of the Y-axis. W2 is typically equivalent to W1 but may be different from W1. Point Q3 corresponds to a point translated from point Q1 by an arbitrary distance determined in accordance with specifications of the mutual induction circuit 1 along the negative direction of the X-axis. Point Q4 corresponds to a point translated from point Q3 by a distance of W2 along the negative direction of each of the X- and Y-axes. Point Q5 corresponds to a point translated from point Q3 by a distance of E1 along the positive direction of the Y-axis. Note that E1 is determined in accordance with specifications of the mutual induction circuit 1 so as to be at least less than the Y-coordinate value of point Q3. Point Q6 corresponds to a point translated from point Q5 by a distance of W2 along the negative direction of the X-axis.

The second line 34 electrically connects the second terminal 32 to the first contact 310 as described below, and is situated symmetrical to the first line 33 with respect to the ZX plane.

The third line 35 is situated on plane B for electrically connecting the first line 33 to a fourth line 36 which will be described later. In the present embodiment, the third line 35 is exemplarily formed within an area enclosed by a parallelogram having, as vertices, four points Q5 through Q8 as described below (see FIG. 5). Points Q5 and Q6 are as described above. In order to avoid unnecessary contacts between the first and second inductors 2 and 3, points Q7 and Q8 correspond to points respectively translated from first and second points, which are respectively situated symmetrical to points Q5 and Q6 with respect to the ZX plane, by a distance slightly greater than W1+W2 along the negative direction of the X-axis.

The fourth line 36 is a partially looped line forming a portion of the outermost turn of the second inductor 3 and electrically connecting the third line 35 to a third contact 313. In the present embodiment, the fourth line 36 is exemplarily formed within an area determined by eight points Q7 through Q14 on plane B (see FIG. 5). Note that the width of the fourth line 36 is W2. Points Q7 and Q8 are as described above. Point Q9 corresponds to a point translated from point Q7 by a distance of E2+W2 along the positive direction of the Y-axis. Preferably, E2 is equivalent to D3. Point Q10 corresponds to a point translated from point Q9 by a distance of W2 along the negative direction of each of the X- and Y-axes. Point Q11 corresponds to a point translated from point Q9 by a distance of E3+2×W2 along the negative direction of the X-axis. Note that in order to avoid unnecessary contacts between the first and second inductors 2 and 3, E3 is selected so as to be less than D2−2×W2 and greater than D5+2×W1. Point Q12 corresponds to a point translated from point Q10 by a distance of E3 along the negative direction of the X-axis. Point Q13 corresponds to a point translated from point Q11 by a distance of E2+W2 along the negative direction of the Y-axis. Point Q14 corresponds to a point translated from point Q12 by a distance of E2 along the negative direction of the Y-axis.

The fifth line 37 is a partially looped line forming a portion of the outermost turn of the second inductor 3 and electrically connecting a second contact 312 and a sixth line 38 both of which will be described later. The fifth line 37 is situated symmetrical to the fourth line 36 with respect to the ZX plane.

The sixth line 38 electrically connects the fifth line 37 to a seventh line 39 which will be described later. In the present embodiment, the sixth line 38 is exemplarily formed within an area enclosed by a parallelogram having, as vertices, four points Q15 through Q18 as described below (see FIG. 5). Points Q15 and Q16 are situated symmetrical to points Q13 and Q14, respectively, with respect to the ZX plane. In order to avoid unnecessary contacts between the first and second inductors 2 and 3, points Q17 and Q18 correspond to points respectively translated from first and second points, which are respectively situated symmetrical to points Q13 and Q14 with respect to the ZX plane, by a distance slightly greater than W1+W2 along the positive direction of the X-axis.

The seventh line 39 is a partially looped line forming a turn situated one turn inward from the outermost turn of the first inductor 2 (in the present embodiment, such a turn is exemplified as an innermost turn) and electrically connecting the sixth line 38 to a fourth contact 315 which will be described later. In the present embodiment, the seventh line 39 is exemplarily formed within an area defined by twelve points Q17 through Q28 as described below (see FIG. 5). Note that the width of the seventh line 39 is W2. Points Q17 and Q18 are as described above. Point Q19 corresponds to a point translated from point Q17 by a distance of E1+W2 along the positive direction of the Y-axis. Point Q20 corresponds to a point translated from point Q18 by a distance of E1 along the positive direction of the Y-axis. Point Q21 corresponds to a point translated from point Q19 by a distance of E4+2×W2 along the positive direction of the X-axis. Note that in order to avoid unnecessary contacts between the first and second inductors 2 and 3, E4 is selected so as to be greater than D7+W1 and less than D5−W2. Point Q22 corresponds to a point translated from point Q20 by a distance of E4 along the positive direction of the X-axis. Points Q23 through Q28 are situated symmetrical to points Q17 through Q22, respectively, with respect to the ZX plane.

In the second inductor 3, the first contact 310, an eighth line 311, the second and third contacts 312 and 313, a ninth line 314, and the fourth contact 315 are present either on plane A of the upper layer or in the interlayer.

The contacts 310, 312, 313, and 315 have a commonality in that they are all situated in the interlayer. In the present embodiment, for ease of description, each of the contacts 310, 312, 313, and 315 is assumed to be a rectangular solid having a base side length of W2 and a height slightly less than D1.

The first contact 310 electrically connects at least a neighborhood of two points on the second line 34, which are situated symmetrical to points Q5 and Q6, respectively, with respect to the ZX plane, to an area enclosed by points Q29 through Q32 on the eighth line 311 as described below (see FIG. 6).

The eighth line 311 is typically a microstrip line electrically connecting the first contact 310 to the second contact 312 as described below. In the present embodiment, the eighth line 311 is exemplarily formed within an area defined by eight points Q29 through Q36 on plane A (see FIG. 5). Points Q31 and Q32 are respectively obtained by projecting first and second points, which are respectively situated symmetrical to points Q5 and Q6 (see FIG. 5) with respect to the ZX plane, onto plane A along a vertical upward direction. Point Q29 corresponds to a point translated from point Q31 by a distance of W2 along the positive direction of the Y-axis. Point Q30 corresponds to a point translated from point Q32 by a distance of W2 along the positive direction of the Y-axis. Points Q33 and Q34 are respectively obtained by projecting first and second points, which are respectively situated symmetrical to points Q7 and Q8 (see FIG. 5) with respect to the ZX plane, onto plane A along a vertical upward direction. Point Q35 corresponds to a point translated from point Q33 by a distance of W2 along the negative direction of the Y-axis. Point Q36 corresponds to a point translated from point Q34 by a distance of W2 along the negative direction of the Y-axis.

The second contact 312 electrically connects an area enclosed by points Q33 through Q36 to a neighborhood of the above first and second points on the fifth line 37 which are respectively situated symmetrical to points Q7 and Q8 with respect to the ZX plane.

The third contact 313 electrically connects a neighborhood of points Q13 and Q14 to points Q37 through Q40 on the ninth line 314 as described below.

The ninth line 314 electrically connects an upper face of the third contact 313 to an upper face of the fourth contact 315 as described below. The outline of the ninth line 314 is defined by eight points Q37 through Q44 on plane B. Points Q39 and Q40 are situated where points Q13 and Q14 project onto plane A along a vertical upward direction. Point Q37 corresponds to a point translated from point Q39 by a distance of W2 along the positive direction of the Y-axis. Point Q38 corresponds to a point translated from point Q40 by a distance of W2 along the positive direction of the Y-axis. Points P41 and P42 are situated where points Q23 and Q24 project onto plane A along a vertical upward direction. Point Q43 corresponds to a point translated from point Q41 by a distance of W2 along the negative direction of the Y-axis. Point Q44 corresponds to a point translated from point Q42 by a distance of W2 along the negative direction of the Y-axis.

The fourth contact 315 electrically connects at least an area enclosed by points Q41 through Q44 on the ninth line 314 to a neighborhood of points Q23 and Q24 on the seventh line 39.

As described above, the second inductor 3 is situated vertically below the first inductor 2, and therefore if voltage is applied between the first and second terminals 21 and 22, magnetic flux is generated and passes through the first inductor 2. The generated magnetic flux also passes through the second inductor 3 in the lower layer, and therefore mutual induction occurs. Due to the mutual induction, an electromotive force in accordance with the ratio of the numbers of turns in the first and second inductors 2 and 3 is induced between the terminals 31 and 32 of the second inductor 3. In this manner, the mutual induction circuit 1 transforms an applied voltage.

Each of the first and second inductors 2 and 3 has a substantially symmetrical shape with respect to the ZX plane. Therefore, the first and second terminals 21 and 22 are equivalent in input impedance to each other, and the first and second terminals 31 and 32 are also equivalent in input impedance to each other. Accordingly, if one of the terminals 21 and 22 is supplied with an in-phase signal contained in a differential signal and the other of the terminals 21 and 22 is supplied with a reverse-phase signal which is equivalent in amplitude but reversed in phase with respect to the in-phase signal, the mutual induction as described above induces a transformed in-phase signal at one of the terminals 31 and 32 of the second inductor 3, while inducing a transformed reverse-phase signal at the other of the terminals 31 and 32.

As described above, the mutual induction circuit 1 includes the first inductor 2 with substantial plane symmetry in the upper layer and the second inductor 3 with substantial plane symmetry in the lower layer, and therefore is able to obtain a transformed differential signal from an input differential signal. Accordingly, the mutual induction circuit 1 is not required to include a plurality of inductors on each of the primary and secondary sides. Therefore, it is possible to realize a small-footprint mutual induction circuit 1.

In the mutual induction circuit 1, the first and second inductors 2 and 3 only occupy two wiring layers, and both the first and second terminals 21 and 22 can be situated outside the outermost turn of the first inductor 2. Further, both the first and second terminals 31 and 32 can be situated outside the outermost turn of the second inductor 3. Accordingly, unlike in the case of a conventional transformer element, it is not necessary to provide a wiring layer for forming a signal line for supplying an input signal or outputting an output signal. This makes it possible to reduce the number of wiring layers used for forming the mutual induction circuit 1, whereby it is possible to form the mutual induction circuit 1 sufficiently away from a semiconductor substrate so as to reduce internal losses due to resistive components of the semiconductor substrate.

In addition to essential elements as described above, the mutual induction circuit 1 preferably includes a contact 6. The contact 6 is made of a conductive material, and connects at least an area including a virtual center NP1 (see FIG. 3) of the first inductor 2 and its surroundings to an area including a virtual center NP2 (see FIG. 5) of the second inductor 3 and its surroundings. Note that the virtual center NP1 is a point of intersection between the ZX plane and a line translated from a line extending between points P28 and P34, by a distance of W1/2 along the negative direction of the X-axis. The virtual center NP2 is a point of intersection between the ZX plane and a line translated from a line extending between points Q21 and Q27, by a distance of W2/2 along the negative direction of the X-axis.

The virtual centers NP1 and NP2 may be electrically connected together for the following reason. As is apparent from the foregoing, the first inductor 2 has a substantially symmetrical shape with respect to the ZX plane. Because of such symmetry of the first inductor 2 and use of the contacts 210, 212, 213, and 215, as well as the lines 211 and 214, if in-phase and reverse-phase signals are inputted into the first and second terminals 21 and 22, the inputted in-phase and reverse-phase signals propagate through the lines and contacts in the first inductor 2, and are combined together at the virtual center NP1. The length of a path from the first terminal 21 to the virtual center NP1 is substantially the same as the length of a path from the second terminal 22 to the virtual center NP1, and therefore even if the in-phase and reverse-phase signals are combined at the virtual center NP1, an amplitude value of a resultant combined signal is substantially zero. Therefore, where the first inductor 2 is supplied with a differential signal, it is possible to use the virtual center NP1 as a virtual ground for alternating current. Such a virtual ground can also be realized for the second inductor 3. Accordingly, in-phase and reverse-phase signals generated only due to mutual induction between the first and second inductors 2 and 3 are outputted from the first and second terminals 31 and 32. In this manner, the contact 6 reduces distortion of high frequency signals propagating through the mutual induction circuit 1. Further, current flowing through the first inductor 2 can be supplied to the second inductor 3.

Note that the shape of the first inductor 2 is not limited to the above example, and the first inductor 2 can be provided in any shape so long as the following two conditions are satisfied. A first condition is that when the first inductor 2 is projected onto plane A along a vertical downward direction, outlines of a projection form a symmetrical shape with respect to the ZX plane. A second condition is that contacts and lines are used such that portions of the first inductor 2, which correspond to intersections between outlines of the projection, are formed on the plane B side, so as not to be in contact with each other. Also, there is an accompanying third condition that the first and second terminals 21 and 22 are situated outward from the outermost turn of the first inductor 2.

Similarly, the second inductor 3 can be provided in any shape so long as the following three conditions are satisfied. A first condition is that magnetic flux generated in the first inductor passes through the second inductor 3. A second condition is that when the second inductor 2 is projected onto plane B along a vertical upward direction, outlines of a projection form a symmetrical shape with respect to the ZX plane. A third condition is that contacts and lines are used such that portions of the second inductor 3, which correspond to intersections between outlines of the projection, are formed on the plane A side, so as not to be in contact with each other. Also, there is an accompanying fourth condition that the first and second terminals 31 and 32 are situated outward from the outermost turn of the second inductor 3.

Although the present embodiment has been described with respect to a case where a differential signal is inputted into the first inductor 2 to obtain a transformed differential signal from the second inductor 3, the present invention is not limited to this. The differential signal may be inputted into the second inductor 3 so as to obtain a transformed differential signal from the first inductor 2.

Further, although the present embodiment has been described with respect to a case where the number of turns in the first inductor 2 is three and the number of turns in the second inductor 3 is two, the number of turns in each inductor may be any number of turns.

Figure 7A:
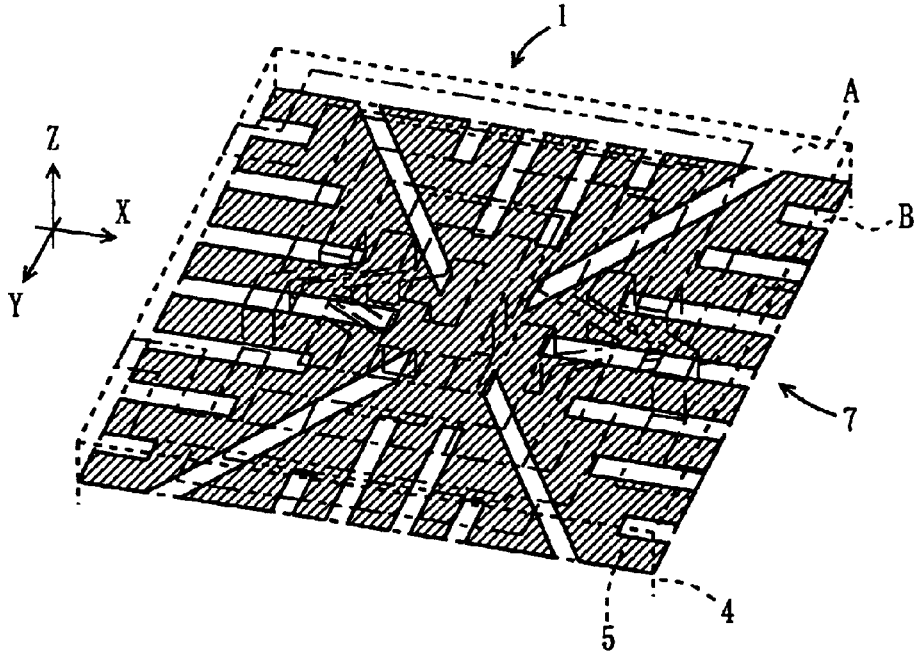
FIG. 7A is a perspective view of a pattern shield 7 preferably included in the mutual induction circuit 1 of FIG. 1.
Figure 7B:
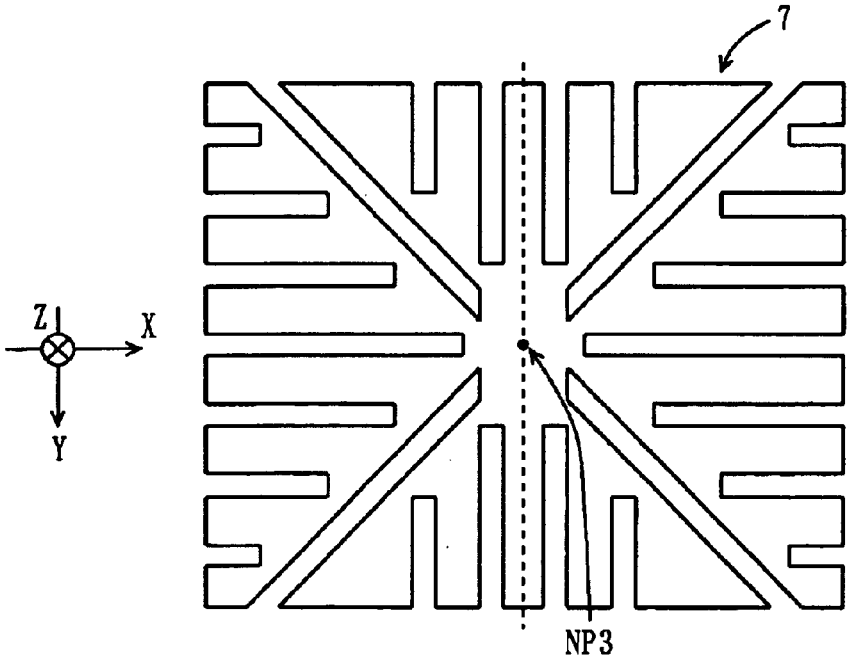
FIG. 7B is a top view of the pattern shield 7 preferably included in the mutual induction circuit 1 of FIG. 1.

Furthermore, in addition to the essential elements as described above, the mutual induction circuit 1 preferably includes a pattern shield 7 as shown in FIGS. 7A and 7B. FIGS. 7A and 7B are a perspective view and a top view, respectively, of the pattern shield 7. Note that in FIG. 7A, outlines of the mutual induction circuit 1 are indicated by two-dot chain lines in order to clarify a positional relationship with the mutual induction circuit 1. In FIGS. 7A and 7B, the pattern shield 7 is made of a conductive material and formed between the semiconductor substrate 4 shown in FIG. 1 and a wiring layer (plane B) of the lower layer. In the case of the mutual induction circuit 1 as shown in FIG. 1, it is preferred that the pattern shield 7 has a rectangular shape. More specifically, among two pairs of opposing sides of the pattern shield 7, one pair of opposing sides each have a length equal to or more than a value of (the X-coordinate value of point Q1)−(the X-coordinate value of point P1), and the other pair of opposing sides each have a length equal to or more than a value of (the Y-coordinate value of point Q9)−(the Y-coordinate value of point P8). Such a pattern shield 7 has a virtual center NP3 to which a ground potential for a alternating signal is applied, and therefore it is possible to electromagnetically isolate the mutual induction circuit 1 from the semiconductor substrate 4, whereby it is possible to further reduce the distortion of high frequency signals propagating through the mutual integration circuit 1.

Further still, the pattern shield 7 has a plurality of slits roughly radiating from the virtual center NP3 so as to be perpendicular to current flowing through the first and second inductors 2 and 3. This inhibits magnetic field generated in the mutual induction circuit 1 from causing overcurrent to occur on the pattern shield 7, whereby it is possible to further reduce the distortion of high frequency signals propagating through the mutual induction circuit 1.

Note that the pattern shield 7 may be formed in a high impurity concentration polysilicon layer if such a polysilicon layer is formed on the semiconductor substrate 4. Moreover, instead of having the slits, the pattern shield 7 may have a plurality of through holes radially arranged from the virtual center NP3.

Figure 8A:
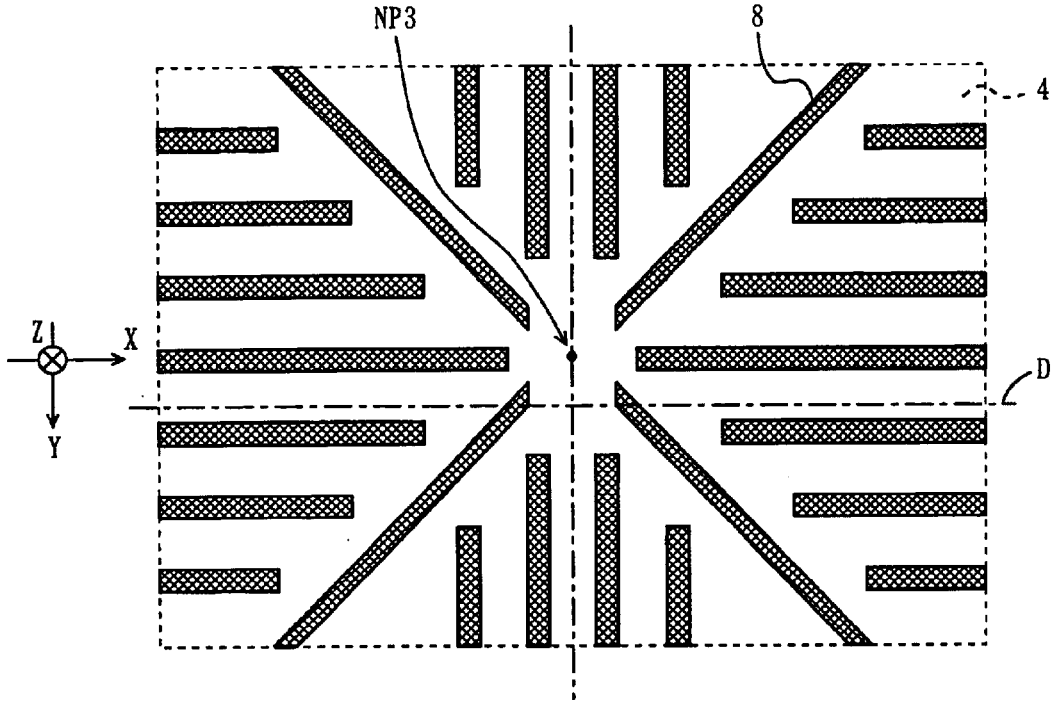
FIG. 8A is a top view illustrating a preferable example of a semiconductor substrate 4 additional to the mutual induction circuit 1 shown in FIG. 1.
Figure 8B:
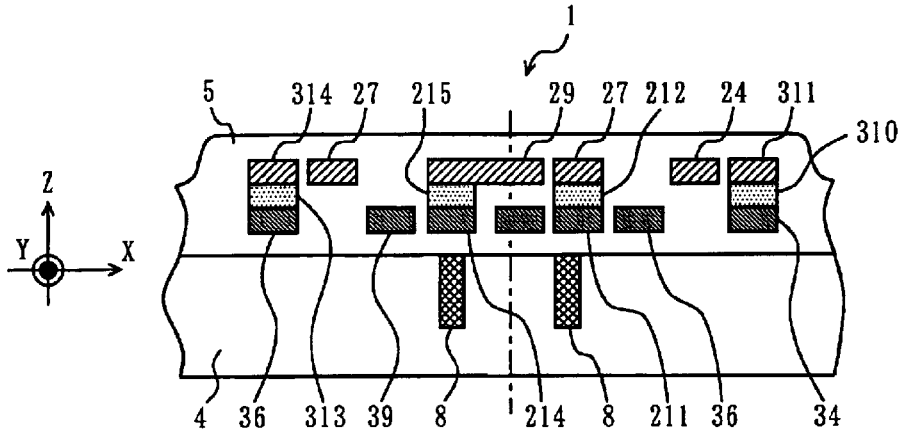
FIG. 8B is a cross-sectional view of the semiconductor substrate 4 taken along plane D shown in FIG. 8A and parallel to the ZX plane.

Further still, it is more preferred that in addition to the essential elements as described above, the mutual induction circuit 1 includes an isolating construction consisting of a plurality of trenches 8 as shown in FIGS. 8A and 8B (see grid hatched portions). FIG. 8A is a top view of a silicon substrate, which is an example of the semiconductor substrate 4 shown in FIG. 1, viewed along a vertical downward direction. Note that for simplification of illustration, the mutual induction circuit 1 is not shown in FIG. 8A. Also, for simplification's sake, in FIG. 8A, reference numeral 8 is assigned to only one trench. FIG. 8B is a cross-sectional view of the silicon substrate shown in FIG. 8A taken along plane D parallel to the ZX plane.

In FIGS. 8A and 8B, the trenches 8 are formed on the silicon substrate as an exemplary semiconductor substrate 4 and filled with an oxide film and polysilicon. Such trenches 8 are used for lateral isolation of a plurality of elements. In FIGS. 8A and 8B, the trenches 8 are formed so as to be perpendicular to the flow of over current which might occur on the silicon substrate, whereby it is possible to inhibit the magnetic field generated in the mutual induction circuit 1 from causing over current to occur on the silicon substrate. Therefore, it is possible to further reduce the distortion of high frequency signals propagating through the mutual induction circuit 1.

As is apparent from FIGS. 1, 5, and 6, the fourth, fifth and seventh lines 36, 37 and 39 of the second inductor 3 are partially situated vertically below the second line 24, the first line 23, and a combination of the fourth and fifth lines 26 and 27, respectively, of the first inductor 2. Accordingly, parasitic capacitance occurs between the second line 24 of the first inductor 2 and the fourth line 36 of the second inductor 3, between the first line 23 of the first inductor 2 and the fifth line 37 of the second inductor 3, and between the fourth and fifth lines 26 and 27 of the first inductor 2 and the seventh line of the second inductor 3. Such parasitic capacitance cancels mutual inductance between the first and second inductors 2 and 3, resulting in weak electromagnetic coupling between the inductors 2 and 3.

Figure 9:
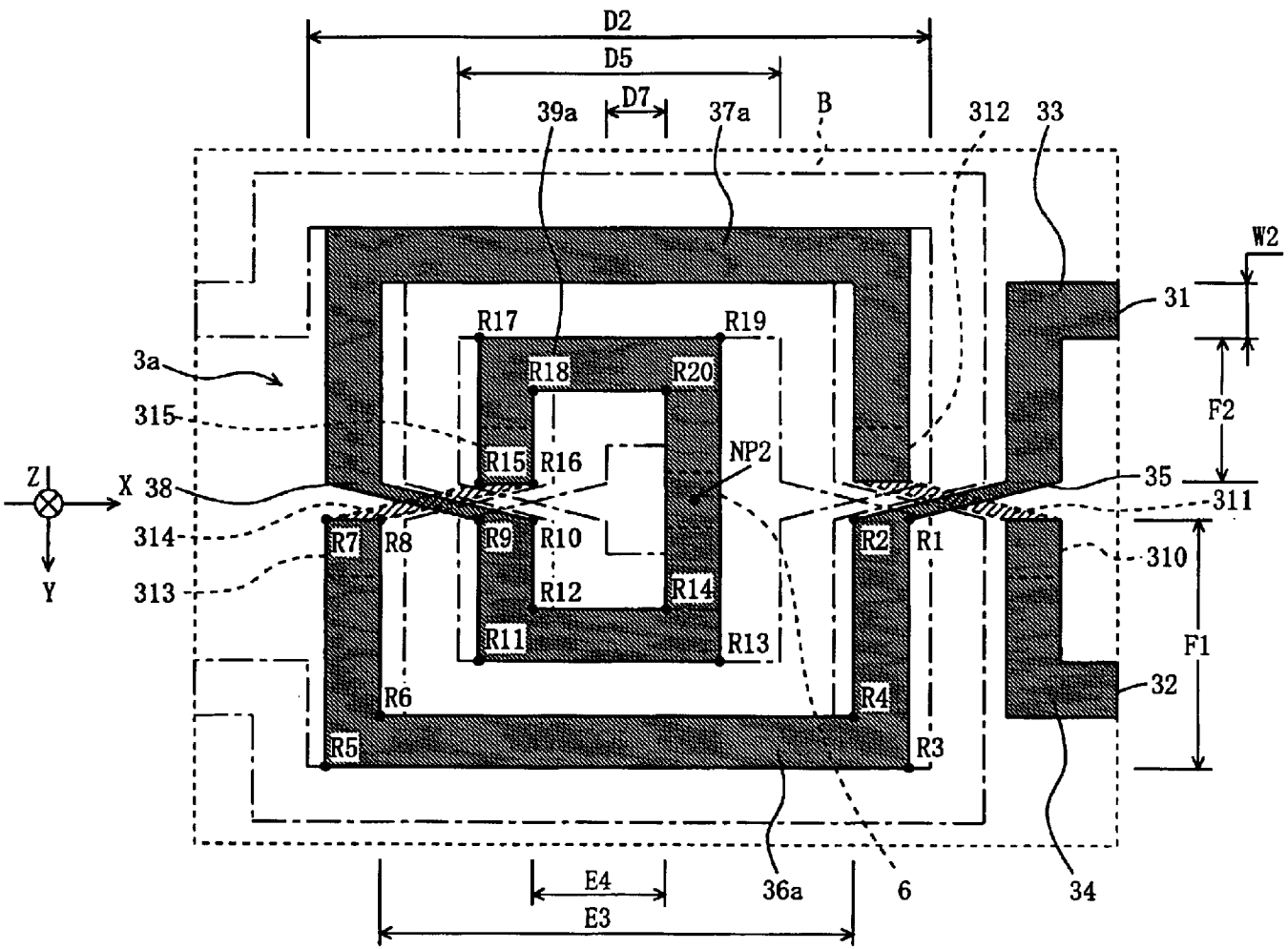
FIG. 9 is a schematic view illustrating the structure of a second inductor 3*a* which is a variation of the second inductor 3 shown in FIG. 1.

In order to reduce the parasitic capacitance, the mutual induction circuit 1 may include a second inductor 3*a* having a shape as shown in FIG. 9, instead of including the second inductor 3. Unlike the second inductor 3 shown in FIGS. 5 and 6, the second inductor 3*a* includes a fourth line 36*a*, a fifth line 37*a*, and a seventh line 39*a* in the lower layer, rather than the fourth line 36, the fifth line 37, and the seventh line 39. There is no other difference between the second inductors 3*a* and 3. In FIG. 9, elements corresponding to those shown in FIGS. 5 and 6 are denoted by the same reference numerals, and detailed descriptions thereof are omitted.

The fourth line 36*a* is a partially looped line forming a portion of the outermost turn of the second inductor 3*a* and electrically connecting the third line 35 to the third contact 313. In the present embodiment, the fourth line 36*a* is exemplarily formed within an area defined by eight points R1 through R8 on plane B (see FIG. 9). Note that the width of the fourth line 36*a* is substantially the same as that of the first line 31. Points R1 and R2 are situated in the same positions as points Q7 and Q8, respectively. Point R3 corresponds to a point translated from point R1 by a distance of F1 along the positive direction of the Y-axis. F1 is determined in accordance with the specifications of the mutual induction circuit 1, and preferably substantially equal to D3. Point R4 corresponds to a point translated from point R3 by a distance of W2 along the negative direction of each of the X- and Y-axes. Point R5 corresponds to a point translated from R3 by a distance of E3+2×W2 along the negative direction of the X-axis. The value of E3 is as described above. Point R6 corresponds to a point translated from point R4 by a distance of E3 along the negative direction of the X-axis. Point R7 corresponds to a point translated from point R5 by a distance of F1 along the negative direction of the Y-axis. Point R8 corresponds to a point translated from point R6 by a distance of F1−W2 along the negative direction of the Y-axis. As is apparent from the above, points R3 through R6 are displaced from points Q9 through Q12, respectively, along the negative direction of the Y-axis. As a result, the fourth line 36*a* deviates from a position vertically below the second line 24 of the first inductor 2 and also from a position vertically below the fifth line 27 situated inward from the second line 24.

The fifth line 37*a* is a partially looped line forming a portion of the outermost turn of the second inductor 3*a* and electrically connecting the second contact 312 to the sixth line 38. The fifth line 37*a* is situated symmetrical to the fourth line 36*a* with respect to the ZX plane.

The seventh line 39*a* is a partially looped line forming a turn situated one inward from the outermost turn of the second inductor 3 (in the present embodiment, such a turn is exemplified as an innermost turn) and electrically connecting the sixth line 38 to the fourth contact 315. In the present embodiment, the seventh line 39*a* is exemplarily formed within an area defined by twelve points R9 through R20 on plane B (see FIG. 9). Note that the width of the seventh line 39*a* is substantially equivalent to the width of the first line 31, i.e., W2. Points R9 and R10 are substantially situated in the same positions as points Q17 and Q18, respectively. Point R11 corresponds to a point translated from R9 by a distance of F2 along the positive direction of the Y-axis. F2 is determined in accordance with the specifications of the mutual induction circuit 1, and preferably substantially equal to D4. Point R12 corresponds to a point translated from point R10 by a distance of F2−W2 along the positive direction of the Y-axis. Point R13 corresponds to a point translated from point R11 by a distance of E4+2×W2 along the positive direction of the X-axis. The value of E4 is as described above. Point R14 corresponds to a point translated from point R12 by a distance of E4 along the positive direction of the X-axis. Points R15 through R20 are situated symmetrical to points R9 through R12, respectively, with respect to the plane ZX. As is apparent from the above, points R11 through R16 are displaced from points Q19 through Q26, respectively, toward the X-axis. As a result, most portions of the seventh line 39*a* deviate from a position vertically below the first inductor 2.

Most portions of the fourth, fifth, and seventh lines 36*a*, 37*a*, and 39*a* of the second inductor 3*a* as described above are not situated vertically below the second line 24, the first line 23, and a combination of the fourth and fifth lines 26 and 27, respectively, of the first inductor 2. Accordingly, it is possible to reduce parasitic capacitance which might occur between the first inductor 2 and the second inductor 3*a*.

Figure 10:
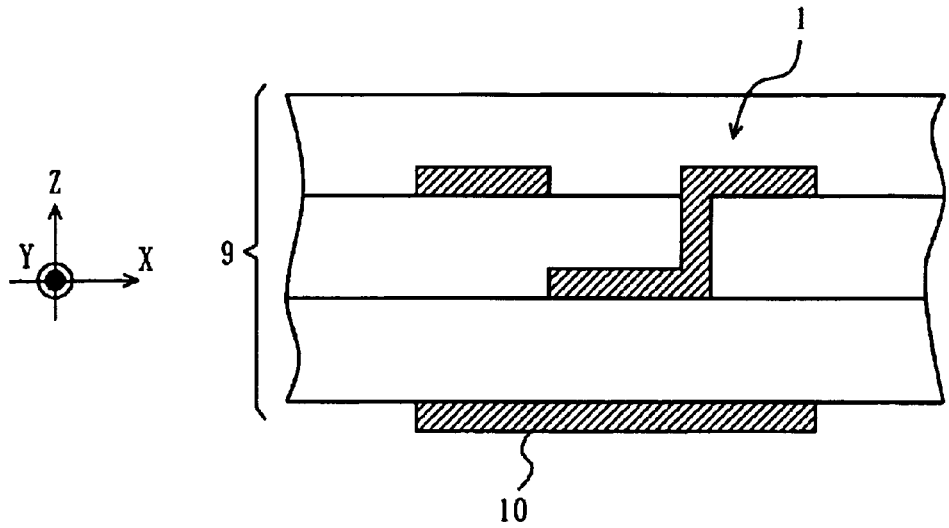
FIG. 10 is a schematic view of a dielectric multilayer substrate 9 which is an alternative of the semiconductor substrate 4 shown in FIG. 1.

Further, a transformer element as the above-described mutual induction circuit 1 may be formed on a dielectric multilayer substrate 9 as shown in FIG. 10 instead of being formed on the semiconductor substrate 4. In the case of the dielectric multilayer substrate 9, it is possible to provide a ground 10 below the transformer element 1 via the substrate. Accordingly, in the dielectric multilayer substrate 9, it is possible to reduce an area occupied by both the mutual induction circuit 1 and the ground 10.

Figure 11:
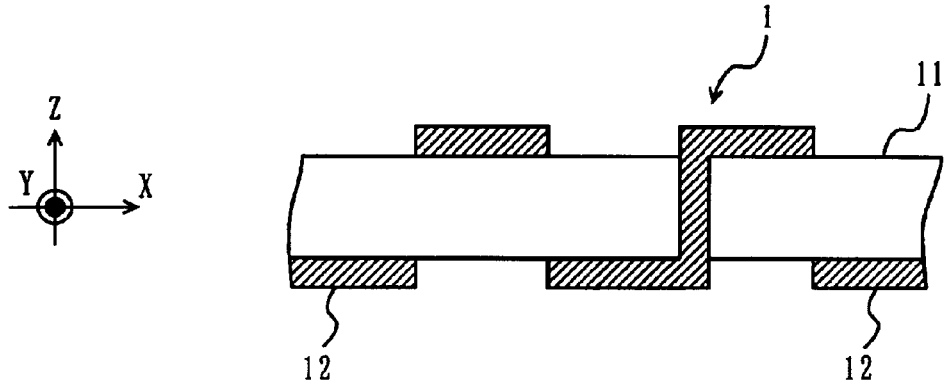
FIG. 11 is a schematic view of a double-sided substrate 11 which is an alternative of the semiconductor substrate 4 shown in FIG. 1.

Furthermore, the transformer element as the mutual induction circuit 1 uses only two wiring layers. Accordingly, it is possible to arrange inductors of the transformer element on opposite faces of a single layer double-sided substrate 11 as shown in FIG. 11. In this case, more than one grounds 12 are formed on, for example, the bottom face of the double-sided substrate 11 so as to be away from the mutual induction circuit 1. This makes it possible to reduce the height of each of the mutual induction circuit 1 and the ground.

As is apparent from FIG. 4, when the first inductor 2 is projected onto plane B, some lines, e.g., third and eighth lines 25 and 211, intersect with another line. Discussion over a preferable value of an intersection angle θ between the eighth line 211 and the Y-axis is provided below with reference to FIG. 4. In FIG. 4, as shown in a rectangle enclosed by one-dot chain lines, it is assumed that a width of a line is W, a space between adjacent lines is S, and the third and eighth lines 25 and 211 intersect with each other within a rectangle having a length of (2×W+S) and a width of d.

In order to design such an intersection, W is selected such that satisfactory sharpness of resonance (i.e., Q factor) of the first and second inductors 2 and 3 is obtained in a target frequency bandwidth, and S is selected so as to be a maximum possible value within design rule constraints.

On the other hand, in order to minimize parasitic capacitance, a value of d is selected in view of the following two points. A first point is to minimize overlapping of two intersecting lines. A second point is to optimize widths and lengths of the two intersecting lines.

Firstly, a value of θ is calculated in view of the first point. An area SA of overlapping of the two intersecting lines is obtained by the following expression (1):

$$SA=(2\cdot W+S-d\cdot\tan\theta)\cdot(d-S/\tan\theta) \quad (1),$$

where tan θ is equivalent to (W+S)/d, and therefore the above expression (1) is transformed into the following expression (2).

$$SA=W^2\cdot d/(W+S) \quad (2)$$

From the above expression (2), it is appreciated that the area SA becomes smaller as the value of d is decreased. In general, the minimum value of d is equivalent to S. In this case, an angle θ is represented by the following expression (3).

$$\theta=\tan^{-1}((W+S)/S) \quad (3)$$

Next, the value of θ is calculated in view of the second point. A width W' of each of the two intersecting lines at the intersection is represented by the following expression (4).

$$W'=W\cdot\cos\theta=(W\cdot d)/\sqrt{((W+S)^2+d^2)} \quad (4)$$

A length L' of each of the two intersecting lines at the intersection cannot be solely derived but can be approximately represented by the following expression (5).

$$L'\approx\sqrt{((W+S)^2+d^2)} \quad (5).$$

If a sheet resistance (Ω/□)) of each line is ρ, a resistance R of the line at the intersection is represented by the following expression (6).

$$R=\rho\cdot L'/W' \quad (6)$$

$$=\rho[\{(W+S)^2/(d\cdot W)\}+(d/W)]$$

In the above expression (6), R is minimized when the first and second terms of the right side are equivalent to each other, and therefore the following expression (7) is established.

$$(W+S)^2/(d\cdot W)=(d/W) \quad (7)$$

If the above expression (7) is solved for d, d=W+S. In this case, a parasitic capacitance R is minimized to 2ρ(W+S)/W. Because tan θ=1, it is appreciated that θ is preferably equivalent to 45 degrees.

(Second Embodiment)

Figure 12:
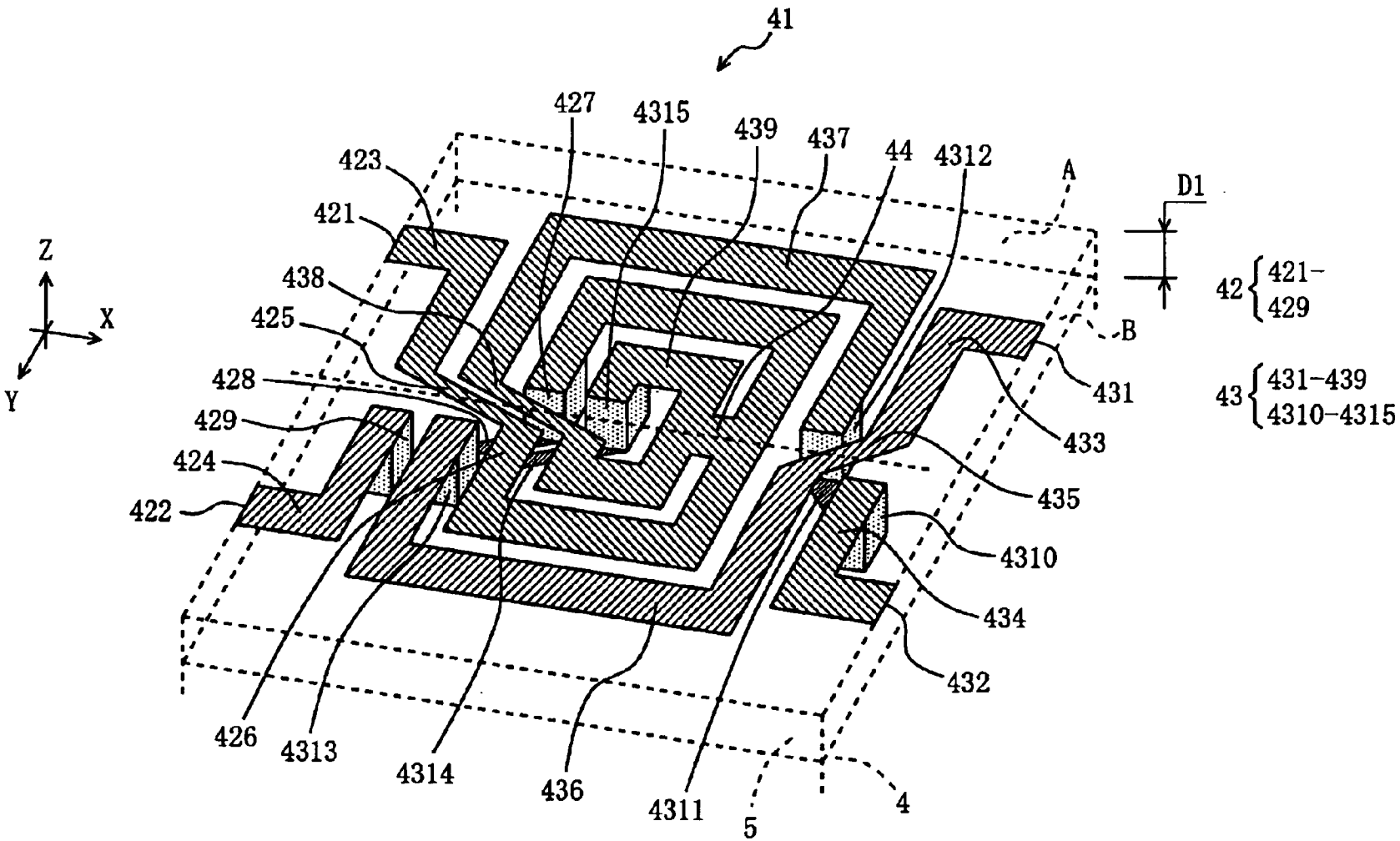
FIG. 12 is a perspective view illustrating the structure of a mutual induction circuit 41 according to a second embodiment of the present invention.

FIG. 12 is a perspective view illustrating the structure of a transformer element which is an example of a mutual induction circuit 41 according to a second embodiment of the present invention. Note that for ease of description, a three-dimensional coordinate system consisting of X-, Y-, and Z-axes is shown in FIG. 12. In FIG. 12, as in the case of the mutual induction circuit 1, the mutual induction circuit 41 is formed across two wiring layers, i.e., upper and lower wiring layers, within an interlayer insulating film 5 on the semiconductor substrate 4. In the following descriptions, the upper wiring layer, the lower wiring layer, and an interlayer between the upper and lower wiring layers are referred to as an "upper layer, a "lower layer, and an "interlayer", respectively. Specifically, the mutual induction circuit 41 is made of a conductive material, and essentially includes a first inductor 42 and a second inductor 43.

Figure 13:
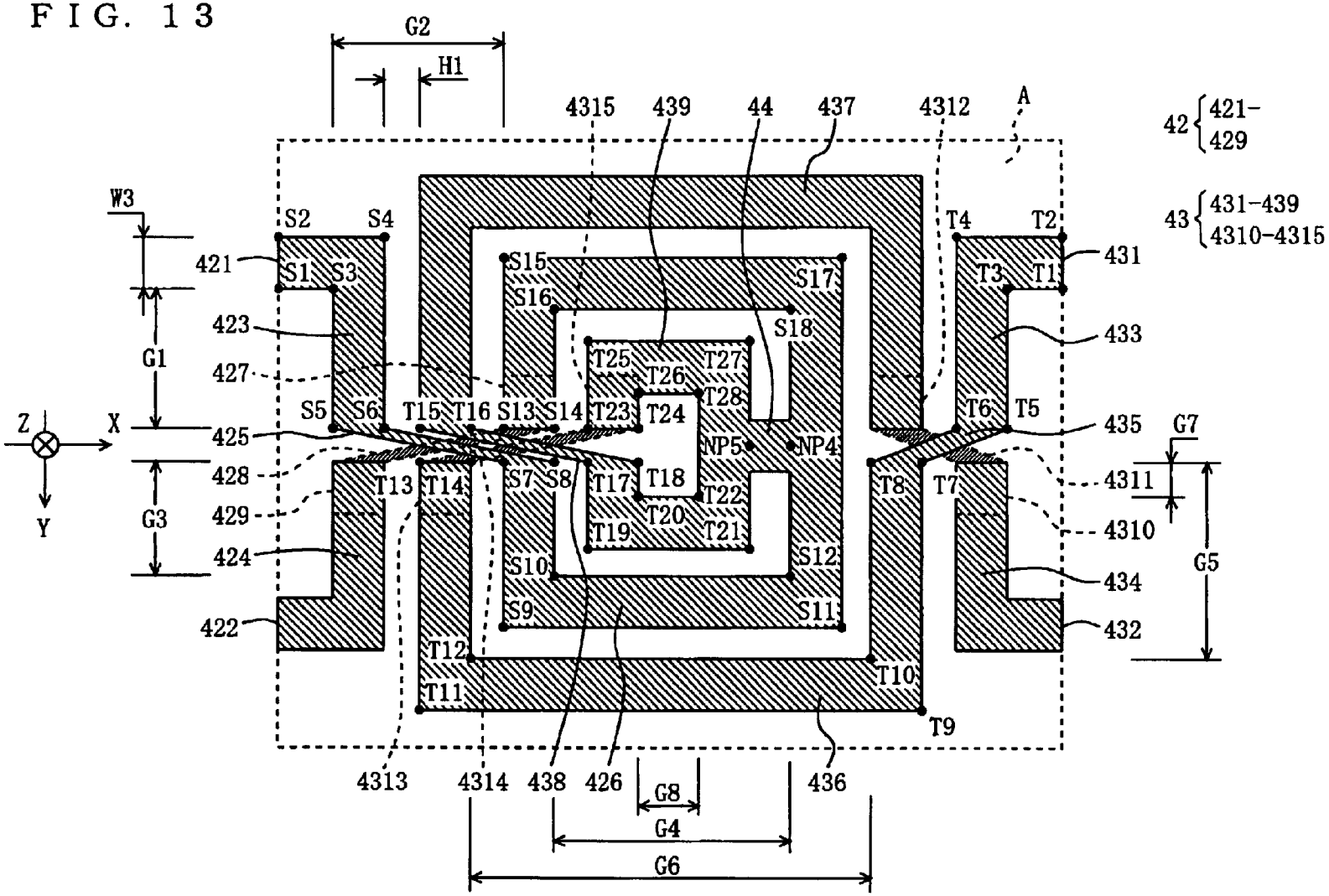
FIG. 13 is a cross-sectional view of the mutual induction circuit 41 shown in FIG. 12 and taken along plane A (see FIG. 12) parallel to the XY plane.
Figure 14:
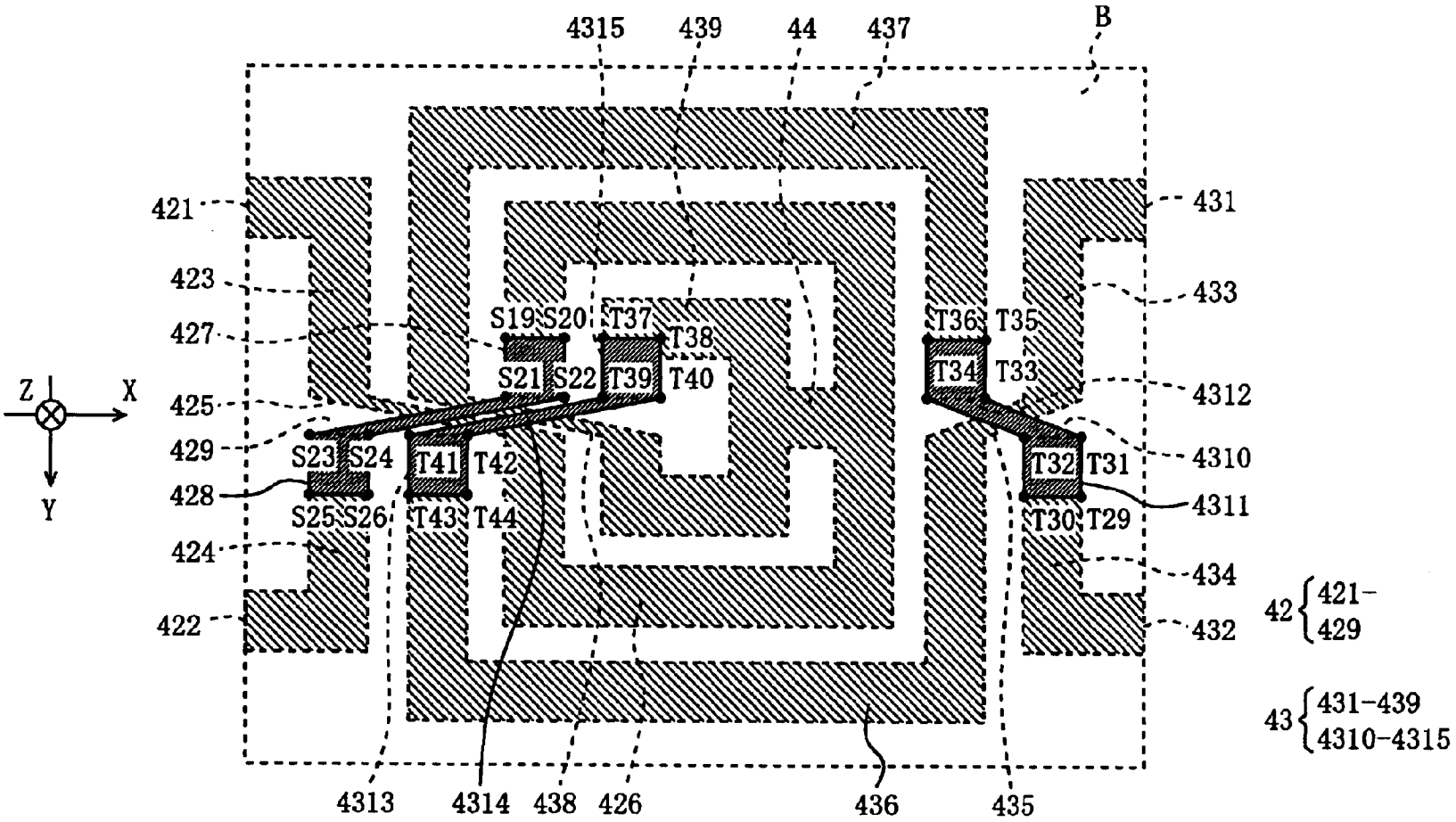
FIG. 14 is a cross-sectional view of the mutual induction circuit 41 taken along plane B (see FIG. 12) which is included in a lower layer and corresponds to a plane translated from plane A (see FIG. 12) by a distance of D1 along the negative direction of the Z-axis.

FIG. 13 is across-sectional view of the mutual induction circuit 41 taken along plane A (see FIG. 12) in the upper layer which is parallel to the XY plane. FIG. 14 is a cross-sectional view of the mutual induction circuit 41 taken along plane B (see FIG. 12) which is included in the lower layer and corresponds to a plane translated from plane A by a distance of D1 along the negative direction of the Z-axis. Note that in FIGS. 12 and 13, elements of the mutual induction circuit 41, which are not present on either plane A or B, are all indicated by dotted lines.

As shown in FIGS. 12 through 14, most elements of the first inductor 42 are present on plane A, and other elements are present either on plane B or in the interlayer. Specifically, in the first inductor 42, provided on plane A are first and second terminals 421 and 422 and first through fourth lines 423 through 426 which are typically microstrip lines.

The first and second terminals 421 and 422 are situated symmetrical to each other with respect to the ZX plane. Note that in the present embodiment, the first and second terminals 421 and 422 are exemplarily shown as an end of the first line 423 and an end of the second line 424, respectively.

The first line 423 electrically connects the first terminal 421 to the third line 425 as described below. In the present embodiment, the first line 423 is exemplarily formed within an area defined by the following six points S1 through S6 (see FIG. 13). Point S1 has X- and Y-coordinate values (X3,−Y3), where X3 and Y3 are positive values determined in accordance with the specifications of the mutual induction circuit 41. If the width of the first line 423 is W3, point S2 corresponds to a point translated from point S1 by a distance of W3 along the negative direction of the Y-axis. Point S3 corresponds to a point translated from point S1 by an arbitrary distance determined in accordance with the specifications of the mutual induction circuit 41 along the positive direction of the X-axis. Point S4 corresponds to a point translated from point S3 by a distance of W3 along each of the negative direction of the Y-axis and the positive direction of the X-axis. Point S5 corresponds to a point translated from point S3 by a distance of G1 along the positive direction of the Y-axis. Note that G1 is determined in accordance with the specifications of the mutual induction circuit 41 so as to be less than a distance between the ZX plane and point S3. Point S6 corresponds to a point translated from point S5 by a distance of W3 along the positive direction of the X-axis.

The second line 424 connects the second terminal 422 to a fifth line 428 which will be described later. The second line 424 is situated symmetrical to the first line 423 with respect to the ZX plane.

The third line 425 electrically connects the first line 423 to the fourth line 426 as described below. In the present embodiment, the third line 425 is exemplarily formed within a parallelogram enclosed by the following four points S5 through S8 (see FIG. 13). Points S5 and S6 are as described above. Points S7 and S8 correspond to points respectively translated from first and second points, which are respectively situated symmetrical to points S5 and S6 with respect to the ZX plane, by a distance of G2 along the positive direction of the X-axis. Note that if a line width of each of the first and second inductors 42 and 43 is W3 and a distance between a line of the first inductor 42 and a line of the second inductor 43, which is adjacent to the line of the first inductor 42, is H1, G2 is equivalent to 2×(W3+H1).

The fourth line 426 is a partially looped line where magnetic flux passes through the first inductor 42, and is exemplarily formed within an area defined by the following twelve points S7 through S18 (see FIG. 13). In the present embodiment, as in the case of the first line 423, the width of the fourth line 426 is W3. Points S7 and S8 are as described above. Point S9 corresponds to a point translated from point S7 by a distance of G3+W3 along the positive direction of the Y-axis. Note that G3 is a positive value determined in accordance with the specifications of the mutual induction circuit 41 so as to be greater than G7+W3 and less than G5−W3. Note that values G5 and G7 will be described later. Point S10 corresponds to a point translated from point S8 by a distance of G3 along the positive direction of the Y-axis. Point S11 corresponds to a point translated from point S9 by a distance of G4+2×W3 along the positive direction of the X-axis. Note that G4 is determined in accordance with the specifications of the mutual induction circuit 41 so as to be greater than G8+2×W3 and less than G6−2×W3. Note that G6 and G8 will be described later. Point S12 corresponds to a point translated from point S10 by a distance of G4 along the positive direction of the X-axis. Points S13 through S18 are situated symmetrical to points S7 through S12, respectively, with respect to ZX plane.

In the first inductor 42, a first contact 427, the fifth line 428, and a second contact 429 are present either on plane B or in the interlayer. The contacts 427 and 429 have a commonality in that they are all situated in the interlayer. In the present embodiment, for ease of description, each of the contacts 427 and 429 is assumed to be a rectangular solid having a base side length of W3 and a height slightly less than D1.

The first contact 427 electrically connects a neighborhood of points S13 and S14 on the fourth line 426 to an area enclosed by points S19 through S22 (see FIG. 14) on the fifth line 428 as described below.

The fifth line 428 is typically a microstrip line electrically connecting the first contact 427 to the second contact 429 as described below. In the present embodiment, the fifth line 428 is exemplarily formed within an area defined by eight points S19 through S26 on plane B (see FIG. 13). Four points S21 through S24 are obtained by projecting points, which are situated symmetrical to points S5 through S8 with respect to the ZX plane, onto plane B. Point S19 corresponds to a point translated from point S21 by a distance of W3 along the negative direction of the Y-axis. Point S20 corresponds to a point translated from point S22 by a distance of W3 along the negative direction of the Y-axis. Point S25 corresponds to a point translated from point S23 by a distance of W3 along the positive direction of the Y-axis. Point S26 corresponds to a point translated from point S24 by a distance of W3 along the positive direction of the Y-axis.

The second contact 429 electrically connects an area enclosed by points S23 through S26 to a neighborhood of two points on the second line 424 which are situated symmetrical to points S5 and S6 with respect to the ZX plane.

As in the case of the first inductor 42, as shown in FIGS. 12 through 14, most elements of the second inductor 43 are present on plane A, and other elements are present either on plane B or in the interlayer. Specifically, in the second inductor 43, provided on plan A are first and second terminals 431 and 432 and first through seventh lines 433 through 439 which are typically microstrip lines.

The first and second terminals 431 and 432 are situated symmetrical to each other with respect to the ZX plane. Note that in the present embodiment, the first and second terminals 431 and 432 are exemplarily shown as an end of the first line 433 and an end of the second line 434, respectively.

The first line 433 electrically connects the first terminal 431 to the third line 435 as described below, and is exemplarily formed in an area enclosed by the following six points T1 through T6 (see FIG. 10). Point T1 has X- and Y-coordinate values (X4,−Y4), where X4 and Y4 are positive values determined in accordance with the specifications of the mutual induction circuit 41. In the present embodiment, Y4 is equivalent to Y3 described above. If the width of the first line 433 is W3, point T2 corresponds to a point translated from point T1 by a distance of W3 along the negative direction of the Y-axis. Point T3 corresponds to a point translated from point T1 by an arbitrary distance determined in accordance with the specifications of the mutual induction circuit 41 along the negative direction of the X-axis. Point T4 corresponds to a point translated from point T3 by a distance of W3 along the negative direction of each of the X- and Y-axes. Point T5 corresponds to a point translated from point T3 by a distance of G1 along the positive direction of the Y-axis. Point T6 corresponds to a point translated from point T5 by a distance of W3 along the negative direction of the X-axis.

The second line 434 electrically connects the second terminal 432 to a first contact 4310 which will be described later, and is situated symmetrical to the first line 433 with respect to the ZX plane.

The third line 435 electrically connects the first line 433 to the fourth line 436 as described below. In the present embodiment, the third line 435 is exemplarily formed within a parallelogram enclosed by the following four points T5 through T8 (see FIG. 13). Points T5 and T6 are as described above. Points T7 and T8 correspond to points respectively translated from first and second points, which are respectively situated symmetrical to points T5 and T6 with respect to the ZX plane, by a distance of W3+H1 along the negative direction of the X-axis.

The fourth line 436 is a partially looped line forming a portion of the outermost turn of the second inductor 43. In the present embodiment, the fourth line 436 is exemplarily formed within an area defined by the following eight points T7 through T14 (see FIG. 13). Note that the width of the fourth line 436 is W3. Points T7 and T8 are as described above. Point T9 corresponds to a point translated from point T7 by a distance of G5+W3 along the positive direction of the Y-axis. Note that G5 is greater than G3+W3. Point T10 corresponds to a point translated from point T9 by a distance of W3 along the negative direction of each of the X- and Y-axes. Point T11 corresponds to a point translated from point T9 by a distance of G6+2×W3 along the negative direction of the X-axis. Note that G6 is greater than G4+2×W3 and less than (distance between points S4 and T4)−2×

W3. Point T12 corresponds to a point translated from point T10 by a distance of G6 along the negative direction of the X-axis. Point T13 corresponds to a point translated from point T11 by a distance of G5+W3 along the negative direction of the Y-axis. Point T14 corresponds to a point translated from T12 by a distance of G5 along the negative direction of the Y-axis.

The fifth line 437 is a partially looped line forming a portion of the outermost turn of the second inductor 43, and is situated symmetrical to the fourth line 436 with respect to the ZX plane.

The sixth line 438 electrically connects the fifth line 437 to the seventh line 439 as described below. In the present embodiment, the sixth line 438 is exemplarily formed within a parallelogram having, as vertices, the following four points T15 through T18 (see FIG. 13). Points T15 through T18 correspond to points respectively translated from points S5 through S8 by a distance of W3+H1 along the positive direction of the X-axis.

The seventh line 439 is a partially looped line forming a turn situated one turn inward from the outermost turn of the second inductor 43 (in the present embodiment, such a turn is exemplified as an innermost turn). In the present embodiment, the seventh line 439 is exemplarily formed within an area defined by the following twelve points T17 through T28 (see FIG. 10). Note that the width of the seventh line 439 is W3. Points T17 and T18 are as described above. Point T19 corresponds to a point translated from point T17 by a distance of G7+W3 along the positive direction of the Y-axis. Point T20 corresponds to a point translated from T18 by a distance of G7 along the positive direction of the Y-axis. Note that G7 is a positive value less than G3−W3. Point T21 corresponds to a point translated from point T19 by a distance of G8+2×W3 along the positive direction of the X-axis. Note that G8 is a positive value less than G4−2×W3l . Point T22 corresponds to a point translated from point T20 by a distance of G8 along the positive direction of the X-axis. Points T23 through T28 are situated symmetrical to points T17 through T22, respectively, with respect to the ZX plane.

In the second inductor 43, provided either on plane B or in the interlayer are a first contact 4310, an eighth line 4311, the second and third contacts 4312 and 4313, a ninth line 4314, and a fourth contact 4315. The contacts 4310, 4312, 4313, and 4315 have a commonality in that they are all situated in the interlayer. In the present embodiment, for ease of description, each of the contacts 4310, 4312, 4313, and 4315 is assumed to be a rectangular solid having a base side length of W3 and a height slightly less than D1.

The first contact 4310 electrically connects at least a neighborhood of two points on the second line 434, which are situated symmetrical to points T5 and T6, respectively, with respect to the ZX plane, to an area enclosed by points T29 through T32 on the eighth line 4311 as described below (see FIG. 14).

The eighth line 4311 is typically a microstrip line electrically connecting the first contact 4310 to the second contact 4312 as described below. In the present embodiment, the eighth line 4311 is exemplarily formed within an area defined by eight points T29 through T36 on plane B (see FIG. 14). Points T31 through T34 are obtained by projecting four points, which are situated symmetrical to points T5 through T8 with respect to the ZX plane, onto plane B along a vertical downward direction. Points T29 and T30 correspond to points respectively translated from points T31 and T32 by a distance of W3 along the positive direction of the Y-axis. Points T35 and T36 correspond to points respectively translated from points T33 and T34 by a distance of W3 along the negative direction of the Y-axis.

The second contact 4312 electrically connects an area enclosed by points T33 through T36 on the eighth line 4311 (FIG. 14) to a neighborhood of two points on the fifth line 437 which are situated symmetrical to points T7 and T8, respectively, with respect to the ZX plane.

The third contact 4313 electrically connects at least a neighborhood of points T13 and T14 on the fourth line 436 to an area enclosed by points T41 through T44 on the ninth line 4314 as described below.

The ninth line 4314 is typically a microstrip line electrically connecting the third contact 4313 to the fourth contact 4315 as described below. In the present embodiment, the ninth line 4314 is exemplarily formed within an area defined by eight points T37 through T44 (FIG. 14) on plane B. Points T37 through T44 correspond to points respectively translated from points S19 through S26 by a distance of W3+H11 along the positive direction of the X-axis.

The fourth contact 4315 electrically connects an area enclosed by points T37 through T40 (FIG. 14) on the ninth line 4314 to a neighborhood of points T23 and T24 on the sixth line 439.

As described above, each of the first and second inductors 42 and 43 is formed using both the upper and lower layers. The fourth line 426 having a roughly looped shape in the first inductor 42 is placed between the outermost and innermost turns of the second inductor 43. Such placement allows magnetic flux to be generated and thereby to pass through the partially looped shape of the fourth line 426 if voltage is applied between the first and second terminals 421 and 422. The generated magnetic flux also passes through the outermost and innermost turns of the second inductor 43, and therefore, as described in the first embodiment, the mutual induction circuit 41 is able to transform the applied voltage.

Further, the first and second inductors 42 and 43 are shaped so as to be substantially symmetrical to each other with respect to the ZX plane. Accordingly, as in the case of the mutual induction circuit 1 according to the first embodiment, if a differential signal is supplied to each of the terminals 421 and 422, a transformed differential signal is obtained from each of the terminals 431 and 432 of the second inductor 43. Accordingly, it is not necessary to provide a plurality of inductors on each of the primary and secondary sides, whereby it is possible to realize a small-footprint mutual induction circuit 41.

Furthermore, in the mutual induction circuit 41, the first and second inductors 42 and 43 only occupy two wiring layers, and both of the first and second terminals 421 and 422 can be situated outward from the outermost turn of the first inductor 42, and both of the first and second terminals 431 and 432 can be situated outward from the outermost turn of the second inductor 43. Accordingly, it is possible to reduce the number of wiring layers for use in forming the mutual induction circuit 41, whereby it is possible to form the mutual induction circuit 41 sufficiently away from a semiconductor substrate so as to reduce internal losses due to resistive components of the semiconductor substrate.

In general, a transformer element formed in a thin wiring layer has a great internal loss. However, most elements of the mutual induction circuit 41 are formed in the upper layer, and therefore, from the viewpoint of reducing internal losses, the mutual induction circuit 41 is preferably provided in particular by a semiconductor process which fabricates a semiconductor circuit in which a top wiring layer is thicker than underlying wiring layers.

In addition to the essential elements as described above, the mutual induction circuit 41 preferably includes a connection line 44. The connection line 44 is typically a microstrip line which connects at least an area including a virtual center NP4 of the first inductor 42 and its surroundings to an area including a virtual center NP5 of the second inductor 43 and its surroundings (see FIG. 13). Note that the virtual center NP4 is a point of intersection between points S12 and S18 on the fourth line 426, and the virtual center NP5 is an intersection between points T21 and T27. The virtual centers NP4 and NP5 may be connected to each other for the reason described in the first embodiment in relation to the virtual centers NP1 and NP2.

Note that the shape of the first inductor 42 is not limited to the above example, and the first inductor 42 can be provided in any shape so long as three conditions for forming the first inductor 42 (refer to the first embodiment) are satisfied. Similarly, the shape of the second inductor 43 is not limited to the above example, and the second inductor 43 can be provided in any shape so long as four conditions for forming the second inductor 43 (refer to the first embodiment) are satisfied.

Further, a differential signal may be supplied to the second inductor 43 so as to obtain a transformed differential signal from the first inductor 42.

Furthermore, the number of turns in each of the first and second inductors 42 and 43 may be any number of turns.

Further still, preferably, the mutual induction circuit 41 may include the pattern shield 7 described with reference to FIGS. 7A and 7B, as well as the above-described essential elements. Moreover, the mutual induction circuit 41 may be formed on a silicon substrate including the trenches 8 described above with reference to FIGS. 8A and 8B.

Further still, a transformer element as the above-described mutual induction circuit 41 may be formed on the dielectric multilayer substrate 9 as shown in FIG. 10 or on the single layer double-sided substrate 11 as shown in FIG. 11, rather than on the semiconductor substrate 4.

Figure 15:
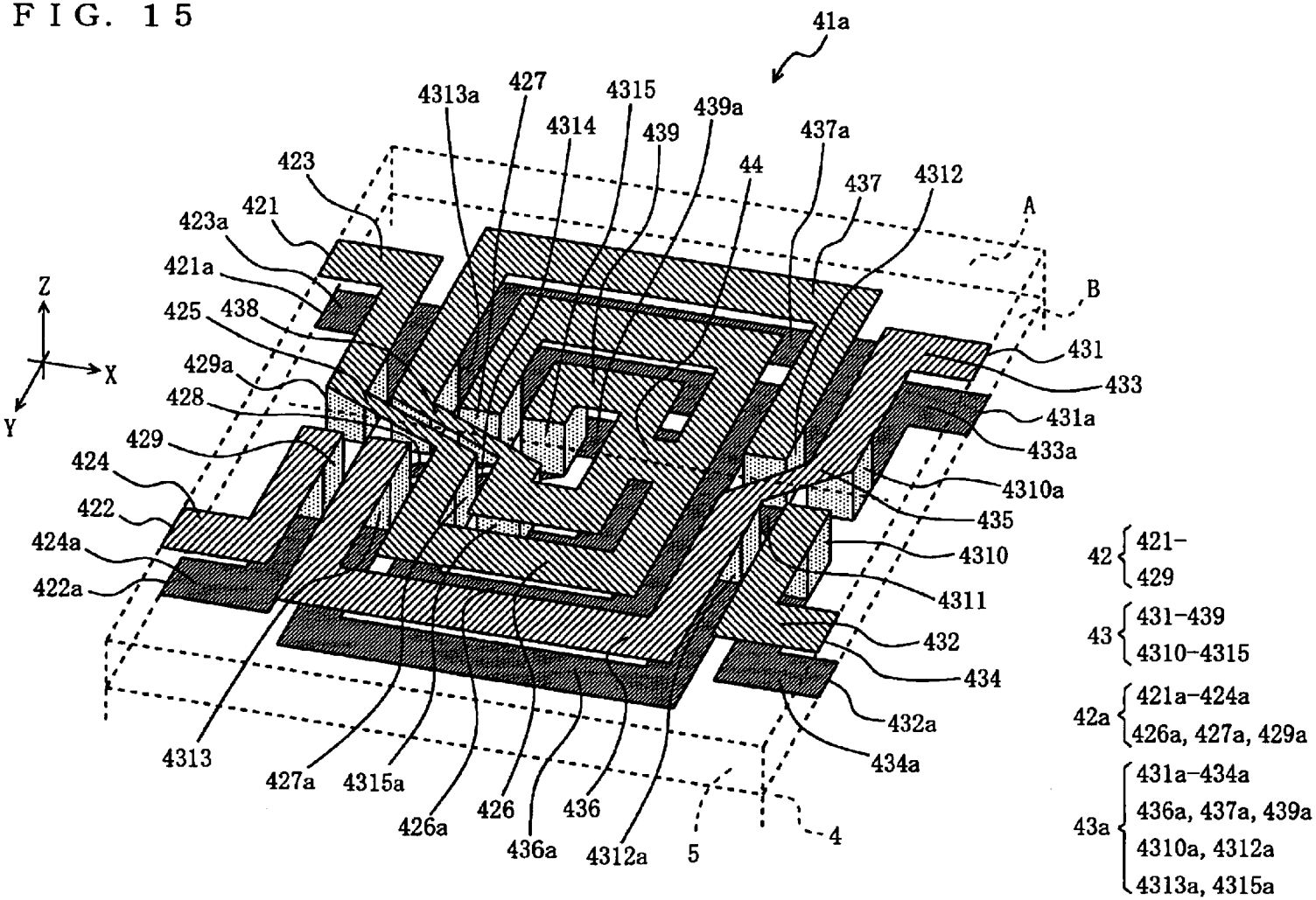
FIG. 15 is a perspective view illustrating the structure of a mutual induction circuit 41*a* which is a variation of the mutual induction circuit 41 shown in FIG. 12.
Figure 16:
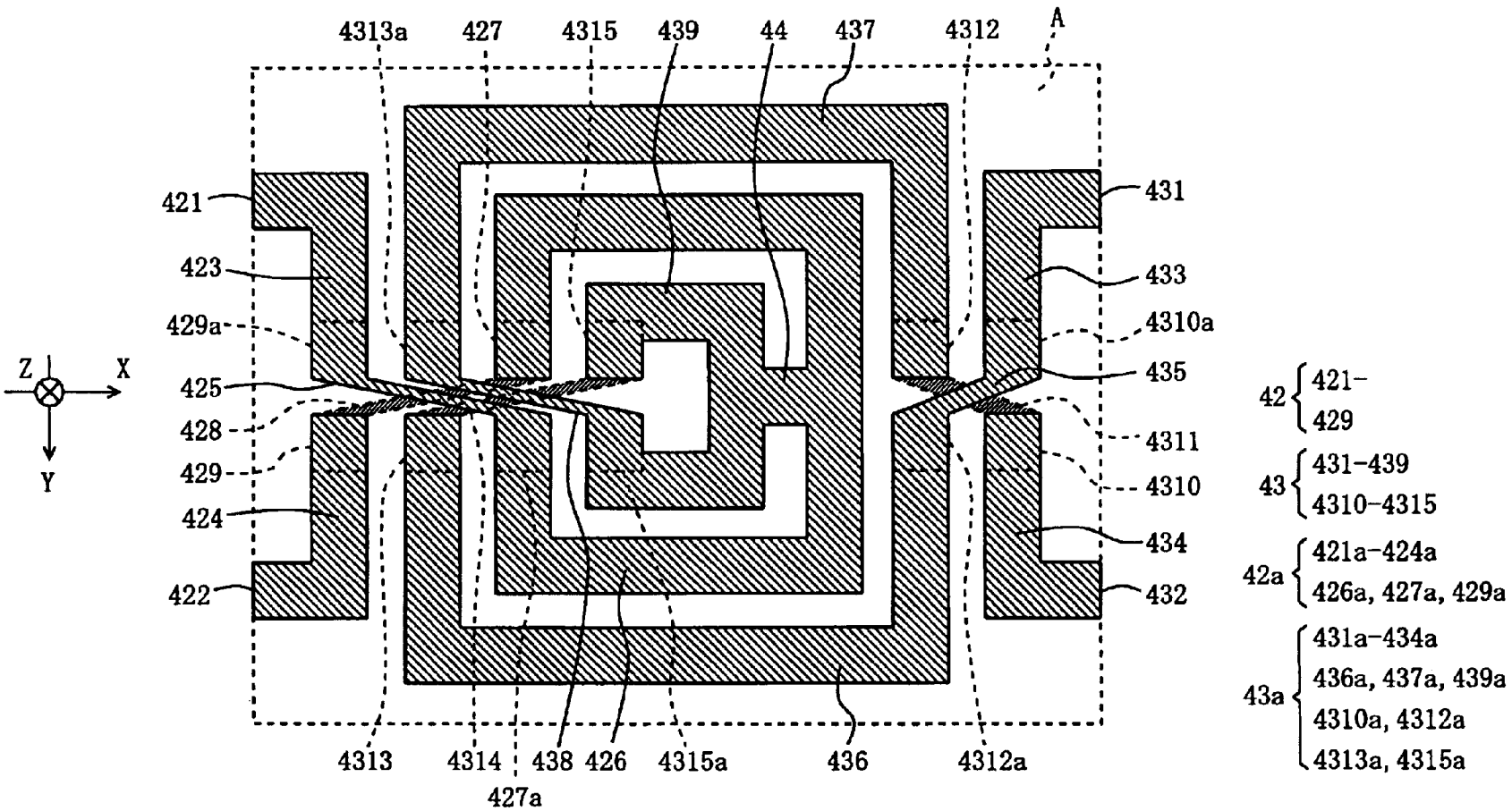
FIG. 16 is a cross-sectional view of the mutual induction circuit 41*a* shown in FIG. 15 and taken along plane A (see FIG. 15) parallel to the XY plane.
Figure 17:
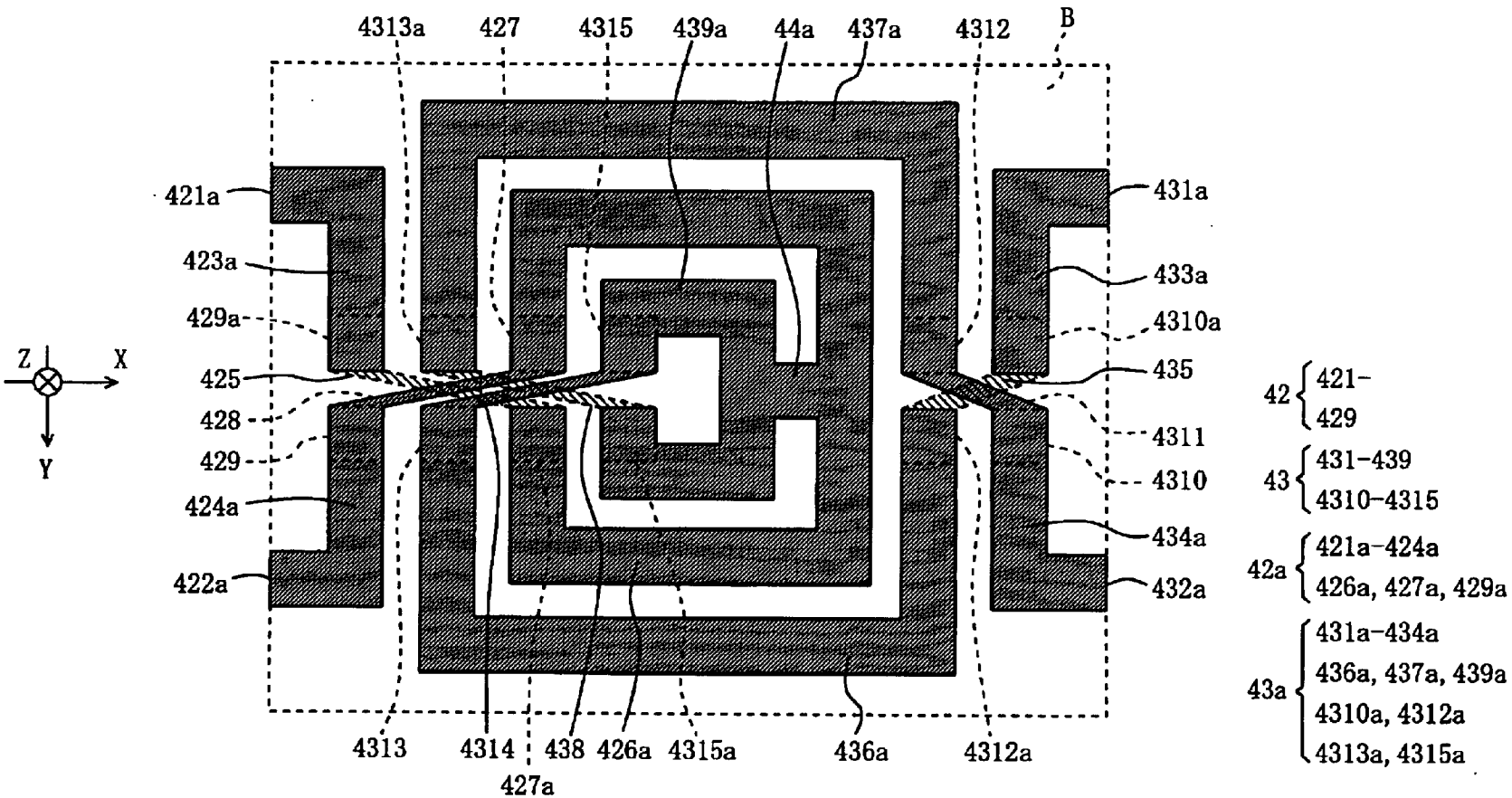
FIG. 17 is across-sectional view of the mutual induction circuit 41*a* shown in FIG. 15 and taken along plane B (see FIG. 15) which corresponds to a plane translated from plane A (see FIG. 15) by a distance of D1 along the negative direction of the Z-axis.

FIG. 15 is a perspective view illustrating the structure of a mutual induction circuit 41*a* which is a variation of the mutual induction circuit 41. For ease of description, a three-dimensional coordinate system consisting of X-, Y-, and Z-axes is shown in FIG. 15. FIG. 16 is a cross-sectional view of the mutual induction circuit 41*a* taken along plane A parallel to the XY plane (see FIG. 15). FIG. 17 is a cross-sectional view of the mutual induction circuit 41*a* taken along plane B (see FIG. 15) corresponding to a plane translated from plane A (see FIG. 15) by a distance of D1 along the negative direction of the Z-axis. Note that in FIGS. 16 and 17, elements of the mutual induction circuit 41*a*, which are not present on either plane A or B, are all indicated by dotted lines.

In FIGS. 15 through 17, the mutual induction circuit 41*a* differs from the mutual induction circuit 41 in including third and fourth inductors 42*a* and 43*a*. There is no other difference between the mutual induction circuits 41 and 41*a*. In FIG. 15, elements corresponding to those shown in FIG. 12 are denoted by the same reference numerals, and descriptions thereof are omitted.

As shown in FIGS. 15 through 17, the third inductor 42*a* includes first and second terminals 421*a* and 422*a*, first, second and third terminals 423*a*, 424*a*, and 426*a*, which are typically microstrip lines, and first and second contacts 427*a* and 429*a*.

The first and second terminals 421*a* and 422*a* are situated where the first and second terminals 421 and 422 project onto plane B along a vertical downward direction.

The first and second lines 423*a* and 424*a* are situated where the first and second lines 423 and 424 project onto plane B along a vertical downward direction. The first line 423*a* electrically connects the first terminal 421*a* to the second contact 429*a* as described below. Similarly, the second line 424*a* electrically connects the second terminal 422*a* to the second contact 429.

The third line 426*a* is situated where the fourth line 426 projects onto plane B along a vertical downward direction. The third line 426*a* is a partially looped line forming a portion of the outermost turn of the third inductor 42*a*.

The first contact 427*a* is situated symmetrical to the first contact 427 with respect to the ZX plane, and electrically connects the fourth line 426 to the third line 426*a*.

The second contact 429*a* is situated symmetrical to the second contact 429 with respect to the ZX plane, and electrically connects the first line 423 to the third line 423*a*.

As shown in FIGS. 15 through 17, the fourth inductor 43*a* includes first and second terminals 431*a* and 432*a*, first, second, third, fourth, and fifth lines 433*a*, 434*a*, 436*a*, 437*a*, and 439*a*, which are typically microstrip lines, and first, second, third, and fourth contacts 4310*a*, 412*a*, 4313*a*, and 4315*a*.

The first and second terminals 431*a* and 432*a* are situated where the first and second terminals 431 and 432 project onto plane B along a vertical downward direction.

The first and second lines 433*a* and 434*a* are situated where the first and second lines 433 and 434 project onto plane B along a vertical downward direction. The first line 433*a* electrically connects the first terminal 431*a* to the first contact 4310*a* as described below. Similarly, the second line 434*a* electrically connects the second terminal 432*a* to the first contact 4310.

The third line 436*a* is situated where the fourth line 436 projects onto plane B along a vertical downward direction. The third line 436*a* is a partially looped line forming a portion of the outermost turn of the fourth inductor 43*a*, and electrically connects the third contact 4313 to the second contact 4312*a* as described below.

The fourth line 437*a* is situated symmetrical to the third line 436*a* with respect to the ZX plane. The fourth line 437*a* is a partially looped line forming a portion of the outermost turn of the fourth inductor 43*a*, and electrically connects the second contact 4312 to the third contact 4313*a* as described below.

The fifth line 439*a* is situated where the seventh line 439 projects onto plane B along a vertical downward direction. The fifth line 439*a* is a partially looped line forming a portion of the innermost turn of the fourth inductor 43*a*, and electrically connects the fourth contact 4315 to the fourth contact 4315*a* as described below.

The first contact 4310*a* is situated symmetrical to the first contact 4310 with respect to the ZX plane, and electrically connects the first line 433*a* to the first line 433.

The second contact 4312*a* is situated symmetrical to the second contact 4312 with respect to the ZX plane, and electrically connects the fourth line 436 to the third line 436*a*.

The third contact 4313*a* is situated symmetrical to the third contact 4313 with respect to the ZX plane, and electrically connects the fifth line 437 to the fourth line 437*a*.

The fourth contact 4315*a* is situated symmetrical to the fourth contact 4315 with respect to the ZX plane, and electrically connects the seventh line 439 to the fourth line 439*a*.

In the case where the connection line 44 is formed on the upper layer side, the mutual induction circuit 41*a* further includes a connection line 44*a* in an area where the connection line 44 projects onto plane B along a vertical downward direction.

As described above, the mutual induction circuit 41*a* includes the third and fourth inductors 42*a* and 43*a* which correspond to projections of main components of the first and second inductors 42 and 43 onto plane B along a virtual downward direction. The third and fourth inductors 42*a* and 43*a* are electrically connected via contacts to the first and second inductors 42 and 43, respectively. The first and third inductors 42 and 42*a* are connected so as to be symmetrical to each other with respect to the ZX plane. In this structure, if an in-phase signal included in a differential signal is supplied to either a pair of the terminals 421 and 421*a* or a pair of the terminals 422 and 422*a* and a reverse-phase signal, which is equivalent in amplitude but reversed in phase with respect to the in-phase signal, is supplied to the other pair of the terminals, mutual induction as described above induces transformed in-phase signals at one of the pair of the terminals 421 and 421*a* and the pair of the terminals 422 and 422*a*, while inducing transformed reverse-phase signals at the other pair of the terminals. From an equivalent point of view, the mutual induction circuit 41*a* having a shape as described above is structured by two resistors connected in parallel. Accordingly, internal loss of the mutual induction circuit 41*a* can be considered as combined resistance of the two resistors connected in parallel. Accordingly, even if the wiring layer on the upper layer side is thin, it is possible to realize a low-loss mutual induction circuit 41*a*.

(Third Embodiment)

Figure 18:
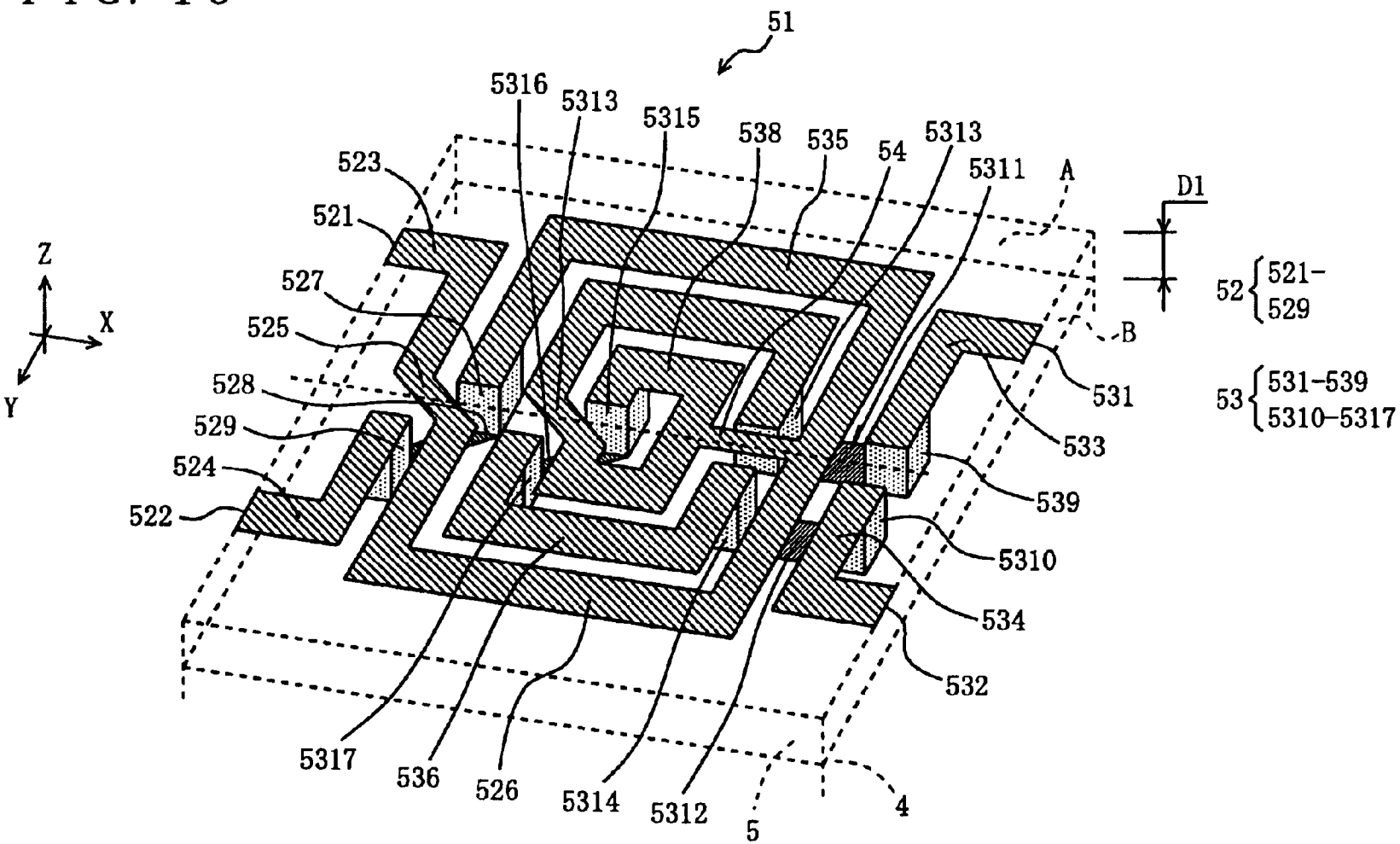
FIG. 18 is a perspective view illustrating the structure of a mutual induction circuit 51 according to the second embodiment of the present invention.

FIG. 18 is a perspective view illustrating the structure of a transformer element which is an example of a mutual induction circuit 51 according to a third embodiment of the present invention. Note that for ease of description, a three-dimensional coordinate system consisting of X-, Y-, and Z-axes is shown in FIG. 18.

In FIG. 18, as in the case of the mutual induction circuit 1, the mutual induction circuit 51 is formed using two wiring layers arranged in the Z-axis direction (i.e., a vertical direction) within the interlayer insulating film 5 on the semiconductor substrate 4. In the following descriptions, the upper wiring layer, the lower wiring layer, and a space between the upper and lower wiring layers are referred to as an "upper layer, a "lower layer, and an "interlayer", respectively. Specifically, the mutual induction circuit 51 is made of a conductive material, and essentially includes a first inductor 52 and a second inductor 53.

Figure 19:
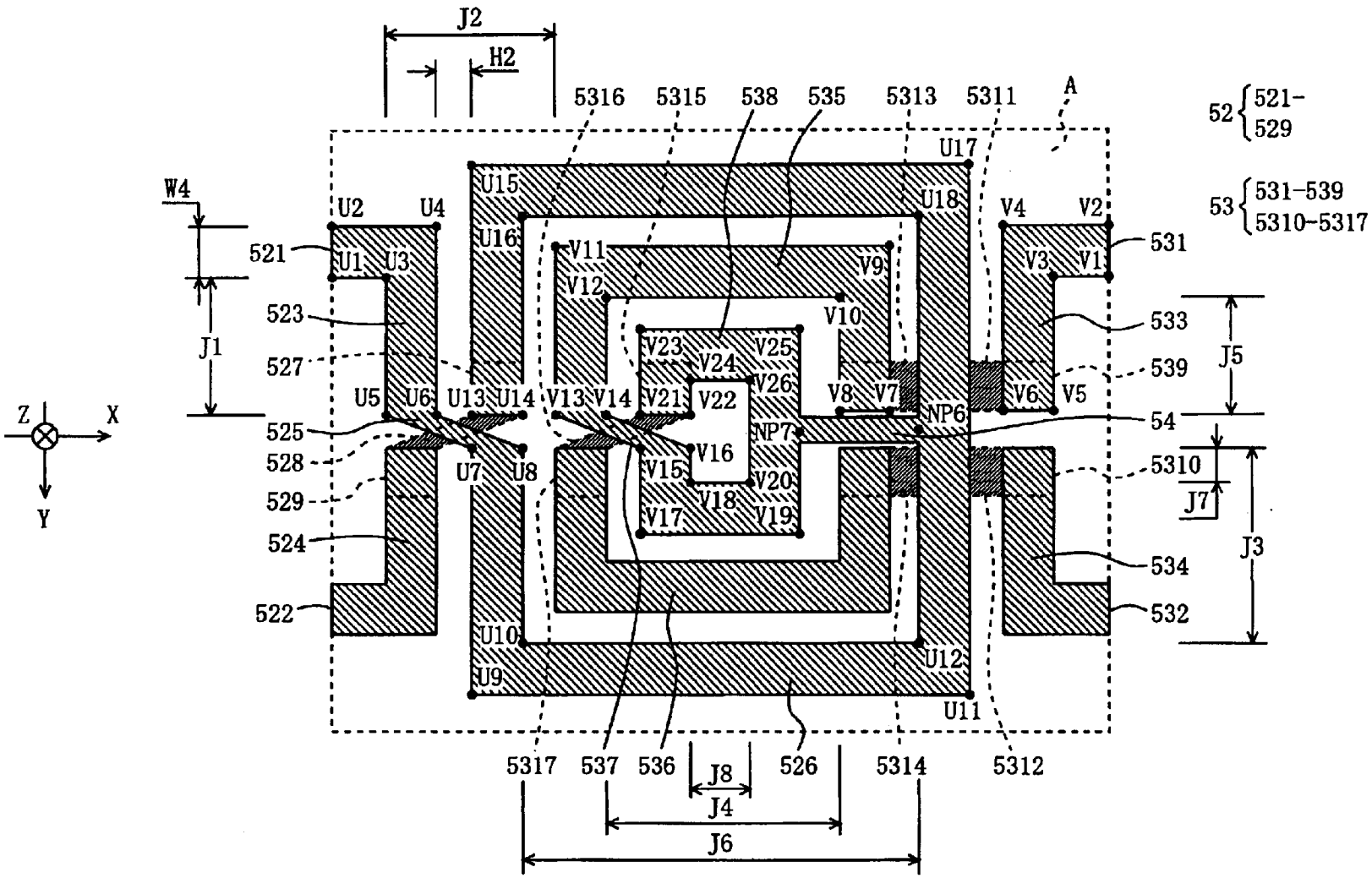
FIG. 19 is a cross-sectional view of the mutual induction circuit 51 shown in FIG. 18 and taken along plane A (see FIG. 18) parallel to the XY plane.
Figure 20:
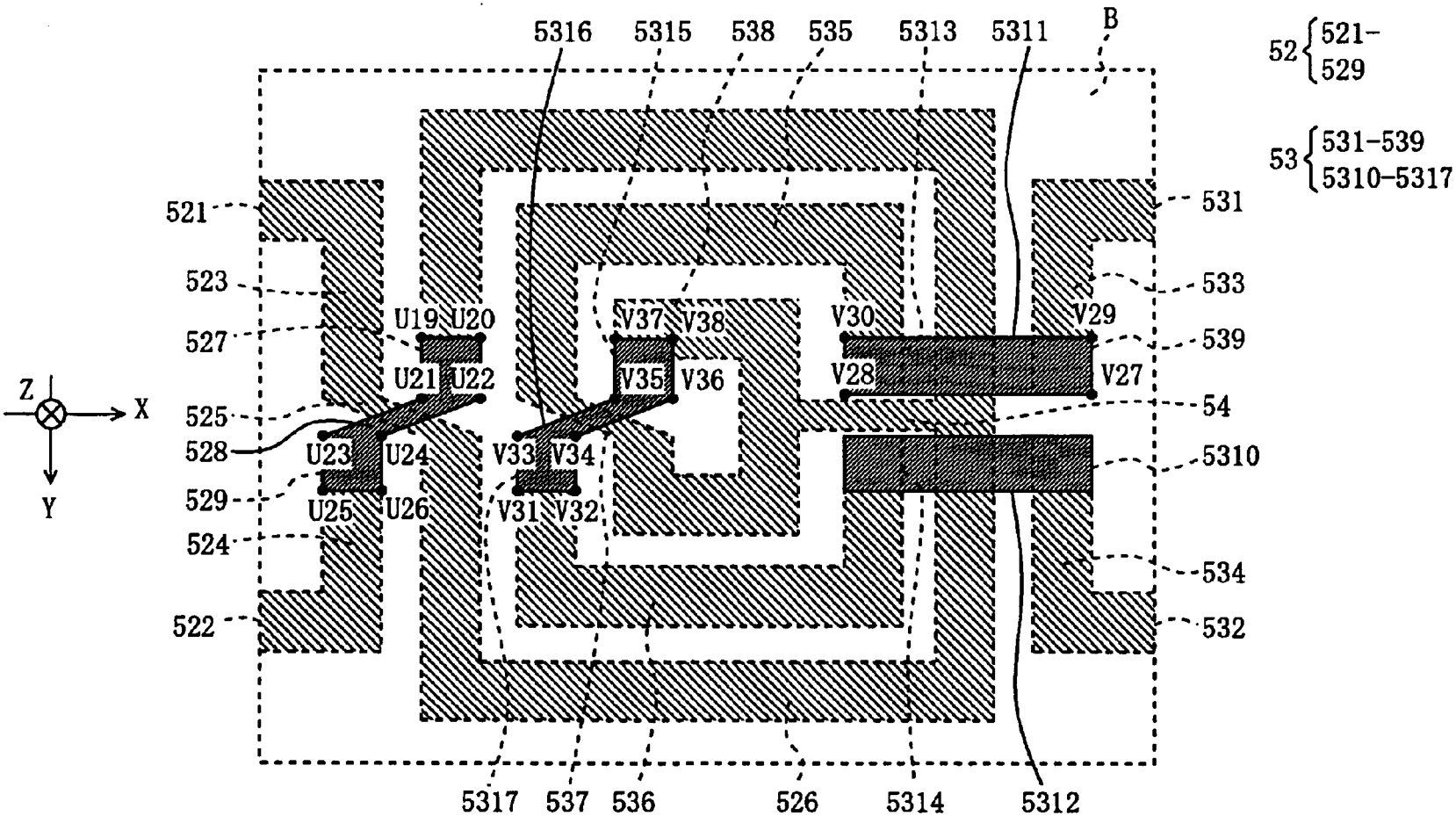
FIG. 20 is across-sectional view of the mutual induction circuit 51 taken along plane B (see FIG. 18) which is included in a lower layer and corresponds to a plane translated from plane A (see FIG. 18) by a distance of D1 along the negative direction of the Z-axis.

FIG. 19 is a cross-sectional view of the mutual induction circuit 51 taken along plane A (see FIG. 18) in the upper layer which is parallel to the XY plane. FIG. 20 is a cross-sectional view of the mutual induction circuit 51 taken along plane B (see FIG. 18) which is included in the lower layer and corresponds to a plane translated from plane A (see FIG. 18) by a distance of D1 along the negative direction of the Z-axis. Note that in FIGS. 19 and 20, elements of the mutual induction circuit 51, which are not present on either plane A or B, are all indicated by dotted lines.

The first inductor 52 is made of a conductive material. As shown in FIGS. 18 through 20, most elements of the first inductor 52 are present on plane A, and other elements are present either on plane B or in the interlayer. Specifically, the first inductor 52 includes first and second terminals 521 and 522, and first through fourth lines 523 through 526 which are typically microstrips.

The first and second terminals 521 and 522 are situated symmetrical to each other with respect to the ZX plane. In the present embodiment, the first and second terminals 521 and 522 are exemplarily shown as an end of the first line 523 and an end of the second line 524, respectively.

The first line 523 connects the first terminal 521 to the third line 525 as described below. In the present embodiment, the first line 523 is exemplarily formed within an area defined by the following six points U1 through U6 (see FIG. 19).

Point U1 has X- and Y-coordinate values (X5,−Y5), where X5 and Y5 are positive values determined in accordance with the specifications of the mutual induction circuit 51. If the width of the first line 523 is W4, point U2 corresponds to a point translated from point U1 by a distance of W4 along the negative direction of the Y-axis. Point U3 corresponds to a point translated from point U1 by an arbitrary distance determined in accordance with the specifications of the mutual induction circuit 51 along the positive direction of the X-axis. Point U4 corresponds to a point translated from point U3 by a distance of W4 along both the negative direction of the Y-axis and the positive direction of the X-axis. Point U5 corresponds to a point translated from point U3 by a distance of J1 along the positive direction of the Y-axis. Note that J1 is less than a distance between the ZX plane and point U3. Point S6 corresponds to a point translated from point U5 by a distance of W4 along the positive direction of the X-axis.

The second line 524 connects the second terminal 522 to a fifth line 528 which will be described later. The second line 524 is situated symmetrical to the first line 523 with respect to the ZX plane.

The third line 525 electrically connects the first line 523 to the fourth line 526 as described below. In the present embodiment, the third line 525 is exemplarily formed within an area enclosed by a parallelogram having, as vertices, the following four points U5 through U8 (see FIG. 19). Points U5 and U6 are as described above. Points U7 and U8 correspond to points respectively translated from first and second points, which are situated symmetrical to points U5 and U6, respectively, with respect to the ZX plane, by a distance of J2 along the positive direction of the X-axis. Note that if a line width of each of the first and second inductors 52 and 53 is W4 and a distance between a line of the first inductor 52 and a line of the second inductor 53, which is adjacent to the line of the first inductor 52, is H2, J2 is equivalent to W4+H2.

The fourth line 526 is a partially looped line forming one turn of the first inductor 52. In the present embodiment, the fourth line 526 is exemplarily formed within an area defined by the following twelve points U7 through U18 (see FIG. 19). In the present embodiment, as in the case of the first line 423, the width of the fourth line 526 is W4. Points U7 and U8 are as described above. Point U9 corresponds to a point translated from point U7 by a distance of J3+W4 along the positive direction of the Y-axis. Note that J3 is a positive value greater than J5+W4. Note that detailed description of the value J5 will be given later. Point U10 corresponds to a point translated from point U8 by a distance of J3 along the positive direction of the Y-axis. Point U11 corresponds to a point translated from point U9 by a distance of J4+2×W4 along the positive direction of the X-axis. Note that J4 is a positive value which is greater than J6+2×W4 and less than (a distance between points U4 and V4)−2×W4. Note that detailed description of the value J6 will be given later. Point U12 corresponds to a point translated from point U10 by a distance of J4 along the positive direction of the X-axis. Points U13 through U18 are situated symmetrical to points U7 through U12, respectively, with respect to the ZX plane.

In the first inductor 52, a first contact 527, a fifth line 528, and the second contact 529 are provided either on plane B or in the interlayer.

The contacts 527 and 529 have a commonality in that they are all situated in the interlayer. In the present embodiment, for ease of description, each of the contacts 527 and 529 is assumed to be a rectangular solid having a base side length of W4 and a height slightly less than D1.

The first contact 527 electrically connects at least a neighborhood of points U13 and U14 on the fourth line 526 to an area enclosed by points U19 through U22 (see FIG. 20) on the fifth line 528 as described above.

The fifth line 528 is typically a microstrip line electrically connecting the first contact 527 to the second contact 529 as described above. In the present embodiment, the fifth line 528 is exemplarily formed within an area defined by eight points U19 through U26 on plane B (see FIG. 20). Four points U21 through U24 are obtained by projecting points, which are situated symmetrical to points U5 through U8 with respect to the ZX plane, onto plane B from immediately above the mutual induction circuit 51, i.e., along a vertically downward direction. Points U19 and U20 correspond to points respectively translated from points U21 and U22 by a distance of W4 along the negative direction of the Y-axis. Points U25 and U26 correspond to points respectively translated from points U23 and U24 by a distance of W4 along the positive direction of the Y-axis.

The second contact 529 electrically connects an area enclosed by points U23 through U26 to a neighborhood of two points on the second line 524 which are situated symmetrical to points U5 and U6 with respect to the ZX plane.

As in the case of the first inductor 52, most elements of the second inductor 53 are present on plane A, and other elements are present either on plane B or in the interlayer. Specifically, in the second inductor 53, included on plane A are first and second terminals 531 and 532 and first through sixth lines 533 through 538 which are typically microstrip lines.

The first and second terminals 531 and 532 are situated symmetrical to each other with respect to the ZX plane. In the present embodiment, the first and second terminals 531 and 532 are exemplarily shown as an end of the first line 533 and an end of the second line 534, respectively.

The first line 533 electrically connects the first terminal 531 to the third line 535 as described below. In the present embodiment, the first line 533 is exemplarily formed in an area enclosed by six points V1 through V6 (see FIG. 19) on plane A. Point V1 has X- and Y-coordinate values (X6,−Y6), where X6 and Y6 are positive values determined in accordance with the specifications of the mutual induction circuit 51. In the present embodiment, Y6 is equivalent to Y5 described above. If the width of the first line 533 is W4, point V2 corresponds to a point translated from point V1 by a distance of W4 along the negative direction of the Y-axis. Point V3 corresponds to a point translated from point V1 by an arbitrary distance determined in accordance with the specifications of the mutual induction circuit 51 along the negative direction of the X-axis. Point V4 corresponds to a point translated from point V3 by a distance of W4 along the negative direction of each of the X- and Y-axes. Point V5 corresponds to a point translated from point V3 by a distance of J1 along the positive direction of the Y-axis. Point V6 corresponds to a point translated from point V5 by a distance of W4 along the negative direction of the X-axis.

The second line 534 electrically connects the second terminal 532 to a second contact 5310 which will be described later, and is situated symmetrical to the first line 533 with respect to the ZX plane.

The third line 535 is a partially looped line forming a portion of the outermost turn of the second inductor 53 and electrically connecting a third contact 5313 and a fourth line 537 both of which will be described later. In the present embodiment, the third line 535 is exemplarily formed within an area defined by eight points V7 through V14 (see FIG. 19) on plane A. Points V7 and V8 correspond to points respectively translated from points V5 and V6 by a distance slightly greater than 2×(W4+H2) along the negative direction of the X-axis. Point V9 corresponds to a point translated from point V7 by a distance of J5+W4 along the negative direction of the Y-axis. Note that J5 is a positive value which is less than J3−W4 and greater than J7+W4. Note that detailed description of the value J7 will be given later. Point V10 corresponds to a point translated from point V8 by a distance of J5 along the negative direction of the Y-axis. Point V11 corresponds to a point translated from point V9 by a distance of J6+2×W4 along the negative direction of the X-axis. Note that J6 is a positive value which is less than J4−2×W4 and greater than J8+2×W4. Note that detailed description of the value J8 will be given later. Point V12 corresponds to a point translated from point V10 by a distance of J6 along the negative direction of the X-axis. Point V13 corresponds to a point translated from point V11 by a distance of J5+W4 along the positive direction of the Y-axis. Point V14 corresponds to a point translated from point V12 by a distance of J5 along the positive direction of the Y-axis.

The fourth line 536 is a partially looped line forming a portion of the outermost turn of the second inductor 53 and electrically connecting fourth and sixth contacts 5314 and 5317 which will be described later. The fourth line 536 is situated symmetrical to the third line 535 with respect to the ZX plane.

The fifth line 537 connects the third line 535 to the sixth line 538 as described below. In the present embodiment, the fifth line 537 is formed within an area enclosed by a parallelogram having, as vertices, four points V13 through V16 (FIG. 16). Points V13 and V14 are as described above. Points V15 and V16 correspond to points respectively translated from first and second points, which are situated symmetrical to points V13 and V14, respectively, with respect to the ZX plane, by a distance of W4+H2 along the positive direction of the X-axis.

The sixth line 538 is a partially looped line forming a turn situated one turn inward from the outermost turn of the second inductor 53 (in the present embodiment, such a turn is exemplified as an innermost turn). In the present embodiment, the sixth line 538 is formed within an area defined by twelve points V15 through V26 (see FIG. 19). Note that in the present embodiment, the width of the sixth line 538 is W4. Points V15 and V16 are as described above. Point V17 corresponds to a point translated from point V15 by a distance of J7+W4 along the positive direction of the Y-axis. Point V18 corresponds to a point translated from point V16 by a distance of J7 along the positive direction of the Y-axis. Note that J7 is a positive value which is less than J5−W4. Point V19 corresponds to a point translated from point V17 by a distance of J8+2×W4 along the positive direction of the X-axis. Note that J8 is a positive value which is less than J6−2×W4. Point V20 corresponds to a point translated from point T18 by a distance of J8 along the positive direction of the X-axis. Points V21 through V26 are situated symmetrical to points V15 through V20, respectively, with respect to the ZX plane.

In the second inductor 53, provided either on plane B or in the interlayer are first and second contacts 539 and 5310, seventh and eighth lines 5311 and 5312, the third through fifth contacts 5313 through 5315, a ninth line 5316, and a sixth contact 5317.

The contacts 539, 5310, 5313 through 5315, and 5317 have a commonality in that they are all situated in the interlayer. In the present embodiment, for ease of description, each of contacts 539, 5310, 5313 through 5315, and 5317 is assumed to be a rectangular solid having a base side length of W4 and a height slightly less than D1.

The first contact 539 electrically connects at least a neighborhood of points V5 and V6 on the first line 533 to a neighborhood of points V27 and V29 (see FIG. 20) on the seventh line 5311 as described below.

The second contact 5310 is formed symmetrical to the first contact 539 with respect to the ZX plane, and electrically connects a neighborhood of two points, which are situated symmetrical to points V5 and V6, respectively, on the second line 534, to a neighborhood of two points, which are situated symmetrical to points V27 and V29, respectively, on the eighth line 5312 as described below.

The seventh line 5311 electrically connects the first contact 539 to the third contact 5313 as described below. In the present embodiment, the seventh line 5311 is formed within an area enclosed by four points V27 through V30 (see FIG. 20) on plane B. Point V27 is situated where point V5 projects onto plane B along a vertical downward direction. Point V28 corresponds to a point translated from point V27 by a distance of 3×W4+2×H2 along the negative direction of the X-axis. Points V29 and V30 corresponds to points respectively translated from points V27 and V28 by a distance of W4 along the negative direction of the Y-axis.

The eighth line 5312 electrically connects the second contact 5310 to the fourth contact 5314 as described below, and is situated symmetrical to the seventh line 5311 with respect to the ZX plane.

The third contact 5313 electrically connects at least a neighborhood of points V28 and V30 on the seventh line 5311 to a neighborhood of points V7 and V8 (see FIG. 19) on the third line 535.

The fourth contact 5314 is situated symmetrical to the third contact 5313 with respect to the ZX plane, and electrically connects a neighborhood of two points, which are situated symmetrical to points V28 and V30, respectively, on the eighth line 5312, to a neighborhood of two points which are situated symmetrical to points V7 and V8 on the fourth line 5314.

The fifth contact 5315 electrically connects at least a neighborhood of points V21 and V22 on the sixth line 538 to a neighborhood of two points on the ninth line 5316 which are obtained by projecting points V21 and V22 onto plane B.

The ninth line 5316 electrically connects the fifth contact 5313 to the sixth contact 5317 as described below. In the present embodiment, the ninth line 5316 is formed within an area defined by eight points V31 through V38 (see FIG. 20) on plane B. Points V33 through V36 are situated where four points, which are situated symmetrical to points V13 through V16, respectively, with respect to the ZX plane, project onto plane B along a vertical downward direction. Points V31 and V32 correspond to points respectively translated from points V33 and V34 by a distance of W4 along the positive direction of the Y-axis. Points V37 and V38 correspond to points respectively translated from points V35 and V36 by a distance of W4 along the negative direction of the Y-axis.

The sixth contact 5317 electrically connects at least a neighborhood of points V33 and V34 on the ninth line 5316 to a neighborhood of two points on the fourth line 536 which are situated symmetrical to points V13 and V14.

As described above, the mutual induction circuit 51 includes the first and second inductors 52 and 53 which are slightly different in shape from the first and second inductors 42 and 43 but satisfy requirements for forming the first and second inductors 42 and 43 which are described in the second embodiments. Accordingly, it is possible to achieve a technical effect similar to that achieved by the mutual induction circuit 41, i.e., it is possible to reduce a footprint of the mutual induction circuit 51, whereby it is possible to reduce internal losses due to resistive components of the semiconductor substrate. Moreover, as in the case of the mutual induction circuit 41, the mutual induction circuit 51 is preferably provided in particular by a semiconductor process which fabricates a semiconductor circuit in which a top wiring layer is thicker than underlying wiring layers.

In addition to the essential elements as described above, the mutual induction circuit 51 preferably includes a connection line 54. The connection line 54 is typically a microstrip line which connects at least an area including a virtual center NP6 of the first inductor 52 and its surroundings to an area including a virtual center NP7 of the second inductor 53 and its surroundings. Note that the virtual center NP6 is a point of intersection between points U12 and U18, and the virtual center NP7 is a point of intersection between points V19 and V25. The virtual centers NP6 and NP7 may be connected to each other for the reason described in the first embodiment in relation to the virtual centers NP1 and NP2.

Further, a differential signal may be supplied to the second inductor 43 so as to obtain a transformed differential signal from the first inductor 42.

Furthermore, the number of turns in each of the first and second inductors 42 and 43 may be any number of turns.

Further still, preferably, the mutual induction circuit 51 may include the pattern shield 7 described with reference to FIGS. 7A and 7B, in addition to the above-described essential elements. Moreover, the mutual induction circuit 51 may be formed on a silicon substrate including the trenches 8 described above with reference to FIGS. 8A and 8B.

A transformer element as the above-described mutual induction circuit 51 may be formed on a dielectric multilayer substrate 9 as shown in FIG. 10 or on a single layer double-sided substrate 11 as shown in FIG. 11, rather than on the semiconductor substrate 4.

(Fourth Embodiment)

Figure 21:
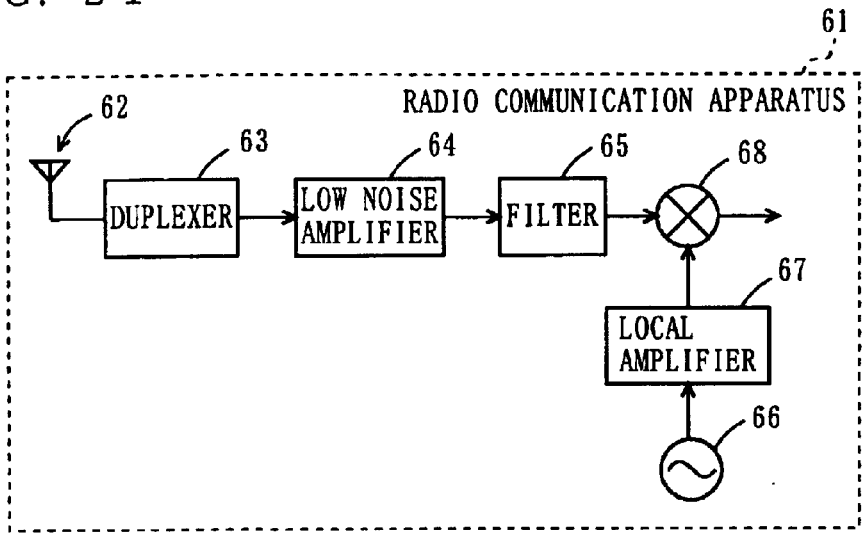
FIG. 21 is a block diagram illustrating the overall structure of a radio communication apparatus 61 according to a fourth embodiment of the present invention.

FIG. 21 is a block diagram illustrating the overall structure of a radio communication apparatus 61 according to a fourth embodiment of the present invention. In FIG. 21, the radio communication apparatus 61 is configured for down conversion of a received signal, and typically includes an antenna 62, a duplexer 63, a low noise amplifier (hereinafter, abbreviated as "LNA") 64, a filter 65, an oscillation circuit 66, a local amplifier 67, and a mixer 68.

The antenna 62 receives an externally transmitted signal. The signal received by the antenna 62 is transmitted to the duplexer 63. The duplexer 63 outputs the signal received by the antenna 62 to the LNA 64. The LNA 64 amplifies the signal outputted from the duplexer 63, and outputs a resultant signal to the filter 65. The filter 65 passes therethrough only a signal component in a desired frequency bandwidth from the signal outputted from the LNA 64.

Figure 22:
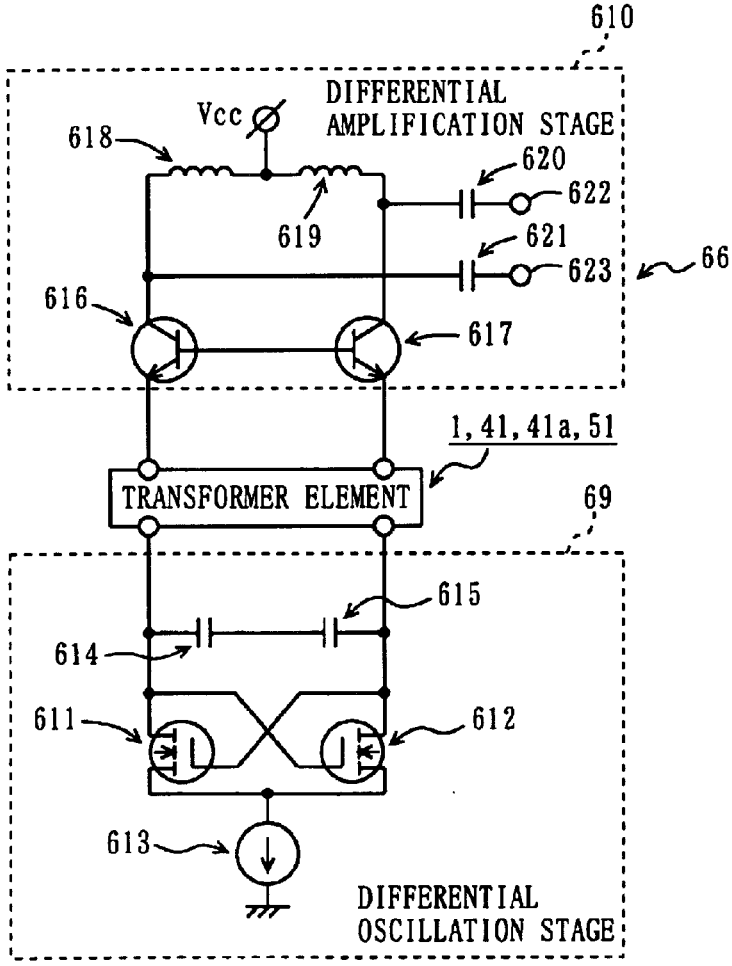
FIG. 22 is a block diagram illustrating the detailed structure of an oscillation circuit 66 shown in FIG. 21.

The oscillation circuit 66 is required for down-converting a signal outputted from the filter 65. The oscillation circuit 66 generates and outputs a local oscillation output having a predetermined frequency. FIG. 22 is a block diagram illustrating the detailed structure of the oscillation circuit 66. In FIG. 22, the oscillation circuit 66 typically includes a differential oscillation stage 69, the mutual induction circuit 1, 41, 41*a*, or 51, and a differential amplification stage 610.

These elements are electrically connected in the order of the differential oscillation stage 69, the mutual induction circuit 1, 41, 41*a*, or 51, and the differential amplification stage 610.

The differential oscillation stage 69 includes first and second oscillation field effect transistors (FETs) 611 and 612, a constant-current source 613, and first and second resonance capacitors 614 and 615 each preferably having variable capacitance.

The differential amplification stage 610 includes third and fourth buffer amplification transistors 616 and 617, first and second choke inductors 618 and 619, first and second capacitors 620 and 621 for cutting direct current component, and first and second output terminals 622 and 623.

In the oscillation circuit 66, direct current is applied to the first and second choke inductors 618 and 619 of the differential amplification stage 610 via a Vcc terminal. The applied direct current is supplied through the third and fourth transistors 616 and 617 to a terminal on the output side of the mutual induction circuit 1, 41, 41*a*, or 51. As described above, the mutual induction circuits 1, 41, 41*a*, and 51 are all configured so as to be able to supply direct current from one of two capacitors to the other capacitor via the contact 6, the connection line 44 or the connection lines 44 and 44*a*, and the connection line 54. Accordingly, it is possible to input direct current from two terminals on the input side of the mutual induction circuit 1, 41, 41*a*, or 51 to the differential oscillation stage 69. The direct current inputted in a manner as described above is supplied to the first and second FETs 611 and 612, and then flows through the constant-current source 613 to a ground, thereby operating the first and second FETs 611 and 612.

The first and second FETs 611 and 612 are connected to each other such that positive feedback is applied thereto. The first and second FETs 611 and 612 generate differential signals each having an oscillation frequency depending on a resonance frequency of the first or second capacitor 614 or 615 with the mutual induction circuit 1, 41, 41*a*, or 51, and supply the mutual induction circuit 1, 41, 41*a*, or 51 with in-phase and reverse-phase signals.

As described above, the mutual induction circuit 1, 41, 41*a*, or 51 transforms an input differential signal, and supplies a resultant signal to the differential amplification stage 610.

In the differential amplification stage 610, the third and fourth transistors 616 and 617 each operate as a grounded-base amplifier to amplify the in-phase and reverse-phase signals contained in the input differential signal. The first and second capacitors 620 and 621 each remove direct current component from the amplified differential signal, and then a resultant signal is outputted from each of the first and second output terminals 622 and 623.

An in-phase or reverse-phase signal outputted from one of the first and second output terminals 622 and 623 is amplified by the local amplifier 67 into a local oscillation signal, and then the local oscillation signal is supplied to the mixer 68. The mixer 68 performs frequency mixing of an output signal of the filter 65 with the local oscillation signal outputted from the local amplifier 67, and then outputs a resultant signal.

As described above, the mutual induction circuit 1, 41, 41*a*, or 51 is incorporated into the oscillation circuit 66, and therefore the differential oscillation stage 69 is operated by merely supplying direct current to the differential amplification stage 610. Accordingly, it is not necessary to supply the direct current to each of the differential amplification stage 610 and the differential oscillation stage 69, and therefore it is possible to curb power consumption of the oscillation circuit 66 and the radio communication apparatus 61.

Further, in the above-described configuration, each of the third and fourth transistors 616 and 617 can be used as a grounded-base amplifier having small mirror capacitance, and therefore it is possible to realize the oscillation circuit 66 resistant to load variation.

(Fifth Embodiment)

As is apparent from FIG. 13, in the mutual induction circuit 41 according to the second embodiment, the first and second inductors 42 and 43 are not symmetrical to each other with respect to the Y-axis, and therefore 1:1 turn ratio cannot be realized between them. In a fifth embodiment of the present invention, a mutual induction circuit 71 capable of realizing a 1:1 turn ratio will be described.

Figure 23:
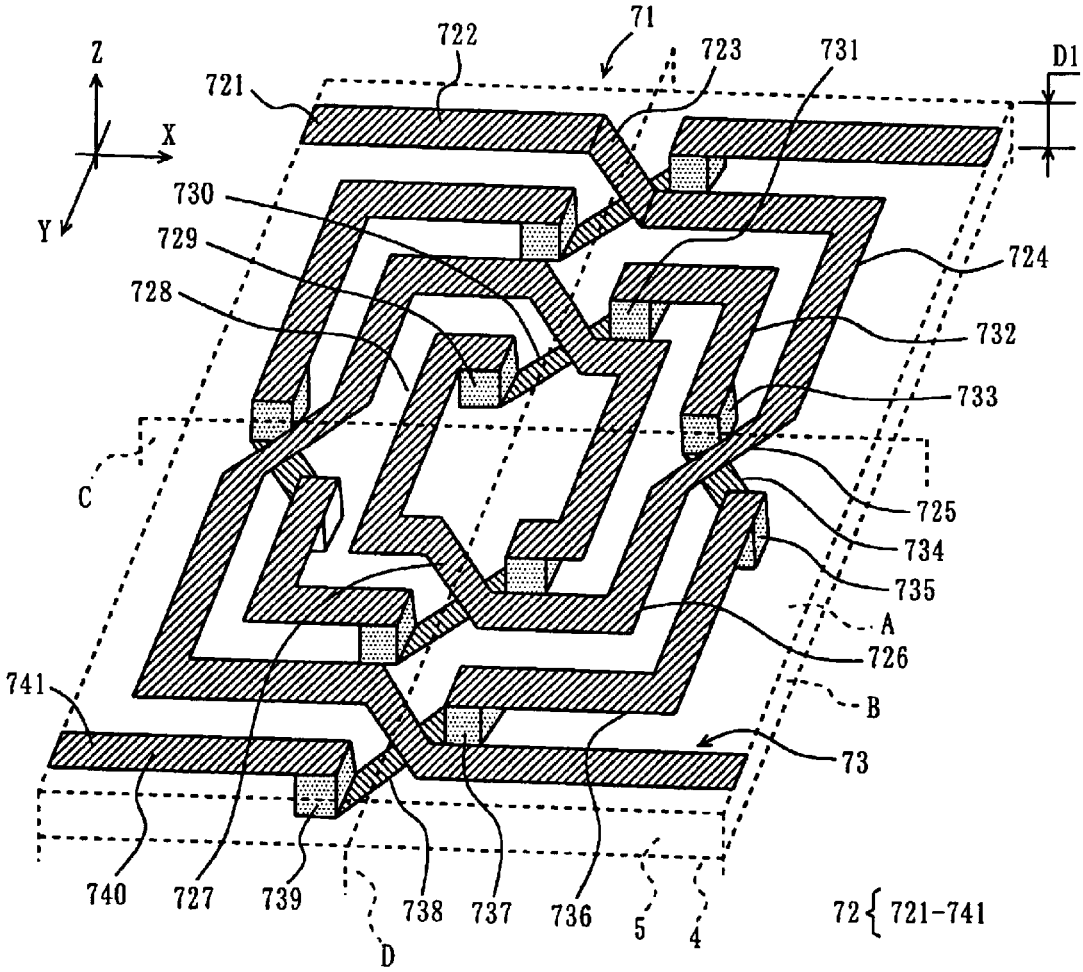
FIG. 23 is a perspective view illustrating the structure of a mutual induction circuit 71 according to a fifth embodiment of the present invention.

FIG. 23 is a perspective view illustrating the structure of a transformer element which is an example of the mutual induction circuit 71. For ease of description, a three-dimensional coordinate system as used in other embodiments is shown in FIG. 23. In FIG. 23, similar to the mutual induction circuit 1, the mutual induction circuit 71 is formed using two wiring layers, i.e., upper and lower wiring layers, within the interlayer insulating film 5 on the semiconductor substrate 4. In the following descriptions, the upper wiring layer, the lower wiring layer, and a space between the upper and lower wiring layers are referred to as an "upper layer, a "lower layer, and an "interlayer", respectively. Specifically, the mutual induction circuit 71 is made of a conductive material, and essentially includes a first inductor 72 and a second inductor 73.

Figure 24:
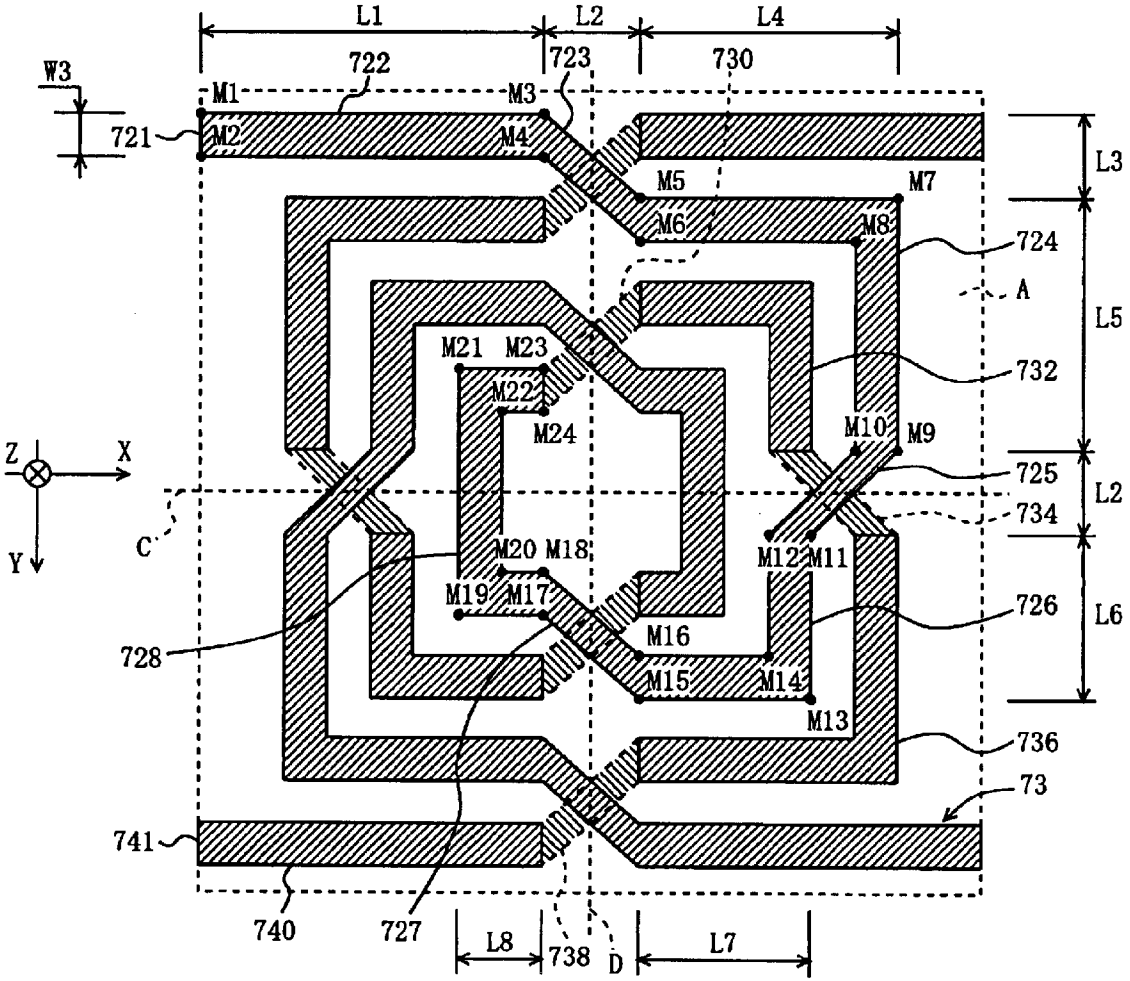
FIG. 24 is a cross-sectional view of the mutual induction circuit 71 shown in FIG. 23 and taken along plane A (see FIG. 23) parallel to the XY plane.
Figure 25:
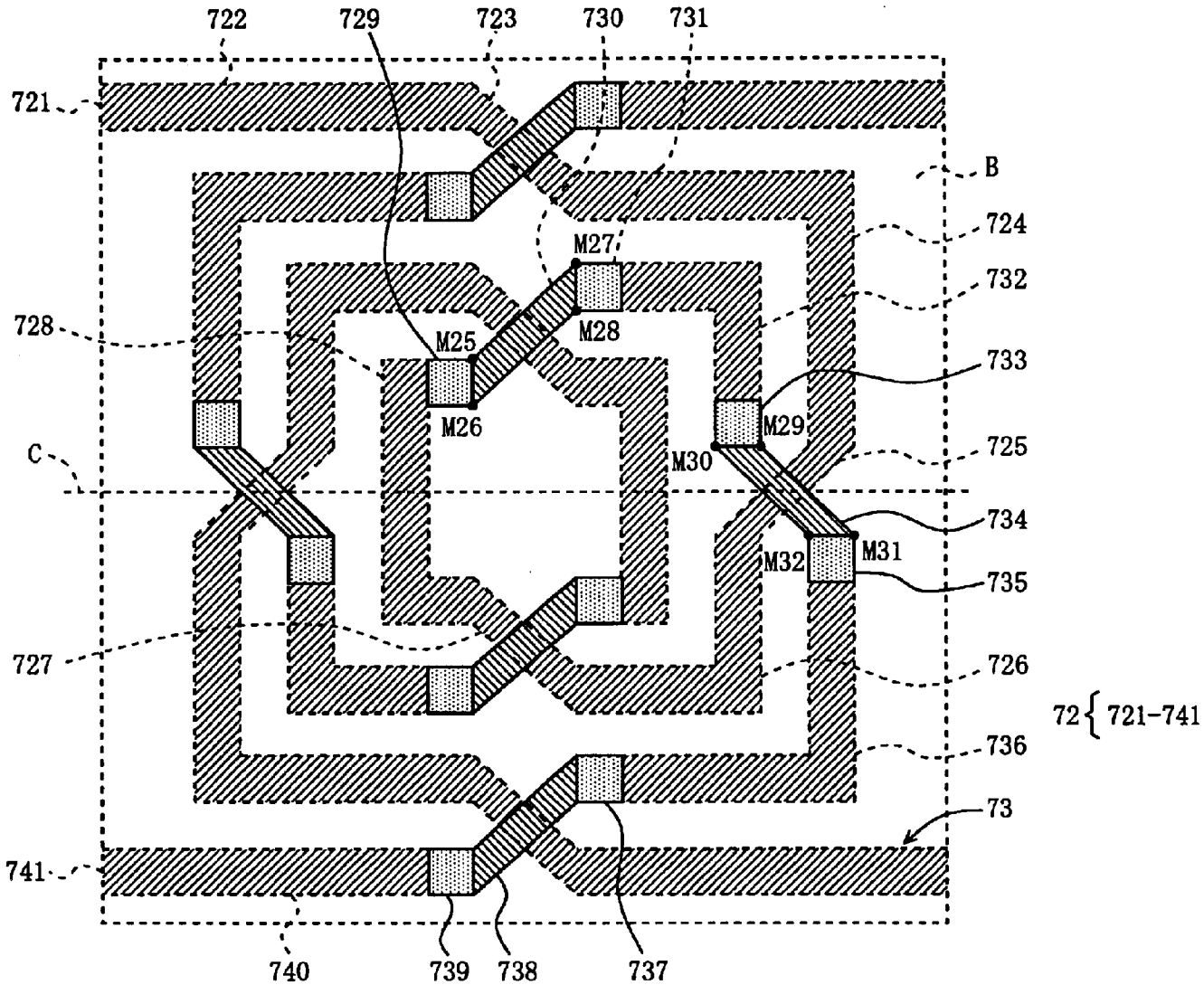
FIG. 25 is across-sectional view of the mutual induction circuit 71 taken along plane B (see FIG. 23) which is included in a lower layer and corresponds to a plane translated from plane A (see FIG. 23) by a distance of D1 along the negative direction of the Z-axis.

FIG. 24 is a cross-sectional view of the mutual induction circuit 71 taken along plane A (see FIG. 23) parallel to the XY plane in the upper layer. FIG. 25 is a cross-sectional view of the mutual induction circuit 71 taken along plane B (see FIG. 23), which is included in the lower layer and corresponds to a plane translated from plane A (see FIG. 23) by a distance of D1 along the negative direction of the Z-axis. Note that in FIGS. 24 and 25, elements of the mutual induction circuit 71, which are not present on either plane A or B, are all indicated by dotted lines. Also, in FIGS. 23 through 25, plane C is a reference plane parallel to the ZX plane and passing through the center of the mutual induction circuit 71, and plane D is a reference plane parallel to the YZ plane and passing through the center of the mutual induction circuit 71.

As shown in FIGS. 23 through 25, most elements of the first inductor 72 are present on plane A, and other elements are present either on plane B or in the interlayer. Specifically, the first inductor 72 includes a first terminal 721, a second line 722, a first connection line 723, a third line 724, a second connection line 725, a fourth line 726, a third connection line 727, a fifth line 728, a first contact 729, a fourth connection line 730, a second contact 731, a sixth line 732, a third contact 733, a fifth connection line 734, a fourth contact 735, a seventh line 736, a fifth contact 737, a sixth connection line 738, a sixth contact 739, an eighth line 740, and a second terminal 741.

Most of the above elements are provided in the upper layer, i.e., on plane A. Specifically, as shown in FIG. 24, provided on plane A are the first terminal 721, the second line 722, the first connection line 723, the third line 724, the second connection line 725, the fourth line 726, the third connection line 727, the fifth line 728, the sixth line 732, the seventh line 736, the eighth line 740, and the second terminal 741.

As shown in FIG. 25, among elements other than those situated on plane A, the fourth connection line 730, the fifth connection line 734, and the sixth connection line 738 are situated in the lower later, i.e., on plane B.

As shown in FIG. 23, the first contact 729, the second contact 731, the third contact 733, the fourth contact 735, the fifth contact 737, and the sixth contact 739 are situated in the interlayer.

In the present embodiment, the first terminal 721 is exemplarily shown as an end of the first line 722.

The first line 722 is typically a microstrip line, and electrically connects the first terminal 721 to the first connection line 723 as described below. In the present embodiment, the first line 722 is exemplarily formed within an area defined by the following four points M1 through M4 on plane B (see FIG. 24). Point M1 has X- and Y-coordinate values (X1,−Y1), where X1 and Y1 are positive values determined in accordance with the specifications of the mutual induction circuit 71. If the width of the first line 722 is W3, point M2 corresponds to a point translated from point M1 by a distance of W3 along the positive direction of the Y-axis. Point M3 corresponds to a point translated from point M1 by an arbitrary distance L1 determined in accordance with the specifications of the mutual induction circuit 71 along the positive direction of the X-axis. Point M4 corresponds to a point translated from point M3 by a distance of W3 along the positive direction of the Y-axis.

The first connection line 723 is typically a microstrip line, and electrically connects the first line 722 to the third line 724 as described below. In the present embodiment, the first connection line 723 is exemplarily formed within an area defined by points M3 through M6 (see FIG. 24). Points M3 and M4 are as described above. Point M5 corresponds to a point translated from point M3 by a distance of L2 along the positive direction of the X-axis and a distance of L3 along the positive direction of the Y-axis. Point M6 corresponds to a point translated from point M4 by a distance of L2 along the positive direction of the X-axis and a distance of L3 along the positive direction of the Y-axis. In FIG. 24, each of L2 and L3 is an arbitrary number determined in accordance with the specifications of the mutual induction circuit 71, and L3 is selected so as to be greater than W3.

The third line 724 is typically a microstrip line, and electrically connects the first connection line 723 to the second line 726 as described below. In the present embodiment, the third line 724 is exemplarily formed within an area enclosed by the following six points M5 through M10 (see FIG. 24). Points M5 and M6 are as described above. Point M7 corresponds to a point translated from point M5 by a distance of L4 along the positive direction of the X-axis. Point M8 corresponds to a point translated from point M6 by a distance of L4−W3 along the positive direction of the X-axis. Note that L4 is determined in accordance with the specifications of the mutual induction circuit 71 so as to be less than L1. Point M9 corresponds to a point translated from point M7 by a distance of L5 along the positive direction of the Y-axis. Point M10 corresponds to a point translated from point M8 by a distance of L5−W3 along the positive direction of the Y-axis.

The second connection line 725 is typically a microstrip line, and electrically connects the third line 724 to the fourth line 726 as described below. In the present embodiment, the second connection line 725 is exemplarily formed within a parallelogram enclosed by the following four points M9 through M12 (see FIG. 24). Point M9 and M10 are as described above. Point M11 corresponds to a point translated from point M9 by a distance of L2 along the positive direction of the Y-axis and a distance of L3 along the negative direction of the X-axis. Point M12 corresponds to a point translated from point M10 by a distance of L2 along the positive direction of the Y-axis and a distance of L3 along the negative direction of the X-axis.

The fourth line 726 is typically a microstrip line, and electrically connects the second connection line 725 to the third connection line 727. In the present embodiment, the fourth line 726 is exemplarily formed within an area enclosed by the following six points M11 through M16 (see FIG. 24). Points M11 and M12 are as described above. Point M13 corresponds to a point translated from point M11 by a distance of L6 along the positive direction of the Y-axis. Point M14 corresponds to a point translated from point M12 by a distance of L6−W3 along the positive direction of the Y-axis. Note that L6 is determined in accordance with the specifications of the mutual induction circuit 71 so as to be less than L5−W3. Point M15 corresponds to a point translated from point M13 by a distance of L7 along the negative direction of the X-axis. Point M16 corresponds to a point translated from point M14 by a distance of L7−W3 along the negative direction of the X-axis.

The third connection line 727 is typically a microstrip line, and electrically connects the fourth line 726 to the fifth line 728 as described below. In the present embodiment, the third connection line 727 is exemplarily formed within a parallelogram enclosed by the following four points M15 through M18 (see FIG. 24). Point M15 and M16 are as described above. Point M17 corresponds to a point translated from point M15 by a distance of L3 along the negative direction of the Y-axis and a distance of L2 along the negative direction of the X-axis. Point M18 corresponds to a point translated from point M16 by a distance of L3 along the negative direction of the Y-axis and a distance of L2 along the negative direction of the X-axis.

The fifth line 728 is typically a microstrip line, and electrically connects the third connection line 727 to the first contact 729. In the present embodiment, the fifth line 728 is exemplarily formed within an area enclosed by the following eight points M17 through M24 (see FIG. 24). Points M17 and M18 are as described above. Point M19 corresponds to a point translated from point M17 by a distance of L8 along the negative direction of the X-axis. Point M20 corresponds to a point translated from point M18 by a distance of L8−W3 along the negative direction of the X-axis. Note that L8 is determined in accordance with the specifications of the mutual induction circuit 71 so as to be less than L7−W3. Points M21 and M22 are situated symmetrical to points M19 and M20, respectively, with respect to plane C. Points M23 and M24 are situated symmetrical to points M17 and M18, respectively, with respect to plane C.

The first contact 729 electrically connects points M23 and M24 on the fifth line 728 to points M25 and M26 of the fourth connection line 730 as described below.

The fourth connection line 730 is typically a microstrip line, and electrically connects the first contact 729 to the second contact 731 as described below. In the present embodiment, the fourth connection line 730 is exemplarily formed within a parallelogram enclosed by the following four points M25 through M28 (see FIG. 25). Point M25 corresponds to a point translated from point M23 by a distance of D1 (see FIG. 23) along the negative direction of the Z-axis. Point M26 corresponds to a point translated from point M24 by a distance of D1 (see FIG. 23) along the negative direction of the Z-axis. Point M27 corresponds to a point translated from point M25 by a distance of L2 along the positive direction of the X-axis and a distance of L3 along the negative direction of the Y-axis. Point M28 corresponds to a point translated from point M26 by a distance of L2 along the positive direction of the X-axis and a distance of L3 along the negative direction of the Y-axis.

The second contact 731 electrically connects points M27 and M28 on the fourth line 730 to points M29 and M30 of the sixth line 732 as described below.

The sixth line 732 is typically a microstrip line, and electrically connects the second contact 731 to the third contact 733. The sixth line 732 is situated symmetrical to the fourth line 726 with respect to plane C.

The third contact 733 electrically connects the sixth line 732 to the fifth connection line 734 as described below.

The fifth connection line 734 is typically a microstrip line, and electrically connects the third contact 733 to the fourth contact 735 as described below. In the present embodiment, the fifth connection line 734 is exemplarily formed within a parallelogram enclosed by points M29 through M32 so as to be situated symmetrical to the second connection line 725 with respect to plane C.

The fourth contact 735 electrically connects the fifth line 734 to the seventh connection line 736 as described below.

The seventh line 736 is typically a microstrip line, and electrically connects the fourth contact 735 to the fifth contact 737. The seventh line 736 is situated symmetrical to the third line 724 with respect to plane C.

The fifth contact 737 electrically connects the seventh line 736 to the sixth connection line 738 as described below.

The sixth connection line 738 is typically a microstrip line. In the present embodiment, the sixth connection line 738 is exemplarily formed in the shape of a parallelogram so as to be situated symmetrical to the first connection line 723 with respect to plane C.

The sixth contact 739 electrically connects the sixth connection line 738 to the eighth line 740 as described below.

The eighth line 740 is typically a microstrip line. In the present embodiment, the eighth line 740 is situated symmetrical to the first line 722 with respect to plane C.

The second terminal 741 is situated symmetrical to the first terminal 721 with respect to plane C.

The second inductor 73 typically includes microstrip lines and contacts, and has a shape obtained by rotating the first inductor 72 by 180 degrees about an intersection line E between planes C and D.

As described above, each of the first and second inductors 72 and 73 is formed using the upper and lower layers. The second inductor 73 has a shape substantially symmetrical to the shape of the first inductor 72 with respect to planes C and D, and therefore it is possible to realize a 1:1 turn ratio between the first and second inductors 72 and 73.

The mutual induction circuit 71 has all features of the mutual induction circuit 1, and therefore can achieve a technical effect similar to that achieved by the mutual induction circuit 1.

More preferably, the mutual induction circuit 71 may include the pattern shield 7 described with reference to FIGS. 7A and 7B. Moreover, the mutual induction circuit 71 may be formed on a silicon substrate including the trenches 8 described above with reference to FIGS. 8A and 8B. The mutual induction circuit 71 may be formed on a dielectric multilayer substrate 9 as shown in FIG. 10 or on a single layer double-sided substrate 11 as shown in FIG. 11, rather than on the semiconductor substrate 4.

(Sixth Embodiment)

In the radio communication apparatus 61 shown in FIG. 21, a single-phase signal is inputted into the antenna 62, while the mixer 68 is incorporated into an integrated circuit. Accordingly, a differential circuit is often used in the radio communication apparatus 61. A sixth embodiment of the present invention will be described below with respect to an amplification circuit 83 which receives a single-phase signal and outputs a differential signal.

Figure 26:
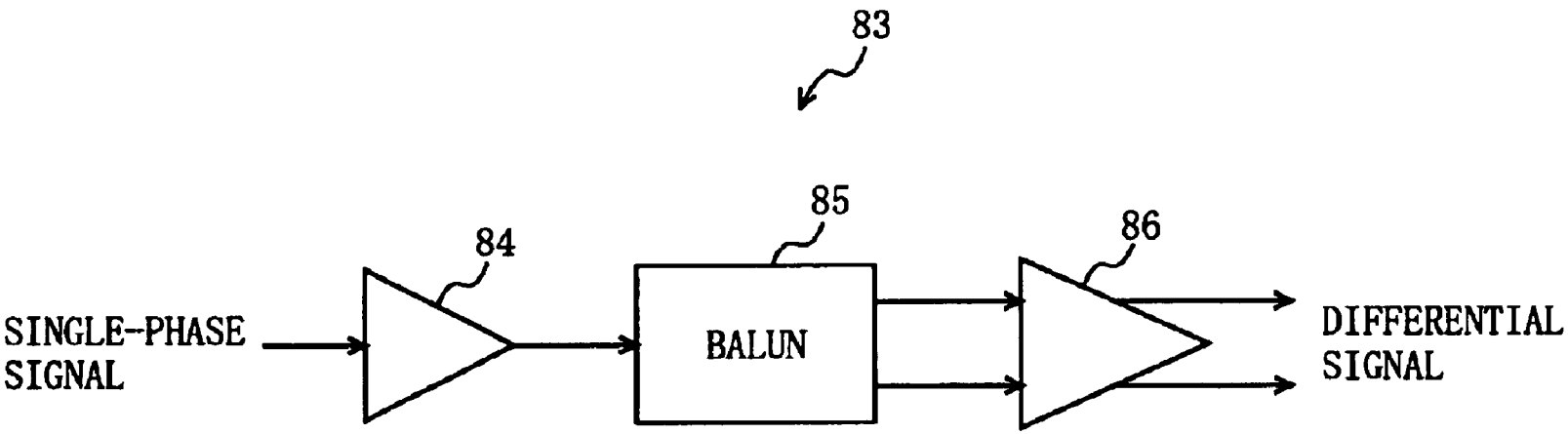
FIG. 26 is a block diagram illustrating the overall structure of an amplification circuit 83 according to a sixth embodiment of the present invention.

FIG. 26 is a block diagram illustrating the overall structure of the amplification circuit 83. In FIG. 26, the amplification circuit 83, which is typically used as a low noise amplifier (e.g., as the LNA 64 shown in FIG. 21), includes a preamplifier 84, a balun 85, and a differential amplifier 86.

The preamplifier 84 amplifies a single-phase signal received by, for example, an antenna.

Figure 27:
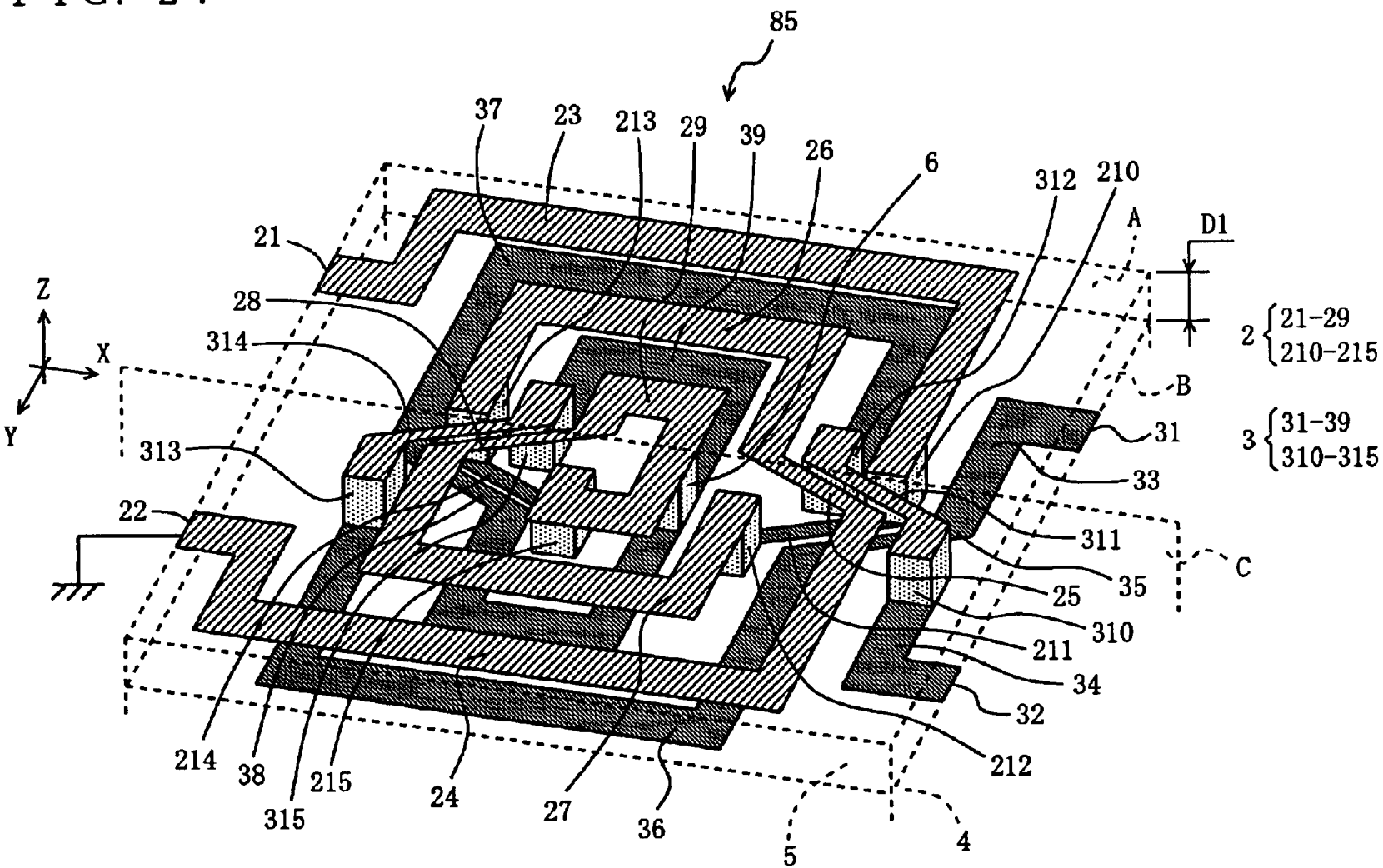
FIG. 27 is a perspective view illustrating an exemplary structure of a balun 85 shown in FIG. 26.

The balun 85 is a balance-unbalance transformer circuit which converts a single-phase signal into a differential signal. Specifically, the balun 85 converts a single-phase signal amplified by the preamplifier 84 into a differential signal. FIG. 27 is a perspective view illustrating an exemplary structure of the balun 85 shown in FIG. 26. In FIG. 27, the balun 85 differs from the mutual induction circuit 1 shown in FIG. 1 in that the second terminal 22 is grounded. There is no other difference between the balun 85 and the mutual induction circuit 1. In FIG. 27, elements corresponding to those shown in FIG. 1 are denoted by the same reference numerals, and detailed descriptions thereof are omitted.

In the thus-structured balun 85, when a single-phase signal outputted from the preamplifier 84 is inputted into the first terminal 21, in-phase and reverse-phase signals contained in a differential signal are outputted from the first and second terminals 31 and 32 of the second inductor 3.

The differential amplifier 86 amplifies the differential signal outputted from the balun 85.

The amplifier circuit 83 having the above-described structure has the balun 85 incorporated therein, and therefore it is possible to generate a differential signal in which a difference in phase between the in-phase and reverse-phase signals is considerably small.

Although the mutual induction circuit 1 is applied to the balun 85 shown in FIG. 27, the present invention is not limited to this. The mutual induction circuit 41 (see FIG. 12), the mutual induction circuit 51 (see FIG. 18), or the mutual induction circuit 71 (see FIG. 23) may be applied to the balun 85.

(Seventh Embodiment)

Figure 28:
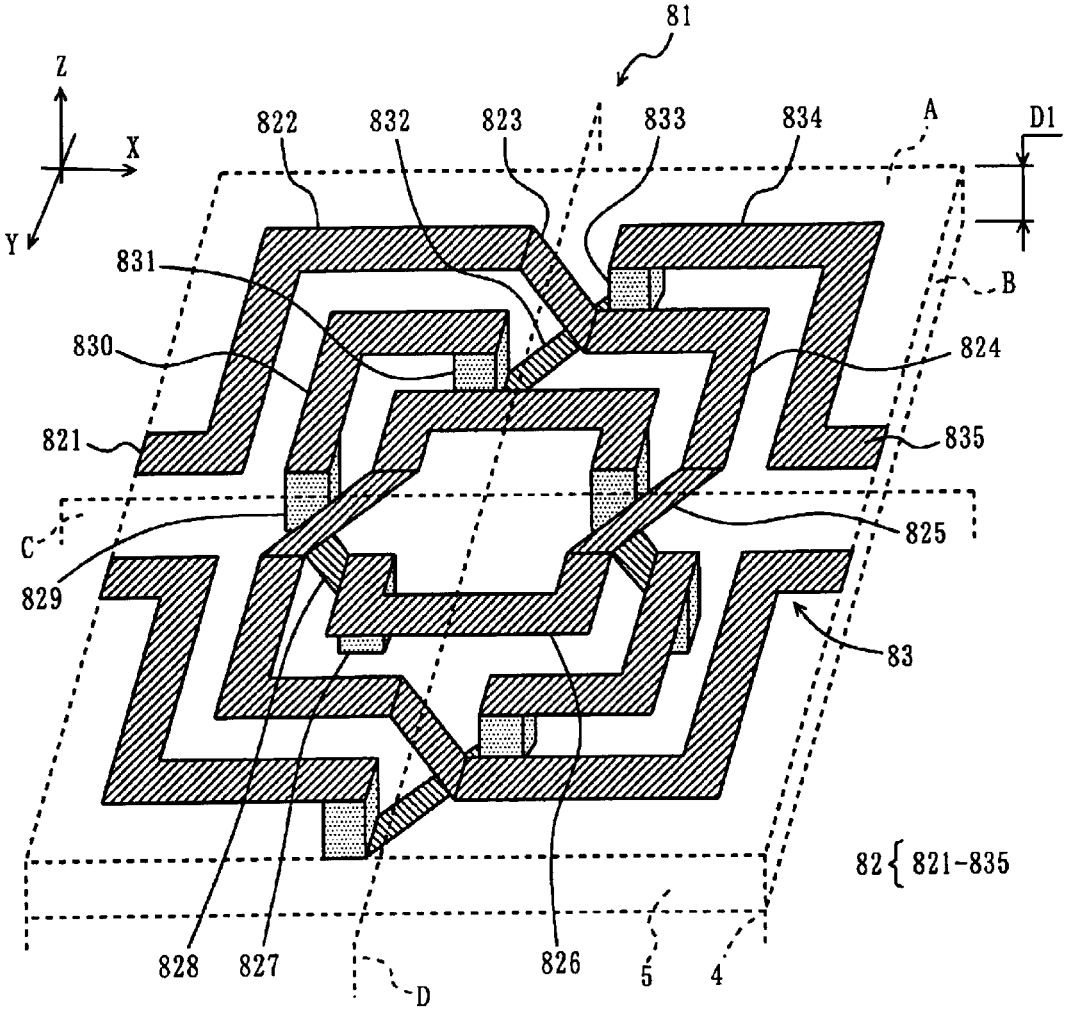
FIG. 28 is a perspective view illustrating a structure of a mutual induction circuit 81 according to a seventh embodiment of the present invention.

FIG. 28 is a perspective view illustrating the structure of common mode chokes which are taken as an example of a mutual induction circuit 81 according to a seventh embodiment of the present invention. For ease of description, a three-dimensional coordinate system as described in other embodiment is shown in FIG. 28. In FIG. 28, similar to the mutual induction circuit 1, the mutual induction circuit 81 is formed using two wiring layers, i.e., upper and lower wiring layers, within the interlayer insulating film 5 on the semiconductor substrate 4. In the following descriptions, the upper wiring layer, the lower wiring layer, and a space between the upper and lower wiring layer are referred to as an "upper layer, a "lower layer, and an "interlayer", respectively. Specifically, the mutual induction circuit 81 is made of a conductive material, and essentially includes a first inductor 82 and a second inductor 83.

Figure 29:
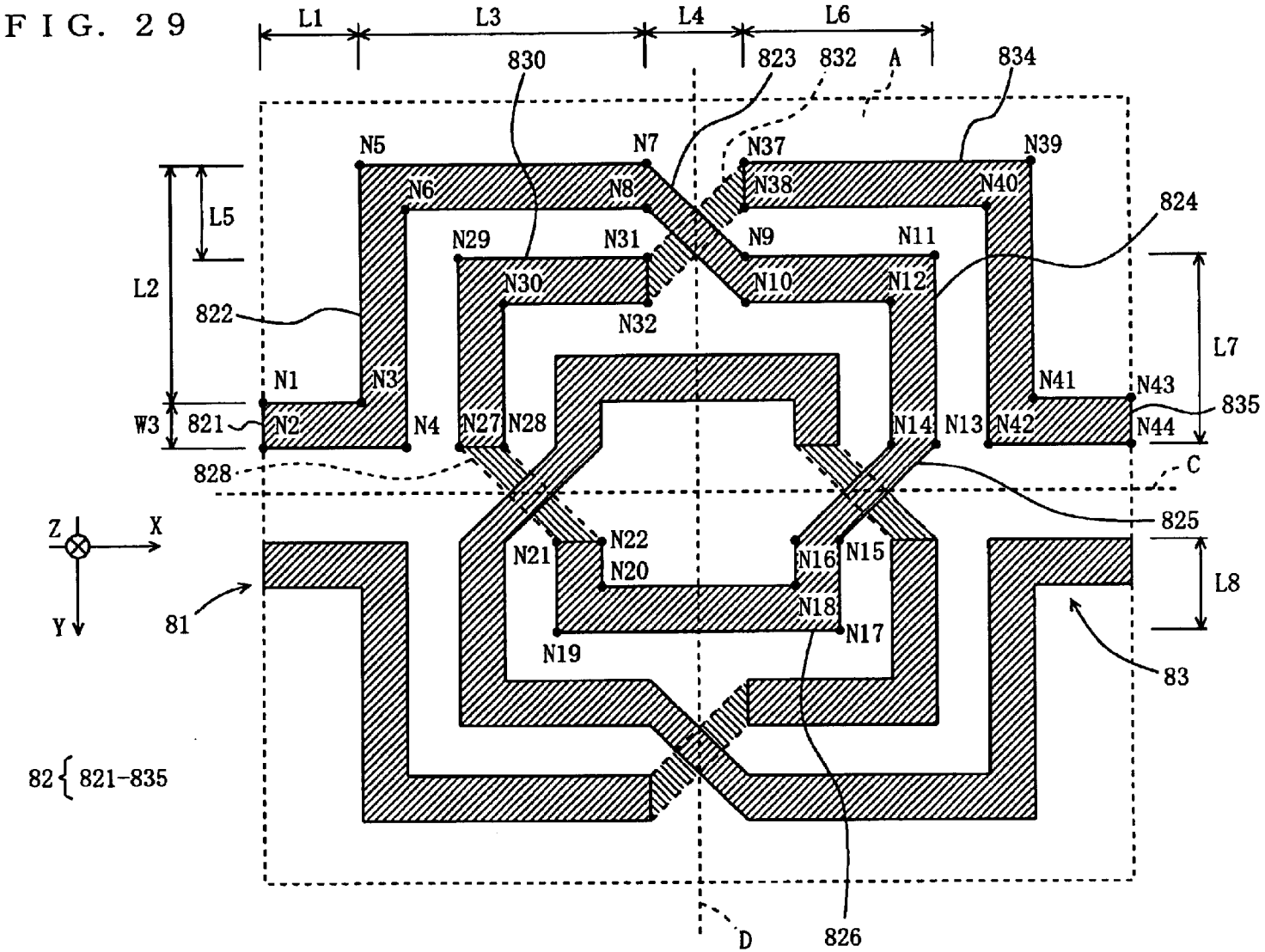
FIG. 29 is across-sectional view of the mutual induction circuit 81 taken along plane A (see FIG. 28) parallel to the XY plane.
Figure 30:
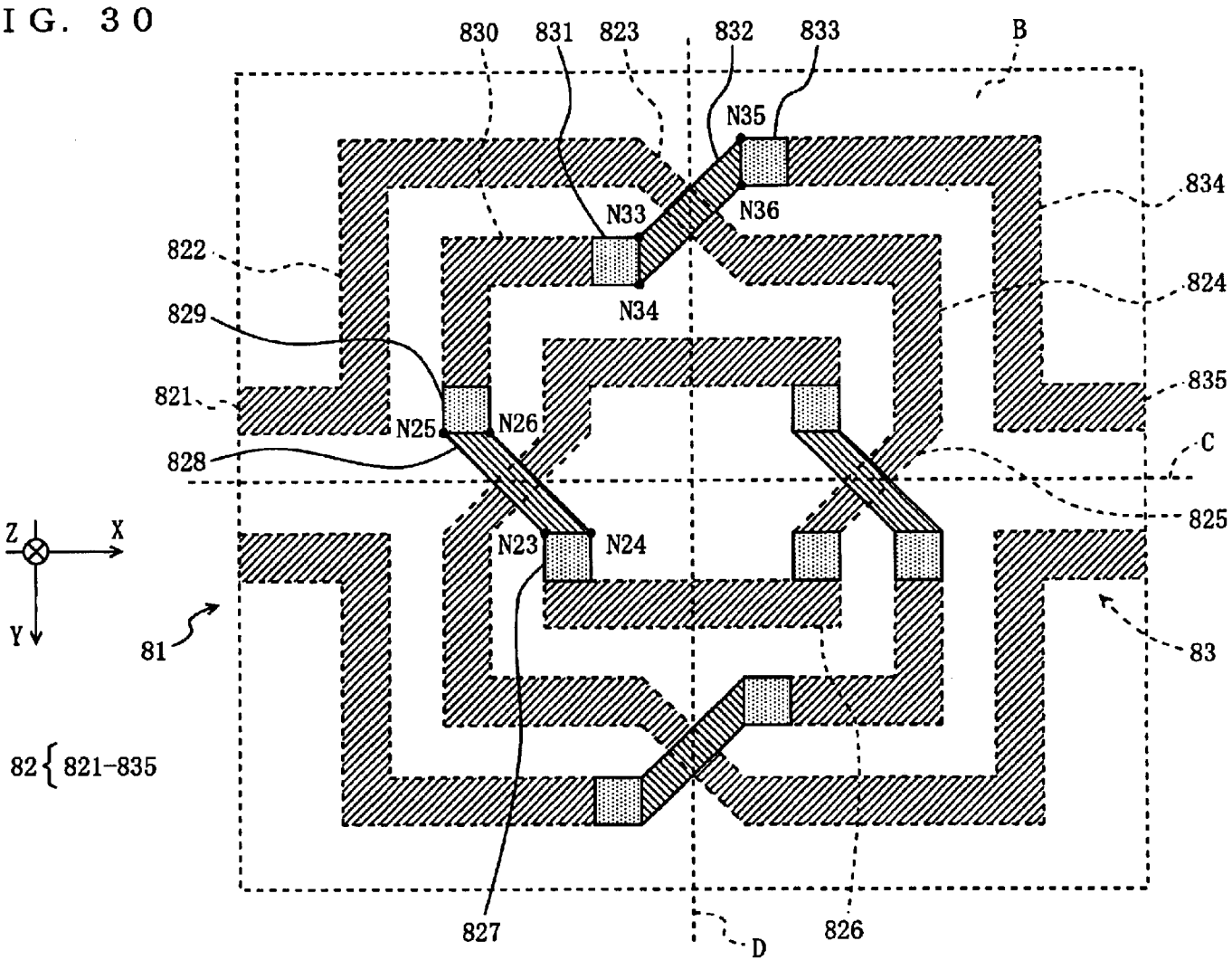
FIG. 30 is a cross-sectional view of the mutual induction circuit 81 taken along plane B (see FIG. 28), which is included in a lower layer and corresponds to a plane translated from plane A (see FIG. 28) by a distance of D1 along the negative direction of the Z-axis.

FIG. 29 is a cross-sectional view of the mutual induction circuit 81 taken along plane A (see FIG. 28) parallel to the XY plane in the upper layer. FIG. 30 is a cross-sectional view of the mutual induction circuit 81 taken along plane B (see FIG. 28), which is included in the lower layer and corresponds to a plane translated from plane A (see FIG. 28) by a distance of D1 along the negative direction of the Z-axis. Note that in FIGS. 29 and 30, elements of the mutual induction circuit 81, which are not present on either plane A or B, are all indicated by dotted lines. In FIGS. 28 through 30, plane C is a reference plane parallel to the ZX plane and passing through the center of the mutual induction circuit 81, and plane D is a reference plane parallel to the YZ plane and passing through the center of the mutual induction circuit 81.

As shown in FIGS. 28 through 30, most elements of the first inductor 82 are present on plane A, and other elements are present either on plane B or in the interlayer. Specifically, the first inductor 82 includes a first input terminal 821, a second line 822, a first connection line 823, a second line 824, a second connection line 825, a third line 826, a third contact 827, a third connection line 828, a second contact 829, a fourth line 830, a third contact 831, a fourth connection line 832, a fourth contact 833, a fifth line 834, and a first output terminal 835.

Most of the above elements are provided in the upper layer, i.e., on plane A. Specifically, as shown in FIG. 29, provided on plane A are the first input terminal 821, the first line 822, the first connection line 823, the second line 824, the second connection line 825, the third line 826, the fourth line 830, the fifth line 834, and the first output terminal 835.

As shown in FIG. 30, among elements other than those situated on the plane A, the third connection line 828 and the fourth connection line 832 are situated in the lower layer, i.e., on plane B.

Further, as shown in FIG. 30, the first contact 827, the second contact 829, the third contact 831, and the fourth contact 833 are situated in the interlayer.

In the present embodiment, the first terminal 821 is exemplarily shown as an end of the first line 822.

The first line 822 is typically a microstrip line, and electrically connects the first terminal 821 to the first connection line 823 as described below. In the present embodiment, the first line 822 is exemplarily formed within an area defined by the following eight points N1 through N8 on plane B (see FIG. 29). Point N1 has X- and Y-coordinate values (X1,−Y1), where X1 and Y1 are positive values determined in accordance with the specifications of the mutual induction circuit 81. If the width of the first line 822 is W3, point N2 corresponds to a point translated from point N1 by a distance of W3 along the positive direction of the Y-axis. Point N3 corresponds to a point translated from point N1 by a distance of L1 along the positive direction of the X-axis. Point N4 corresponds to a point translated from point N2 by a distance of L1+W3 along the positive direction of the X-axis. Point N5 corresponds to a point translated from point N3 by a distance of L2 along the negative direction of the Y-axis. Point N6 corresponds to a point translated from point N4 by a distance of L2 along the negative direction of the Y-axis. Point N7 corresponds to a point translated from point N5 by a distance of L3 along the positive direction of the x-axis. Point N8 corresponds to a point translated from point N6 by a distance of L3−W3 along the positive direction of the X-axis. Note that L1 through L3 are values determined in accordance with the specifications of the mutual induction circuit 81, and in particular, L2 and L3 are determined in relation to the number of turns in the first inductor 82. In the present embodiment, the number of turns is assumed to be one, and in order to ensure the symmetry of the mutual induction circuit 81, L2 and L3 are selected so as to be greater than 2×W3 and 3×W3, respectively.

The first connection line 823 is typically a microstrip line, and electrically connects the first line 822 to the second line 824 as described below. In the present embodiment, the first connection line 823 is exemplarily formed within a parallelogram defined by four points N7 through N10 (see FIG. 29). Points N7 and N8 are as described above. Point N9 corresponds to a point translated from point N7 by a distance of L4 along the positive direction of the X-axis and a distance of L5 along the positive direction of the Y-axis. Point N10 corresponds to a point translated from point N8 by a distance of L4 along the positive direction of the X-axis and a distance of L5 along the positive direction of the Y-axis. In FIG. 29, L4 and L5 are arbitrary numbers determined in accordance with the specifications of the mutual induction circuit 81, and L5 is selected so as to be greater than W3.

The second line 824 is typically a microstrip line, and electrically connects the first connection line 823 to the second connection line 825 as described below. In the present embodiment, the second line 824 is exemplarily formed within a parallelogram enclosed by the following six points N9 through N14 (see FIG. 29). Points N9 and N10 are as described above. Point N11 corresponds to a point translated from point N9 by a distance of L6 along the positive direction of the X-axis. Point N12 corresponds to a point translated from point N10 by a distance of L6−W3 along the positive direction of the X-axis. Note that L6 is determined in accordance with the specifications of the mutual induction circuit 71 so as to be greater than 2×W3. Point N13 corresponds to a point translated from point N11 by a distance of L7 along the positive direction of the Y-axis. Point N14 corresponds to a point translated from point N12 by a distance of L7−W3 along the positive direction of the Y-axis. Note that L7 is determined in accordance with the specifications of the mutual induction circuit 81 so as to be greater than 2×W2.

The second connection line 825 is typically a microstrip line, and electrically connects the second line 824 to the third line 826 as described below. In the present embodiment, the second connection line 825 is exemplarily formed within a parallelogram enclosed by the following four points N13 through N16 (see FIG. 29). Point N13 and N14 are as described above. Point n15 corresponds to a point translated from point N13 by a distance of L5 along the positive direction of the Y-axis and a distance of L4 along the negative direction of the X-axis. Point N16 corresponds to a point translated from point N14 by a distance of L5 along the positive direction of the Y-axis and a distance of L4 along the negative direction of the X-axis.

The third line 826 is typically a microstrip line, and electrically connects the second connection line 825 to the first contact 827 as described below. In the present embodiment, the third line 826 is exemplarily formed within an area enclosed by the following eight points N15 through N22 (see FIG. 29). Points N15 and N16 are as described above. Point N17 corresponds to a point translated from point N15 by a distance of L8 along the positive direction of the Y-axis. Point N18 corresponds to a point translated from point N16 by a distance of L8−W3 along the positive direction of the Y-axis. Note that L8 is determined in accordance with the specifications of the mutual induction circuit 81 so as to be greater than W3. Points N19 and N20 are situated symmetrical to points N17 and N18, respectively, with respect to plane D. Points N21 and N22 are situated symmetrical to points N15 and N16, respectively, with respect to plane D.

The first contact 827 electrically connects points N21 and N22 on the third line 826 to points N23 and N24 on the third line 828 as described below.

The third connection line 828 is typically a microstrip line. The third connection line 828 is formed within a parallelogram enclosed by four points N23 through N26 (see FIG. 30) so as to be situated symmetrically to the second connection line 825 with respect to plane D.

The second contact 829 is situated where the first contact 827 is translated by a distance of L5 along the negative direction of the Y-axis and a distance of L4 along the negative direction of the X-axis. The second contact 829 electrically connects at least points N25 and N26 on the third connection line 828 to points N27 and N28 on the fourth line 830 as described below.

The fourth line 830 is typically a microstrip line, and formed within an area symmetrical to the second line 824 with respect to plane D (i.e., an area enclosed by points N27 through N32).

The third contact 831 electrically connects points N31 and N32 on the fourth line 830 to points N33 and N34 on the fourth connection line 832 as described below.

The forth connection line 832 is typically a microstrip line, and formed within a parallelogram enclosed by four points N33 through N36 (see FIG. 30) so as to be situated symmetrical to the first connection line 823 with respect to plane D.

The fourth contact 833 is situated where the third contact 827 is translated by a distance of L5 along the negative direction of the Y-axis and a distance of L4 along the positive direction of the X-axis. The fourth contact 833 electrically connects at least points N35 and N36 on the fourth connection line 832 to points N37 and N38 on the fifth line 834 as described below.

The fifth line 834 is typically a microstrip line, and formed within an area situated symmetrical to the first line 822 with respect to plane D (i.e., an area enclosed by points N37 through N44).

The first output terminal 835 is situated symmetrical to the first input terminal 821 with respect to plane D.

Described next is the second inductor 83. The second inductor 83 has a shape obtained by rotating the first inductor 82 by 180 degrees about an intersection line extending between planes C and D. Accordingly, the first and second inductors 82 and 83 are substantially symmetrical to each other with respect to plane C or D.

In the thus-configured first inductor 82, if an in-phase signal contained in a differential signal is inputted into the first input terminal 821, a current loop is formed, thereby generating magnetic flux. Thereafter, the inputted in-phase signal is outputted from the first output terminal 835. In the second inductor 83, if a reverse-phase signal contained in the differential signal is inputted into a second input terminal adjacent to the first input terminal 821 along the Y-axis direction, a current loop is generated, thereby generating magnetic flux. The second inductor 83 is situated such that magnetic flux generated in the first inductor 82 passes therethrough, and the current loops in the first and second inductors 82 and 83 are generated in the same direction. Accordingly, due to mutual induction, the inputted positive- and reverse-phase signals are outputted while mutually intensifying each other.

The thus-configured mutual induction circuit 81 has all features of the mutual induction circuit 1, and therefore can achieve a technical effect similar to that achieved by the mutual induction circuit 1. Each of the first and second inductors 82 and 83 has input and output terminals in its outermost turn. Accordingly, it is easy to connect leads from each of the first and second inductors 82 and 83 as well as to keep the leads away from looped portions of the first and second inductors 82 and 83. Therefore, even if current flows through the leads, magnetic field generated thereby is unlikely to cause an adverse effect to loop current.

Note that as in the case of the mutual induction circuit 51 (see FIG. 18), the mutual induction circuit 81 may include inductors each formed by two layers, i.e., the upper and lower layers.

(Eighth Embodiment)

Figure 31:
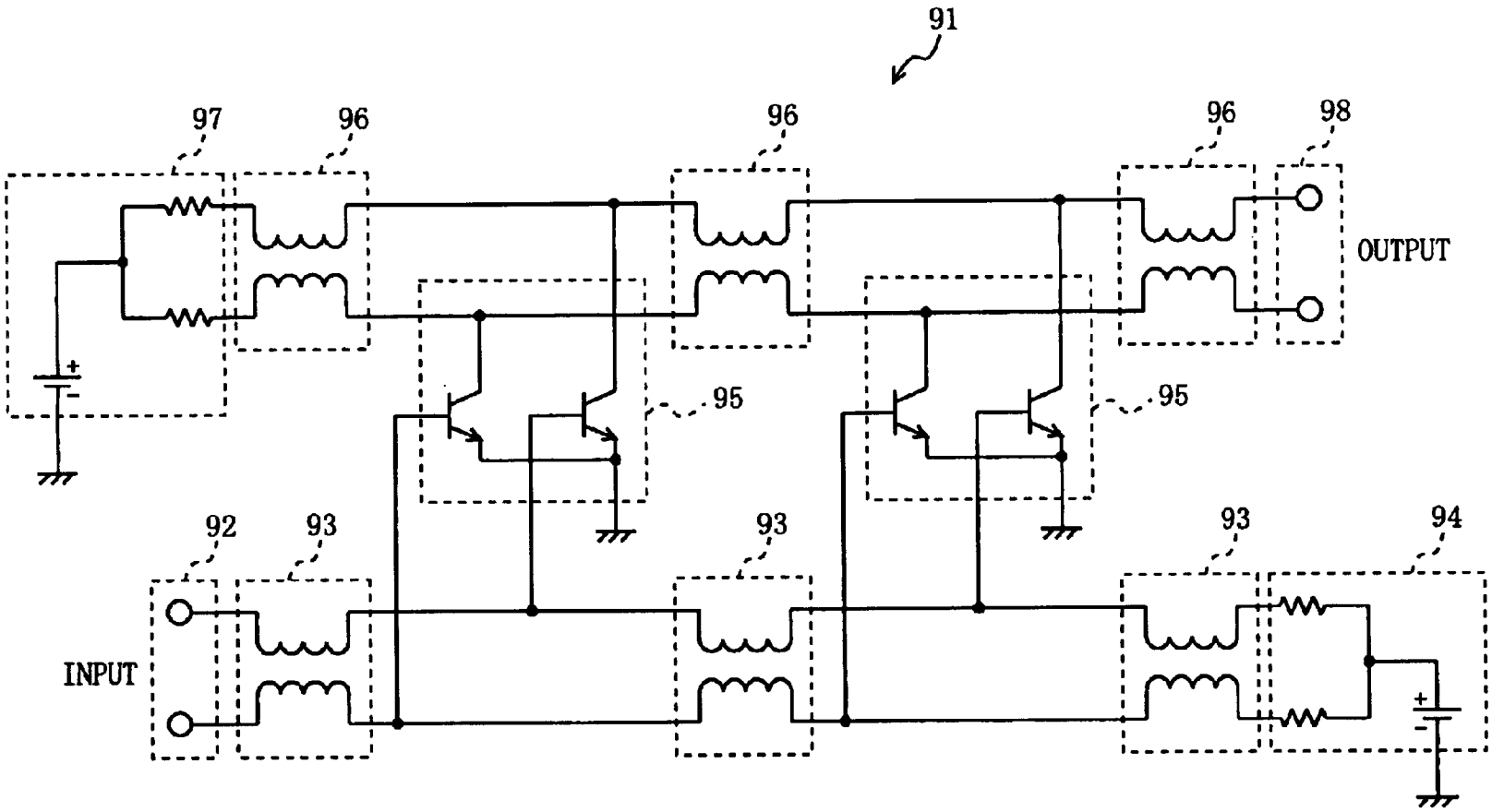
FIG. 31 is a circuit diagram illustrating the overall structure of an amplification circuit 91 according to an eighth embodiment of the present invention.
Figure 32A:
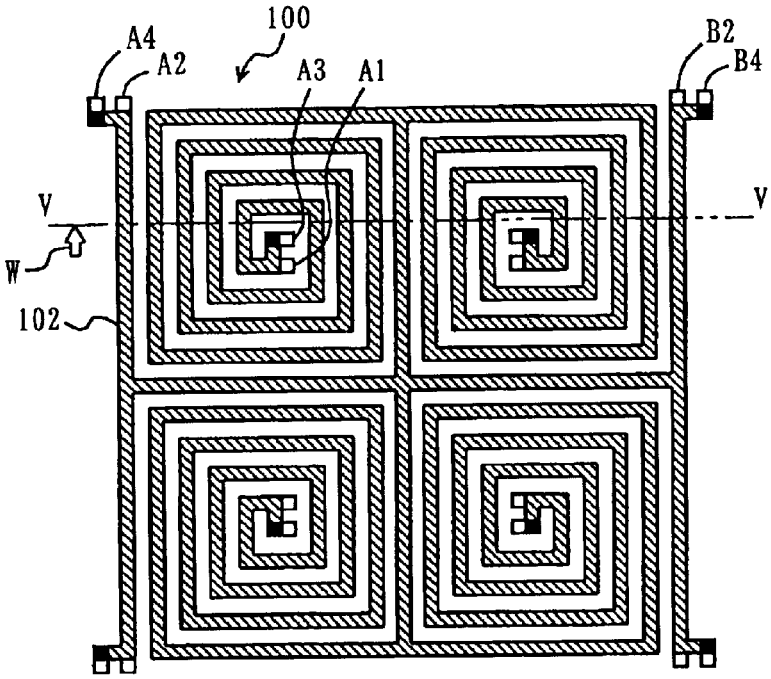
FIG. 32A PRIOR ART
FIG. 32A is a top view schematically illustrating a structure of a transformer element (a first mutual induction circuit 100) which is a first exemplary conventional mutual induction circuit.
Figure 32B:
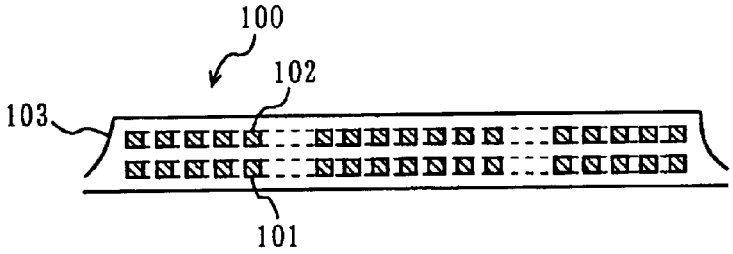
FIG. 32B PRIOR ART
FIG. 32B is a schematic view illustrating a cross section of the first mutual induction circuit 100 taken along line V—V shown in FIG. 32A and viewed from the direction of arrow W1.
Figure 33:
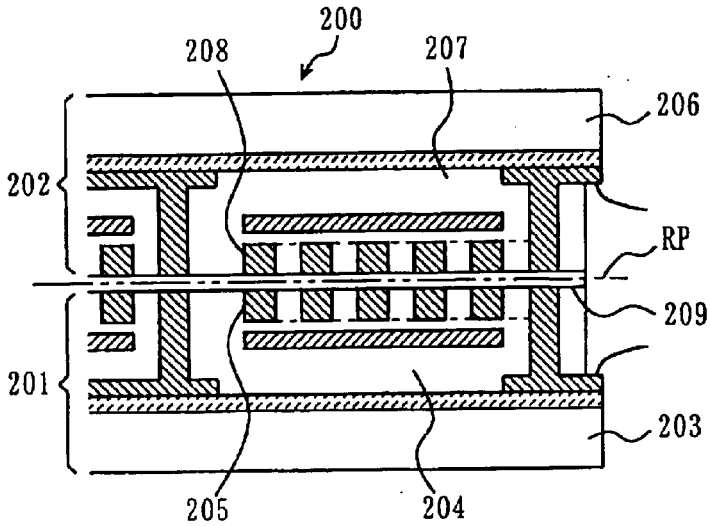
FIG. 33 PRIOR ART
FIG. 33 is a vertical cross-sectional view schematically illustrating a structure of a transformer element (a second mutual induction circuit 200) which is a second exemplary conventional mutual circuit.
Figure 34A:
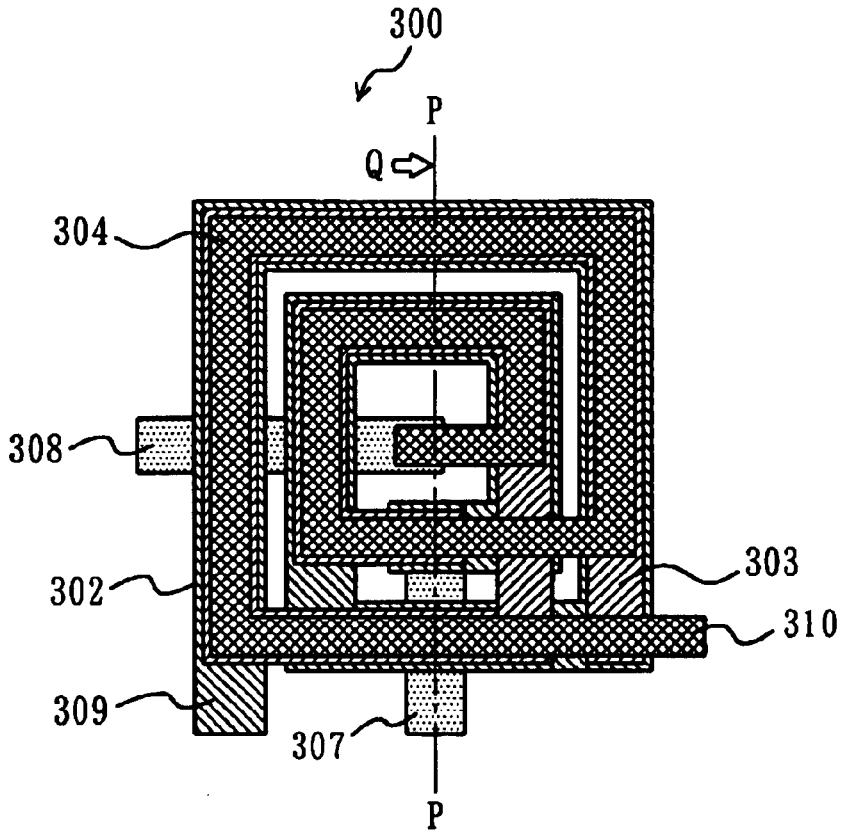
FIG. 34A PRIOR ART
FIG. 34A is a top view schematically illustrating a structure of a transformer element (a third mutual induction circuit 300) which is a third exemplary conventional mutual induction circuit.
Figure 34B:
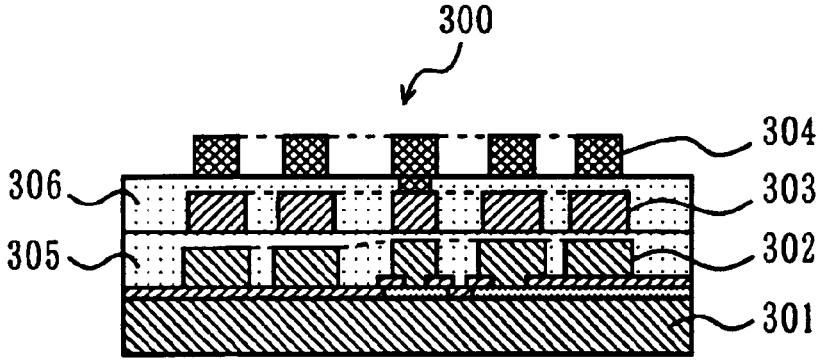
FIG. 34B PRIOR ART
FIG. 34B is a cross-sectional view of the third mutual induction circuit 300 taken along line P—P shown in FIG. 34A and viewed from the direction of arrow Q.
Figure 35:
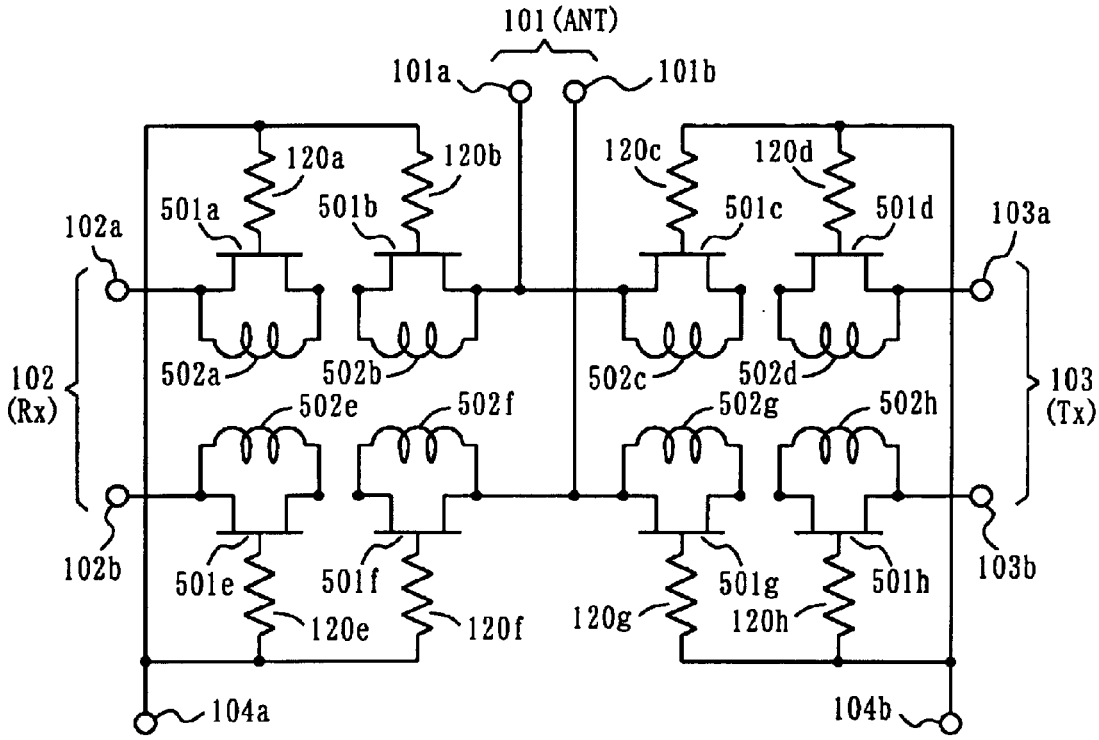
FIG. 35 PRIOR ART
FIG. 35 is a schematic diagram illustrating the structure of a differential switch circuit including a differential inductor element as a conventional mutual induction circuit.
Figure 36:
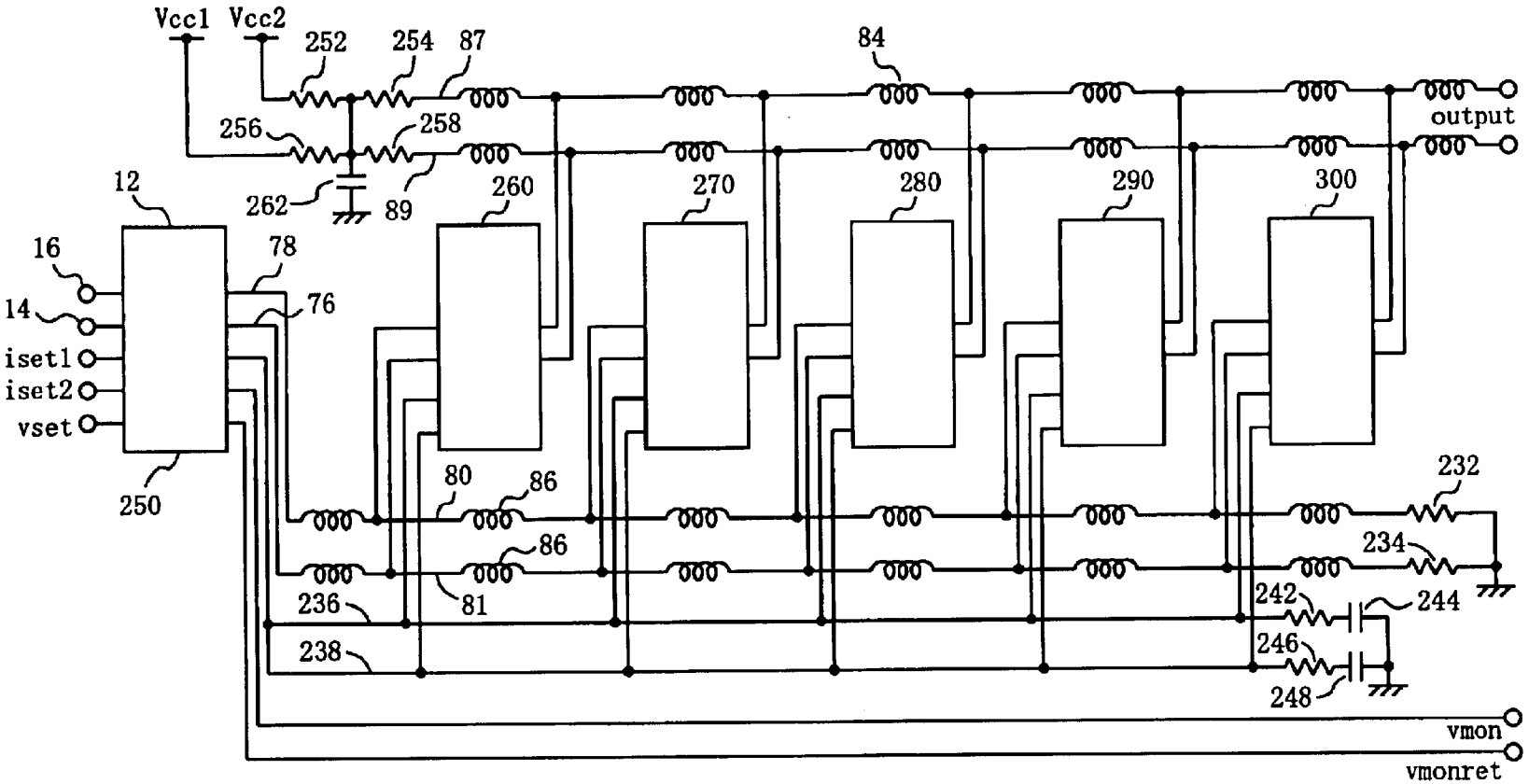
FIG. 36 PRIOR ART
FIG. 36 is a schematic diagram illustrating a structure of a differential distributed amplifier circuit including a differential inductor element as a conventional mutual induction circuit.
Figure 37A:
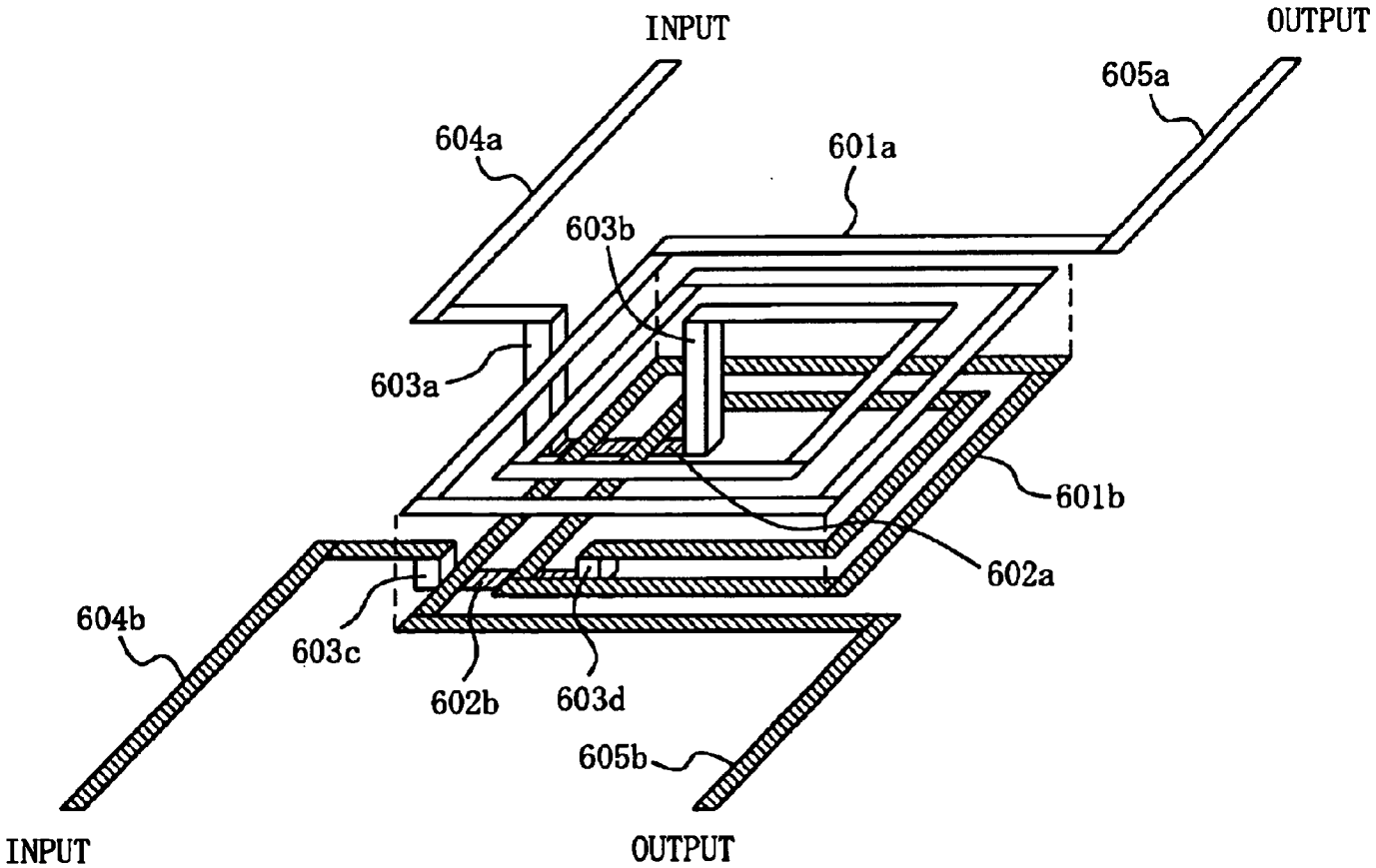
FIG. 37A PRIOR ART
FIG. 37A is a perspective view illustrating an exemplary structure of the differential inductor element shown in FIG. 36.
Figure 37B:
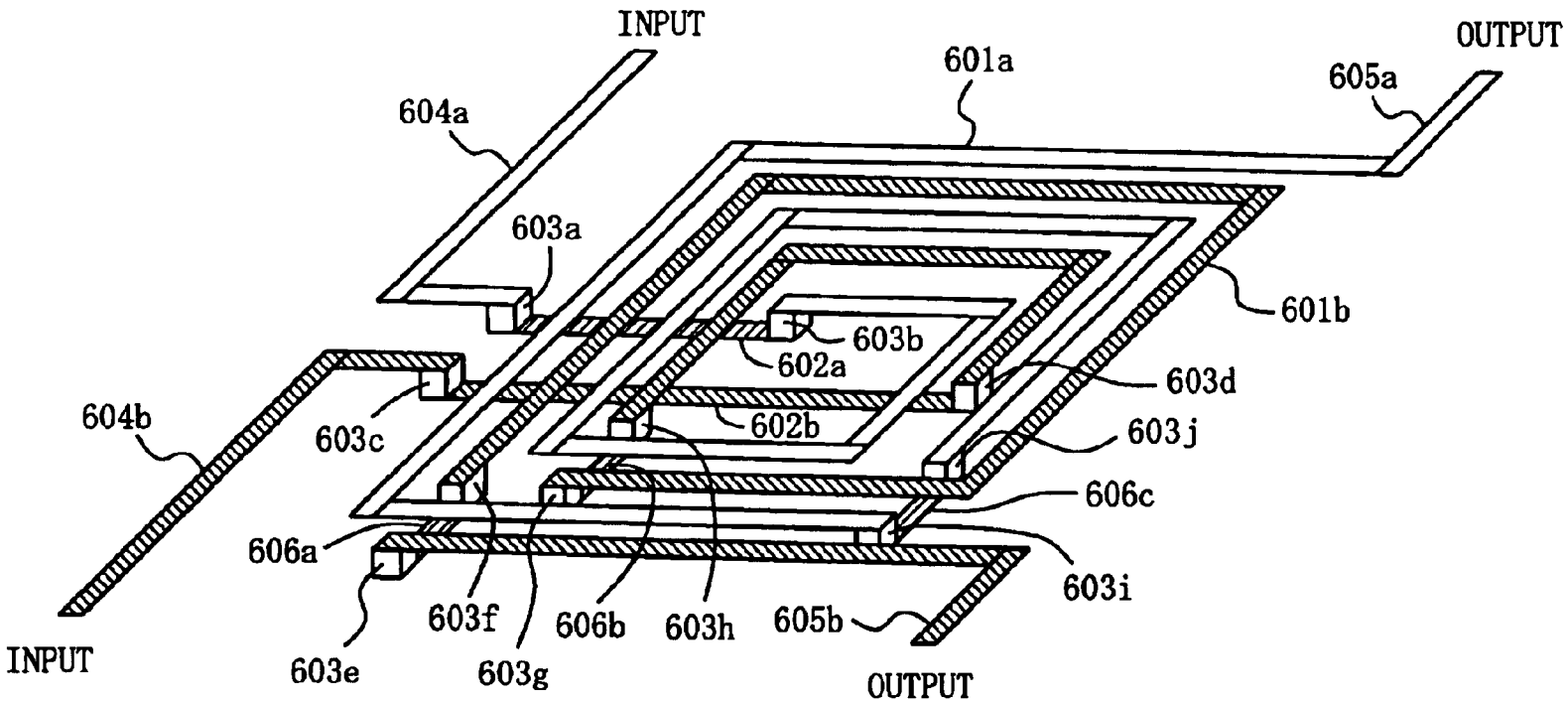
FIG. 37B PRIOR ART
FIG. 37B is a perspective view illustrating another exemplary structure of the differential inductor element shown in FIG. 36.

FIG. 31 is a circuit diagram illustrating the overall structure of an amplification circuit 91 according to an eighth embodiment of the present invention. In FIG. 31, the amplification circuit 91 includes a differential input terminal 92, a plurality of input side mutual induction circuits 93 (three of which are shown in FIG. 31), an input side differential termination circuit 94, a plurality of amplification stages 95 (two of which are shown in FIG. 31), a plurality of output side mutual induction circuits 96 (three of which are shown in FIG. 31), an output side differential termination circuit 97, and a differential output terminal 98.

The differential input terminal 92 is operable to receive a differential signal.

The mutual induction circuits 93 each are equivalent to the mutual induction circuit 81 as described above, and they are connected in series with each other so as to reflect common mode noise which might be superimposed onto an input differential signal.

The input side terminal circuit 94 includes a differential termination resistor, and terminates a differential signal outputted from the mutual induction circuit 93 situated in a previous stage.

In each amplification stage 95, a differential input side is connected to an output side of a corresponding one of the mutual induction circuits 93, and a differential output side is connected to an input side of a corresponding one of the mutual induction circuits 96. Each amplification stage 95 is operable to amplify and output the input differential signal.

The mutual induction circuits 96 each are equivalent to the mutual induction circuit 81 as described above, and they are connected in series between the output side termination circuit 97 and the differential output terminal 98 so as to reflect common mode noise which might be superimposed onto the input differential signal.

The output side termination circuit 97 includes a differential termination resistor, and terminates a differential signal outputted from the mutual induction circuit 96 situated in a previous stage.

The differential output terminal 98 is operable to output a differential signal amplified by each amplification stage 95.

As described above, the amplification circuit 91 has a plurality of mutual induction circuits 81 incorporated therein, and therefore it is possible to flatten gain over a considerably wide range of frequency band. Moreover, the mutual induction circuit 81 is incorporated as common mode chokes, and therefore it is possible to realize an amplification device which is less susceptibility to influence of common mode noise. Also, it is possible to realize a small-footprint amplification circuit which occupies a smaller area of a semiconductor chip.

While the invention has been described in detail, the foregoing description is in all aspects illustrative and not restrictive. It is understood that numerous other modifications and variations can be devised without departing from the scope of the invention.

What is claimed is:

1. A mutual induction circuit formed using first and second wiring layers arranged parallel to each other in a vertical direction, the circuit comprising:

a first inductor; and a second inductor situated such that a magnetic flux induced in the first inductor passes therethrough, wherein the first and second inductors are each provided using the first and second wiring layers such that if projected into one of the first and second wiring layers either along a vertical upward direction or a vertical downward direction, outlines of a projection form a symmetrical shape with respect to a first reference plane, and portions corresponding to intersections between the outlines of the projection on the wiring layer are formed so as to be out of contact with each other.

2. The mutual induction circuit according to claim 1, wherein the mutual induction circuit is a transformer element, wherein the first inductor includes first and second input terminals to which in-phase and reverse-phase signals contained in a differential signal are inputted, the in-phase and reverse-phase signals inputted into the first and second input terminals inducing a magnetic flux, and wherein the second inductor includes first and second output terminals from which transformed in-phase and reverse-phase signals are outputted via mutual induction with the first inductor.

3. The mutual induction circuit according to claim 2, wherein either one of the first and second inductors includes:

a plurality of pairs of first and second partially looped lines provided in either the first or second wiring layer along a direction from an outer circumferential side to an inner circumferential side, such that the first and second partially looped lines in each pair are situated symmetrical to and separate from each other with respect to the first reference plane; and at least one connection line formed in another one of the first and second wiring layers, so as to connect, via two contacts formed between the first and second wiring layers, one first partially looped line formed on the outer circumferential side to one second partially looped line situated one turn inward from the one first partially looped line situated on the outer circumferential side.

4. The mutual induction circuit according to claim 2, wherein the first inductor includes:

a plurality of pairs of first and second partially looped lines provided in the first wiring layer along a direction from an outer circumferential side to an inner circumferential side, such that the first and second partially looped lines in each pair are situated symmetrical to and separate from each other with respect to the first reference plane;

a first connection line formed in the second wiring layer, so as to connect, via two contacts, one first partially looped line formed on the outer circumferential side at a first side with respect to the first reference plane to one second partially looped line situated one turn inward from the one first partially looped line so as to be opposed to the one first partially looped line at a second side with respect to the first reference plane; and a second connection line formed in the first wiring layer, so as to connect one first partially looped line formed on the outer circumferential side at the second side with respect to the first reference plane to one second partially looped line situated one turn inward from the one first partially looped line so as to be opposed to the one first partially looped line at the first side with respect to the first reference plane, wherein the second inductor includes:

a plurality of pairs of first and second partially looped lines provided in the second wiring layer along a direction from the outer circumferential side to the inner circumferential side, such that the first and second partially looped lines in each pair are situated symmetrical to and separate from each other with respect to the first reference plane;

a first connection line formed in the first wiring layer, so as to connect, via two contacts, one first partially looped line formed on the outer circumferential side at the first side with respect to the first reference plane to one second partially looped line situated one turn inward from the one first partially looped line so as to be opposed to the one first partially looped line at the second side with respect to the first reference plane; and a second connection line formed in the second wiring layer, so as to connect one first partially looped line formed on the outer circumferential side at the second side with respect to the first reference plane to one second partially looped line situated one turn inward from the one first partially looped line so as to be opposed to the one first partially looped line at the first side with respect to the first reference plane.

5. The mutual induction circuit according to claim 4, wherein the first and second partially looped lines included in the second inductor are absent vertically immediately below or above the first and second partially looped lines included in the first inductor.

6. The mutual induction circuit according to claim 4, further comprising a contact for electrically connecting a virtual center of the first inductor to a virtual center of the second inductor.

7. The mutual induction circuit according to claim 2, wherein the first inductor includes:

a plurality of pairs of first and second partially looped lines provided in the first wiring layer along a direction from an outer circumferential side to an inner circumferential side, such that the first and second partially looped lines in each pair are situated symmetrical to and separate from each other with respect to the first reference plane;

a first connection line formed in the second wiring layer, so as to connect, via two contacts, one first partially looped line formed on the outer circumferential side at a first side with respect to the first reference plane to one second partially looped line situated one turn inward from the one first partially looped line so as to be opposed to the one first partially looped line at a second side with respect to the first reference plane; and a second connection line formed in the first wiring layer, so as to connect one first partially looped line formed on the outer circumferential side at the second side with respect to the first reference plane to one second partially looped line situated one turn inward from the one first partially looped line so as to be opposed to the one first partially looped line at the first side with respect to the first reference plane, and wherein the second inductor includes:

a plurality of pairs of first and second partially looped lines provided in the first wiring layer along a direction from the outer circumferential side to the inner circumferential side, so as to alternate with the plurality of pairs of first and second partially looped lines included in the first inductor;

a first connection line formed in the first wiring layer, so as to connect, via two contacts, one first partially looped line formed on the outer circumferential side at the first side with respect to the first reference plane to one second partially looped line situated one turn inward from the one first partially looped line so as to be opposed to the one first partially looped line at the second side with respect to the first reference plane; and a second connection line formed in the second wiring layer, so as to connect one first partially looped line formed on the outer circumferential side at the second side with respect to the first reference plane to one second partially looped line situated one turn inward from the one first partially looped line so as to be opposed to the one first partially looped line at the first side with respect to the first reference plane.

8. The mutual induction circuit according to claim 7, wherein the first and second inductors are shaped so as to be symmetrical to each other with respect to a second reference plane perpendicular to the first reference plane.

9. The mutual induction circuit according to claim 2, wherein the first inductor includes:

a plurality of pairs of first and second partially looped lines provided in the first wiring layer along a direction from an outer circumferential side to an inner circumferential side, such that the first and second partially looped lines in each pair are situated symmetrical to and separate from each other with respect to the first reference plane;

a first connection line formed in the second wiring layer, so as to connect, via two contacts, one first partially looped line formed on the outer circumferential side at a first side with respect to the first reference plane to one second partially looped line situated one turn inward from the one first partially looped line so as to be opposed to the one first partially looped line at a second side with respect to the first reference plane; and a second connection line formed in the first wiring layer, so as to connect one first partially looped line formed on the outer circumferential side at the second side with respect to the first reference plane to one second partially looped line situated one turn inward from the one first partially looped line so as to be opposed to the one first partially looped line at the first side with respect to the first reference plane, wherein the second inductor includes:

a plurality of pairs of first and second partially looped lines provided in the first wiring layer along a direction from the outer circumferential side to the inner circumferential side, so as to alternate with the plurality of pairs of first and second partially looped lines included in the first inductor;

a first connection line formed in the first wiring layer, so as to connect, via two contacts, one first partially looped line formed on the outer circumferential side at the first side with respect to the first reference plane to one second partially looped line situated one turn inward from the one first partially looped line so as to be opposed to the one first partially looped line at the second side with respect to the first reference plane; and a second connection line formed in the second wiring layer, so as to connect one first partially looped line formed on the outer circumferential side at the second side with respect to the first reference plane to one second partially looped line situated one turn inward from the one first partially looped line so as to be opposed to the one first partially looped line at the first side with respect to the first reference plane, and wherein the first partially looped lines included in the second inductor are adjacent to each other in the first wiring layer, and the second partially looped lines included in the second inductor are adjacent to each other in the first wiring layer.

10. The mutual induction circuit according to claim 7, further comprising a line for electrically connecting a virtual center of the first inductor to a virtual center of the second inductor.

11. The mutual induction circuit according to claim 7, wherein the first wiring layer is thicker than the second wiring layer.

12. The mutual induction circuit according to claim 2, wherein the first and second input terminals are situated at opposite ends of a line forming an outermost turn of the first inductor, and the first and second output terminals are situated at the opposite ends of the line forming the outermost turn of the first inductor.

13. The mutual induction circuit according to claim 7, further comprising:

a third inductor having first and second input terminals for receiving the in-phase and reverse-phase signals contained in the differential signal inputted into the first inductor, the received in-phase and reverse-phase signals inducing the magnetic flux; and a fourth inductor situated such that the magnetic fluxes induced in the first and third inductor pass therethrough, and the fourth inductor including first and second output terminals from which transformed in-phase and reverse-phase signals are outputted via mutual induction with the first inductor, wherein the third and fourth inductors are formed in the second wiring layer so as to have substantially the same shape as those of projections of the first and second inductors onto one surface of the second wiring layer along the vertical downward direction, and wherein the first and third inductors are electrically connected together via a plurality of contacts, and the second and fourth inductors are electrically connected together via a plurality of contacts.

14. The mutual induction circuit according to claim 13, further comprising:

a line for connecting a virtual center of the first inductor to a virtual center of the second inductor; and a line for connecting a virtual center of the third inductor to the virtual center of the second inductor.

15. The mutual induction circuit according to claim 2, wherein the first and second wiring layers are formed on a semiconductor substrate, wherein the mutual induction circuit further includes a shield formed in a third wiring layer which is closer to the semiconductor substrate than the first and second wiring layers are, and wherein the shield has a radial pattern or radially arranged holes.

16. The mutual induction circuit according to claim 2, wherein the first and second wiring layers are formed on a semiconductor substrate, and wherein the mutual induction circuit further includes radially arranged trenches situated closer to the semiconductor substrate than the first and second wiring layers are.

17. The mutual induction circuit according to claim 2, wherein the first and second wiring layers are formed on a dielectric laminated substrate.

18. The mutual induction circuit according to claim 2, wherein the first and second wiring layers are formed on a dielectric single layer double-sided substrate.

19. The mutual induction circuit according to claim 2, wherein the mutual induction circuit is a balun, and wherein one of the first and second input terminals or one of the first and second output terminals is grounded.

20. The mutual induction circuit according to claim 1, wherein the first inductor includes a first input terminal and a first output terminals which are used for receiving and outputting the in-phase signal contained in the differential signal, the in-phase signal received by the first input terminal inducing the magnetic flux, and wherein the second inductor includes a second input terminal and a second output terminal which are used for receiving and outputting the reverse-phase signal contained in the differential signal, the reverse-phase signal received by the second input terminal inducing the magnetic flux.

21. An oscillation circuit comprising:

an oscillation stage for generating a differential signal having a predetermined frequency;

a mutual induction circuit for transforming the differential signal generated by the oscillation stage; and an amplification stage for amplifying the differential signal amplified by the mutual induction circuit, wherein the mutual induction circuit is a transformer element formed on a semiconductor substrate using first and second wiring layers which are parallel to each other in a vertical direction, the transformer element comprising:

a first inductor including first and second input terminals to which in-phase and reverse-phase signals contained in the differential signal generated by the oscillation stage are inputted, the inputted in-phase and reverse-phase signals inducing a magnetic flux;

a second inductor situated such that the magnetic flux induced in the first inductor passes therethrough, and includes first and second output terminals from which transformed in-phase and reverse-phase signals are outputted via mutual induction with the first inductor; and a contact for electrically connecting a virtual center of the first inductor to a virtual center of the second inductor, wherein the first and second inductors are each provided using the first and second wiring layers such that if projected into one of the first and second wiring layers either along a vertical upward direction or a vertical downward direction, outlines of a projection form a symmetrical shape with respect to a predetermined reference plane, and portions corresponding to intersections between the outlines of the projection on the wiring layer are formed so as to be out of contact with each other.

22. The oscillation circuit according to claim 21, wherein the oscillation circuit is incorporated into a radio communication apparatus.

23. An amplification circuit comprising:

a plurality of first mutual induction circuits connected in series with each other, each of the first mutual induction circuit operable to receive a differential signal;

a first termination circuit connected to a last one of the plurality of first mutual induction circuits and including at least a differential termination resistor;

a plurality of amplification stages for amplifying differential signals outputted from all but the last one of the plurality of the first mutual induction circuits;

a second termination circuit including at least a differential termination resistor and terminating a differential signal outputted from each of the amplification stages; and a plurality of second mutual induction circuits connected in series with each other, wherein one of the plurality of second mutual induction circuits is connected to the second termination circuit, and all but the one of the plurality of second mutual induction circuits each are connected to a corresponding one of the plurality of amplification stages, wherein each of the plurality of first and second mutual induction circuits is formed using first and second wiring layers arranged parallel to each other in a vertical direction, each of the plurality of first and second mutual induction circuits comprising:

a first inductor; and a second inductor situated where a magnetic flux induced in the first inductor passes therethrough, and wherein the first and second inductors are each provided using the first and second wiring layers such that if projected into one of the first and second wiring layers either along a vertical upward direction or a vertical downward direction, outlines of a projection form a symmetrical shape with respect to a predetermined reference plane, and portions corresponding to intersections between the outlines of the projection on the wiring layer are formed so as to be out of contact with each other.

* * * * *